US005328787A

United States Patent [19]

Clifford et al.

[11] Patent Number: 5,328,787

[45] Date of Patent: Jul. 12, 1994

[54] METHOD FOR ASSESSING AND CONTROLLING THE SENSITOMETRIC CHARACTERISTICS OF PHOTOGRAPHIC PRODUCTS

[75] Inventors: James D. Clifford, Rochester, N.Y.; Raymond J. Robbins, Hurstbridge, Australia

[73] Assignee: Eastman Kodak Company, Rochester, N.Y.

[21] Appl. No.: 66,827

[22] Filed: May 24, 1993

[51] Int. Cl.[5] ..... G03C 5/00; G03C 7/00; G03C 1/46

[52] U.S. Cl. ..... 430/30; 430/357; 430/359; 430/504; 430/935; 118/665; 118/688; 354/297; 356/404; 356/406; 427/8

[58] Field of Search ..... 356/404, 406; 354/297; 430/30, 220, 357, 358, 359, 504, 935; 427/8; 118/665, 688

[56] References Cited

U.S. PATENT DOCUMENTS

| | | | |
|---|---|---|---|
| 2,590,830 | 3/1952 | Williford et al. | 23/230 |
| 2,697,036 | 12/1954 | Higgins et al. | 95/2 |
| 2,966,408 | 12/1960 | Land | 96/29 |
| 3,039,687 | 6/1962 | Chope | 235/151 |
| 3,079,079 | 2/1963 | Phister, Jr. et al. | 235/151 |
| 3,186,596 | 6/1965 | Badgett | 222/14 |
| 3,294,859 | 12/1966 | Prater et al. | 260/683.2 |
| 3,303,044 | 2/1967 | Fenley | 117/34 |
| 3,310,663 | 5/1963 | Bouman | 235/151.1 |
| 3,388,652 | 6/1968 | Parrent, Jr. | 95/89 |
| 3,415,645 | 12/1968 | Land | 96/3 |
| 3,430,206 | 2/1969 | Ernyei et al. | 340/172.5 |
| 3,446,946 | 5/1969 | Andeen | 235/150.1 |
| 3,507,617 | 4/1970 | Kliem | 23/230 |
| 3,532,862 | 10/1970 | Dahlin | 235/151.1 |
| 3,534,400 | 10/1970 | Dahlin | 235/151.1 |
| 3,537,820 | 11/1970 | Markant et al. | 23/230 |
| 3,544,325 | 12/1970 | Depoorter et al. | 96/84 |
| 3,547,640 | 12/1970 | Beckett et al. | 96/74 |
| 3,579,271 | 5/1971 | Pomerantz | 250/51.5 |
| 3,594,559 | 7/1971 | Pemberton | 235/151.12 |
| 3,601,589 | 8/1971 | McCarty | 235/150 |
| 3,602,701 | 8/1971 | Boyd, Jr. | 235/150.1 |
| 3,663,228 | 5/1972 | Wyckoff | 96/74 |
| 3,671,725 | 6/1972 | Bakke | 235/150.1 |
| 3,672,898 | 6/1972 | Schwan et al. | 96/74 |
| 3,700,335 | 10/1972 | Seelbinder | 356/201 |
| 3,725,071 | 4/1973 | Seelbinder et al. | 96/94 |
| 3,767,900 | 10/1973 | Chao et al. | 235/151.1 |

(List continued on next page.)

FOREIGN PATENT DOCUMENTS 0176794 9/1985 European Pat. Off. .

OTHER PUBLICATIONS

"Principles of Colour Technology" Second edition. By Fred W. Billmeyer, Jr. and Max Saltzman. pp. 24–66.

"The Reproduction of Color in Photography, Printing & Television" By R. W. G. Hunt. p. 116.

*Primary Examiner*—Charles L. Bowers, Jr.
*Assistant Examiner*—J. Pasterczyk
*Attorney, Agent, or Firm*—Charles E. Snee

[57] ABSTRACT

Sensitometric Quality Indicator Parameters (SQIP), including Color Radial Error (1), Average Density Error (2), Contrast Mismatch Error (3), HUE (4), and related Auxiliary Quality Parameters, are derived primarily from the deviations in aim values of the red, green, and blue density values over the standard range of exposure steps for a color photographic product. Normalized tolerance limit values common to SQIP 1–3 are established at one exposure reference level within the standard range of exposure steps. A composite graphical display of density deviations versus LOG H exposure, of SQIP 1–4 with associated tolerance limit values versus LOG H exposure, and of the Auxiliary Quality Parameters enables the rapid analysis and disposition of a batch of color photographic product with regard to sensitometric quality. By incorporating selected Auxiliary Quality Parameters, custom-weighted for a specific product, a quality objective function provides the basis for estimating and implementing prescriptive changes in the set points of calibrated process control variables to improve sensitometric quality.

11 Claims, 35 Drawing Sheets

U.S. PATENT DOCUMENTS

| | | | |
|---|---|---|---|
| 3,776,696 | 12/1973 | Kato et al. | 23/230 |
| 3,798,426 | 3/1974 | Bristol, II | 235/151.1 |
| 3,815,988 | 6/1974 | McVeigh et al. | 355/3 |
| 3,819,376 | 6/1974 | Land | 96/45.2 |
| 3,821,002 | 6/1974 | Culhane et al. | 96/94 |
| 3,851,157 | 11/1974 | Ellis | 235/150.1 |
| 3,913,022 | 10/1975 | Kinoshita et al. | 328/127 |
| 3,930,860 | 1/1976 | Shiba et al. | 96/56 |
| 3,940,600 | 2/1976 | Alexander et al. | 235/151.12 |
| 3,953,135 | 4/1976 | Levy et al. | 356/175 |
| 3,990,898 | 11/1976 | Land | 96/73 |
| 3,999,048 | 12/1976 | Parthemore | 235/151.12 |
| 4,113,371 | 9/1978 | Fraser et al. | 355/4 |
| 4,244,654 | 1/1981 | Asai et al. | 356/404 |
| 4,298,955 | 11/1981 | Munday et al. | 364/900 |
| 4,329,411 | 5/1982 | Land | 430/30 |
| 4,338,351 | 7/1982 | Bloom et al. | 427/8 |
| 4,349,869 | 9/1982 | Prett et al. | 364/159 |
| 4,368,509 | 1/1983 | Li | 364/148 |
| 4,377,338 | 3/1983 | Ernst | 355/14 |
| 4,396,977 | 8/1983 | Slater et al. | 364/188 |
| 4,423,594 | 1/1984 | Ellis | 60/39.28 |
| 4,439,038 | 3/1984 | Mactaggart | 356/408 |
| 4,506,626 | 3/1985 | Schurman et al. | 118/665 |
| 4,616,308 | 10/1986 | Morshedi et al. | 364/159 |
| 4,646,226 | 2/1987 | Moon | 364/176 |
| 4,710,864 | 12/1987 | Li | 364/148 |
| 4,837,597 | 6/1989 | Bisaiji | 355/203 |
| 4,907,167 | 3/1990 | Skeirik | 364/500 |
| 4,910,660 | 3/1990 | Li | 364/148 |
| 4,910,691 | 3/1990 | Skeirik | 364/513 |
| 4,933,870 | 6/1990 | Chang | 364/497 |
| 4,951,088 | 8/1990 | Bonvallet et al. | 355/77 |
| 5,184,174 | 2/1993 | Bell | 430/30 |
| 5,194,887 | 3/1993 | Farling et al. | 354/297 |

CAMERA REVERSAL

| | | | | | | | | | |
|---|---|---|---|---|---|---|---|---|---|
| DT | 0.09 | NDO | 0/0 | TCE | RCE | OSE | DM | ER | PSPD PLVL |
| *RT | 0.7 | * NRO | 4/6 | R 3.4 | 0.5 | 3.3 | 12.5 | -2 | 0 0 |
| +TCM | 6.4 | NMO | 0/2 | G 3.5 | 2.9 | 2.1 | -1 | -0.3 | 0 0 |
| RCM | 3 | CHUE | CC | B 3.2 | 1.7 | -2.8 c | -9.3 c | 0.8 | 0 0 |

PRINT MATERIAL

| | | | | | | | | | |
|---|---|---|---|---|---|---|---|---|---|
| DT 0.18 | NDO 0/0 | | TCE | RCE | OSE | DM | ER | PSPD | PLVL |
| RT 0.13 | NRO 0/0 | R | 2.2 | 1.6 | -1.5 | 0 | 1.3 | 1.2 | 0 |
| TCM 1.4 | NMO 0/0 | G | 1.1 | 0.8 | -0.7 | 2 | 0 | 0 | 0 |
| RCM 1.2 | CHUE 00 | B | 1.7 | 1 | -1.4 | 0 | -1.5 | -1.6 | 0 |
| | | | | | | C | | c | |

FIG. 3 CAMERA NEGATIVE

| | | | | | | | | |
|---|---|---|---|---|---|---|---|---|
| DT 0.09 | NDO 0/0 | | TCE | RCE | OSE | DM | ER | PSPD | PLVL |
| RT 0.7 | NRO 1/5 | R | 2.4 | 2.3 | -0.7 | 0 | 0 | 0 | -1.7 |
| TCM 5.7 | NMO 0/0 | G | 3.7 | 3.7 | 0.1 | -2 | 0.4 | 0 | 0.3 |
| RCM 5.2 | CHUE GG | B | 2 | 0.1 | 2 | 0.5 | 0.6 | 0 | 2 |

INTERNEGATIVE

| | | | TCE | RCE | OSE | DM | ER | PSPD | PLVL |
|---|---|---|---|---|---|---|---|---|---|
| DT 0.37 | NDO 0/0 | R | 3.1 | 2.1 | 2.3 | 1.5 | 0 | -1.1 | 3.4 |
| RT 0.31 | NRO 0/0 | G | 1.5 | 1.2 | 0.9 | 1 | 1.2 | 6.7 | 0 |
| TCM 3.3 | NMO 0/0 | B | 4.3 | 2.9 | 3.2 | -0.5 | -5.1 | 1.9 | -1.2 |
| RCM 2.6 | CHUE 00 | | | | | | c | | |

FIG. 10 COLOR DENSITY BALANCE

FIG. 11 COLOR DENSITY BALANCE

FIG. 12 REFERENCE LIMITS

FIG. 13 GREEN CONTRAST ERROR

INTERMEDIATE

| | | | | | | | | | |
|---|---|---|---|---|---|---|---|---|---|
| DT 0.29 | NDO 0/0 | | TCE | RCE | OSE | DM | ER | PSPD | PLVL |
| RT 0.83 | NRO 3/5 | R | 1.7 | 1.6 | -0.6 | 2 | -1.5 | -0.6 | -0.3 |
| TCM 4 | NMO 0/0 | G | 2.9 | 0.9 | 2.7 | -1 | 1.3 | 3.1 | 0 |
| RCM 2.6 | CHUE GG | B | 2.2 | 2.2 | 0.2 | -1.5 | -3.2 | -5.8 | -0.7 |
| | | | | | C | c | | C | |

REV. DUPLICATING

| | | | TCE | RCE | OSE | DM | ER | PSPD | PLVL |
|---|---|---|---|---|---|---|---|---|---|
| DT 0.14 | NDO 0/0 | R | 1.7 | 1.1 | 1.3 | 1 | -14.6 | -13.9 | 0 |
| RT 0.49 | NRO 1/2 | G | 2.2 | 2.1 | -0.7 | 7.6 | -0.9 | -1.7 | 0 |
| TCM 3.6 | NMO 0/0 | B | 2.9 | 2.8 | -0.5 | -1 | 3.3 | 2.4 | 0 |
| RCM 3 | CHUE BC | | | | | | c | | |

FIG. 24 REV. DUP. (NO CCM)

| | | | | | | | | | |
|---|---|---|---|---|---|---|---|---|---|
| DT 0.14 | NDO 0/0 | | TCE | RCE | OSE | DM | ER | PSPD | PLVL |
| RT 0.23 | NRO 0/0 | R | 2 | 2 | -0.4 | 1 | -14.6 | -15 | 0 |
| TCM 2.2 | NMO 0/0 | G | 2 | 1.7 | 1.1 | 7.6 | -0.9 | -1.4 | 0 |
| RCM 1.7 | CHUE MM | B | 2.7 | 2.7 | 0.1 | -1 | 3.3 c | 2.6 c | 0 |

FIG. 26

| | Pararmeter | A Step Ranges | B Limits | C Inner Factors | D Cylinders (x100) AXG | E AXB | F ALRL | G ALE Wgts $1_1$ | H $1_2$ | I $1_3$ |
|---|---|---|---|---|---|---|---|---|---|---|
| 1 | CRE, ADE | 2-18 | | .667 | 3.5 | 4.375 | 3.5* | 1/3 | 1/3 | 1/3 |
| 2 | ND0, ND02 | 2-18 | | .667 | | | | | | |
| 3 | NR0, NR02 | 2-18 | | .667 | | | | | | |
| 4 | DT, RT | 2-18 | .65 | .667 | | | | | | |
| 5 | DRT | 2-18 | .75 | .667 | | | | | | |
| 6 | TCM, RCM | 4-18 | 9.0% | .667 | | | | | | |
| 7 | NM0, NM02 | 4-18 | | .667 | | | | | | |
| 8 | TCE, RCE | 4-18 | 8.0% | .667 | | | | | | |
| 9 | OSE | 4-18 | | .667 | 5.0% | 6.25% | 5.0% | 1/3 | 1/3 | 1/3 |
| 10 | CSI, CMRL | 3 | 12.0% | | | | | | | |
| 11 | Horn Limits | 2-20 | | .667 | | | | | | |
| 12 | CHUE | 4-18 | | | | | | | | |
| 13 | PLVL | 8-14 | | .667 | 5.0 | 6.25 | 5.0 | 1/3 | 1/3 | 1/3 |
| 14 | PSPD | | | | | | | | | |
| 15 | Speed | | | .667 | 6.0 | 7.5 | 6.0 | 1/3 | 1/3 | 1/3 |
| 16 | DM | 1 | | .667 | 5.0 | 6.25 | 5.0 | 1/3 | 1/3 | 1/3 |
| 17 | BFS | 6-18 | | .667 | 5.0% | 6.25% | 5.0% | 1/3 | 1/3 | 1/3 |
| 18 | Shadow(S) | 4-8 | | | | | | | | |
| 19 | Middle (N) | 9-13 | | | | | | | | |
| 20 | Hilight (H) | 14-18 | | | | | | | | |
| 21 | Speed Prebalancing Weights | | | HT: | DT: | RT: | MT: | CT: | | |
| | | | | J | K | L | M | N | | |

* Actually, the ADRL (Average Density Reference Limit)

FIG. 27

| | | |

FIG. 32 SAMPLE CALIBRATION

INTERNEG TEST

| | | | | | | | | | |
|---|---|---|---|---|---|---|---|---|---|
| DT 0.3 | NDO 0/0 | | TCE | RCE | OSE | DM | ER | PSPD | PLVL |
| RT 1.04 | NRO 4/5 | R | 4.8 | 4.7 | -0.6 | -0.2 | 5.5 | 9 | -2.4 |
| TCM 11.5 | NMO 0/4 | G | 7.3- | 4.5 | 5.8 | 1 | 5.4 | 6.2 | 5.7 |
| RCM 8.8 | CHUE GG | B | 5.4 | 5.1 | -1.9 | 4.3 | 6.3 | 4.5 | 2.4 |

INTERNEG PRED

| | | | TCE | RCE | OSE | DM | ER | PSPD | PLVL |
|---|---|---|---|---|---|---|---|---|---|
| DT 0.19 | NDO 0/0 | | | | | | | | |
| RT 0.52 | NRO 0/0 | R | 3.5 | 3.5 | 0.2 | -0.2 | 6.9 | 5.5 | 0.6 |
| TCM 7.1 | NMO 0/0 | G | 2.6 | 2.1 | 1.5 | 0.9 | 2.2 | -1.6 | 3.5 |
| RCM 6.6 | CHUE GY | B | 4.7 | 4.5 | -1.5 | 4.3 | 8 | 10.3 | 1.6 |

METHOD FOR ASSESSING AND CONTROLLING THE SENSITOMETRIC CHARACTERISTICS OF PHOTOGRAPHIC PRODUCTS

FIELD OF THE INVENTION

This invention relates to assessment and control of the sensitometric characteristics of photographic products by using sensitometric quality indicator parameters, derived from the traditional sensitometric response of a representative test sample manufactured with calibrated process control variables, in conjunction with product-specific tolerance limit values for such parameters and a computer-aided display, such parameters and tolerances being for use in the manufacture of photographic products with consistent quality.

BACKGROUND ART

Light sensitive, silver halide based color photographic products typically comprise a number of constituents in each of their successive layers. The physical grain sizes, chemical structures and chemical compositions of the constituents, as well as the manufacturing process and apparatus used to supply the constituents and apply the layers, can have profound effects on the sensitometric properties or characteristics of the product upon exposure and subsequent development. Thus, variations in such parameters during manufacture of a product can lead, for example, to totally unacceptable products which must be scrapped at considerable expense to the manufacturer or to undesirable variations from run to run of a product which make use of the product difficult for the customer.

One known approach to controlling the sensitometric characteristics of a product has been to sample the product during manufacture; expose it in a controlled manner, and then develop or process it to permit such characteristics to be measured and any necessary manufacturing process or product constituent changes to be made. The red, green and blue density curves have been plotted and then compared to previously determined aim responses for the particular product. A high degree of skill has been required for the reader of such curves to make such comparisons at several points for each color, for such parameters as the speed response, the contrast, the density, the stain limit and the color balance; and then to decide how to adjust the product or the manufacturing process to produce product within acceptable limits. While such analysis has been done, the production process either has been stopped awaiting test results or has continued running on the assumption that the results would be acceptable. In the former instance, undesirable delays in production have resulted; while in the latter instance, substantial quantities of product have been scrapped when the result were not acceptable.

A similar approach to such a problem is disclosed by U.S. Pat. No. 3,990,898 which teaches an empirical method to adjust the color speed balance of a photographic film using filter dyes. Aim values are established for acceptable color speed balance of the product, using samples from previous production runs. Samples are then taken from current runs and sensitometric curves are prepared for the samples. If the current product deviates beyond a tolerance range for color speed balance, the level of at least one filter dye is changed. Further samples incorporating this change are then taken and their color speed balance measured to determine the effectiveness of the dye change. This process is then repeated until the desired effect is achieved.

Thus, in the art of manufacturing photographic films and papers, a need has existed for a method and an apparatus for determining and displaying how a photographic product's color density responses compare to established quality indicator parameters or standards and for predicting and displaying how changes in control variables for the product or its production process will bring the product within desired limits. Such a method and apparatus would enable the manufacturer to adapt relatively quickly to changes in the product during manufacture, which changes are caused by unexpected variations in the constituents of the product, conscious changes in the design of the product, variations in the production conditions and the like.

SUMMARY OF THE INVENTION

An object of the invention is to provide an improved apparatus and method for graphically displaying sensitometric quality indicator parameters for at least one primary color of a light sensitive color photographic product in conjunction with product-specific tolerance limit values for that primary color, thereby visually portraying the sensitometric quality of the product.

Another object of the invention is to provide an improved apparatus for predicting or determining appropriate changes in product or process control variables, using sensitometric quality indicator parameters based on measurement of density responses in at least one primary color.

Yet another object of the invention is to provide an improved computer aided process control apparatus which determines from data bases anticipated quality indicator parameters of a particular product and prescribes changes in the manufacturing process or the product to bring the product within desired tolerance limit values.

The method and apparatus of the invention are defined by the appended claims. However, in their broadest aspects, the method and apparatus are particularly suited for assessing and controlling the sensitometric characteristics of a photographic film or paper product. A sample is removed from a production batch of the product. The density response of the sample is measured in three primary colors to exposure of the sample over a range of exposure steps. For each density response the deviation of the sample from an aim response is determined for that color for the product. The deviations or responses or both are transformed into a sensitometric quality indicator parameter representing contrast mismatch error M. The aim response for at least one primary color is transformed into tolerance limit values for the quality indicator parameter, thereby defining boundaries of acceptable sensitometric quality of the product. Finally, the quality indicator parameter and the tolerance limit values are displayed to visually portray the sensitometric quality of the sample. Quality indicator parameters representing color radial error R or average density error D, or both, also may be determined.

The invention also relates in its broadest aspects to an apparatus and method for assessing and controlling the sensitometric characteristics of a photographic film or paper product and the process for making the product utilizing density response in three primary colors to exposure, over a range of exposure steps, of a sample removed from a production batch of the product. For the process and the product a set of control variables, $CV_i$ to $CV_n$, is provided for each of which a change of a known magnitude will produce a corresponding change in the density response of the product in one or more of three primary colors to exposure over a range of exposure steps. For each density response the deviation of the sample from an aim response is determined for that color for the product. The deviations or responses or both are transformed into sensitometric quality indicator parameters representing color radial error R, average density error D and contrast mismatch error M, wherein R is determined from data points entered within a closed elliptical curve in a color density balance plane with trilinear coordinates. The aim response for at least one primary color is transformed into tolerance limit values for the quality indicator parameters, thereby defining boundaries of acceptable sensitometric quality of the product. A root mean square error HT, a root mean square DT of exposure stepwise values of D within a predetermined exposure step range, a root mean square RT of exposure stepwise values of R within a predetermined exposure step range, a weighted contrast mismatch MT, and a square root CT of the sum of the squares of total contrast errors over all colors are determined and used to define a quality objective function $F=f_1[HT/w_1]^2+f_2[DT/w_2]^2+f_3[RT/w_3]^2+f_4[MT/w_4]^2+f_5[CT/w_5]^2$. The changes to the set of control variables and the corresponding changes to the density responses are used to determine the magnitudes of the control variables for minimization of the value of the quality objective function. Finally, the magnitudes of the control variables are adjusted to achieve the minimization and control the process.

BRIEF DESCRIPTION OF THE DRAWINGS

The present invention can be better appreciated by reference to the following preferred embodiments considered in conjunction with the drawings in which:

FIG. 1, repeats FIG. 8, adding aim densities, prebalanced densities, and the reference LOG H location of a normally-exposed, 18%-reflecting gray card.

FIG. 26 is a master data table containing an example set of limits and exposure step ranges for a camera negative.

FIGS. 27–29, using an internegative as an example, show the comprehensive quality review available through AQP trend plots with sophisticated failure flagging.

DETAILED DESCRIPTION

A portion of this disclosure contains material to which a claim of copyright is made. The copyright owner does not object to copying the patent document but reserves all other rights.

Introduction

Figure 2:
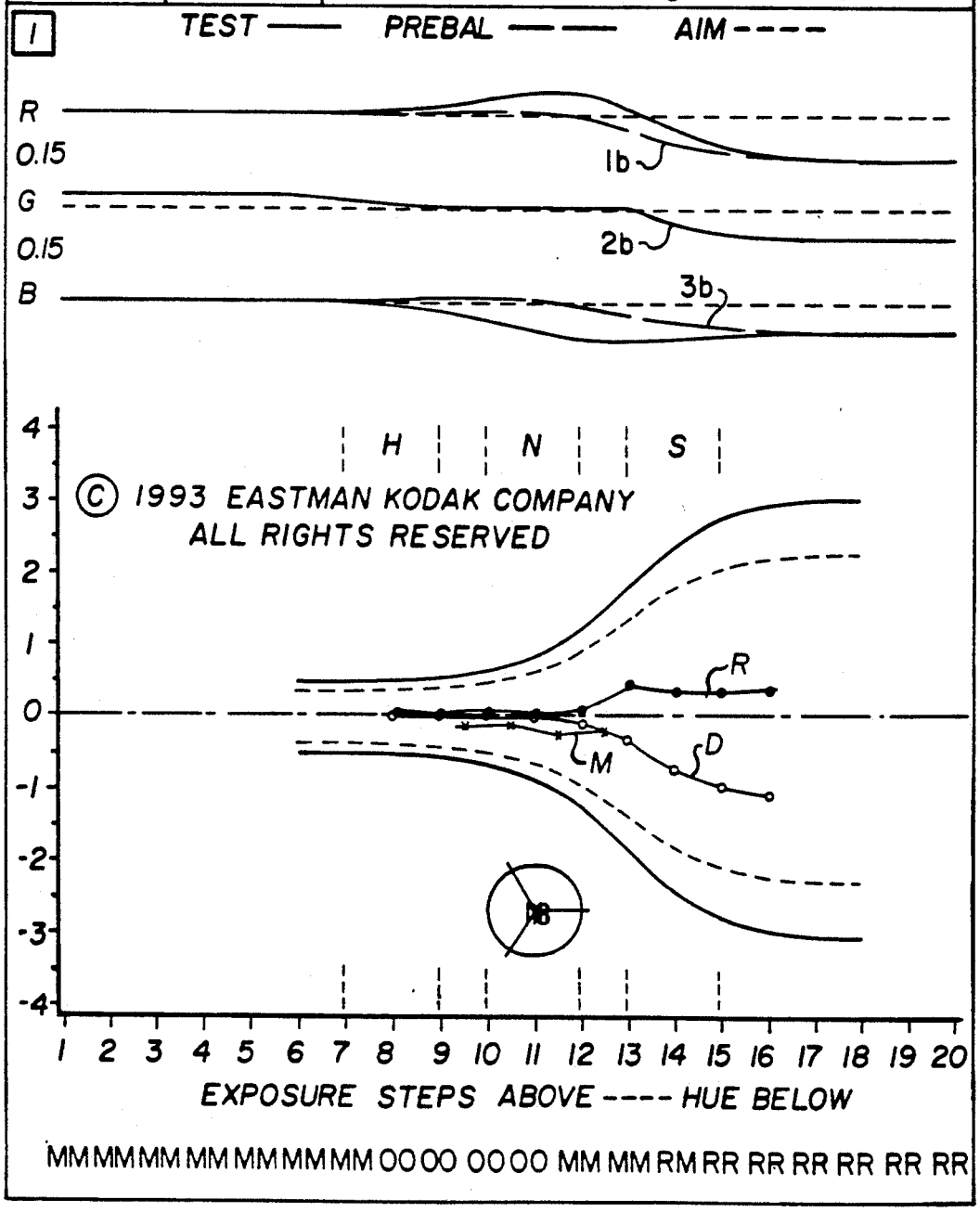
Figure 3:
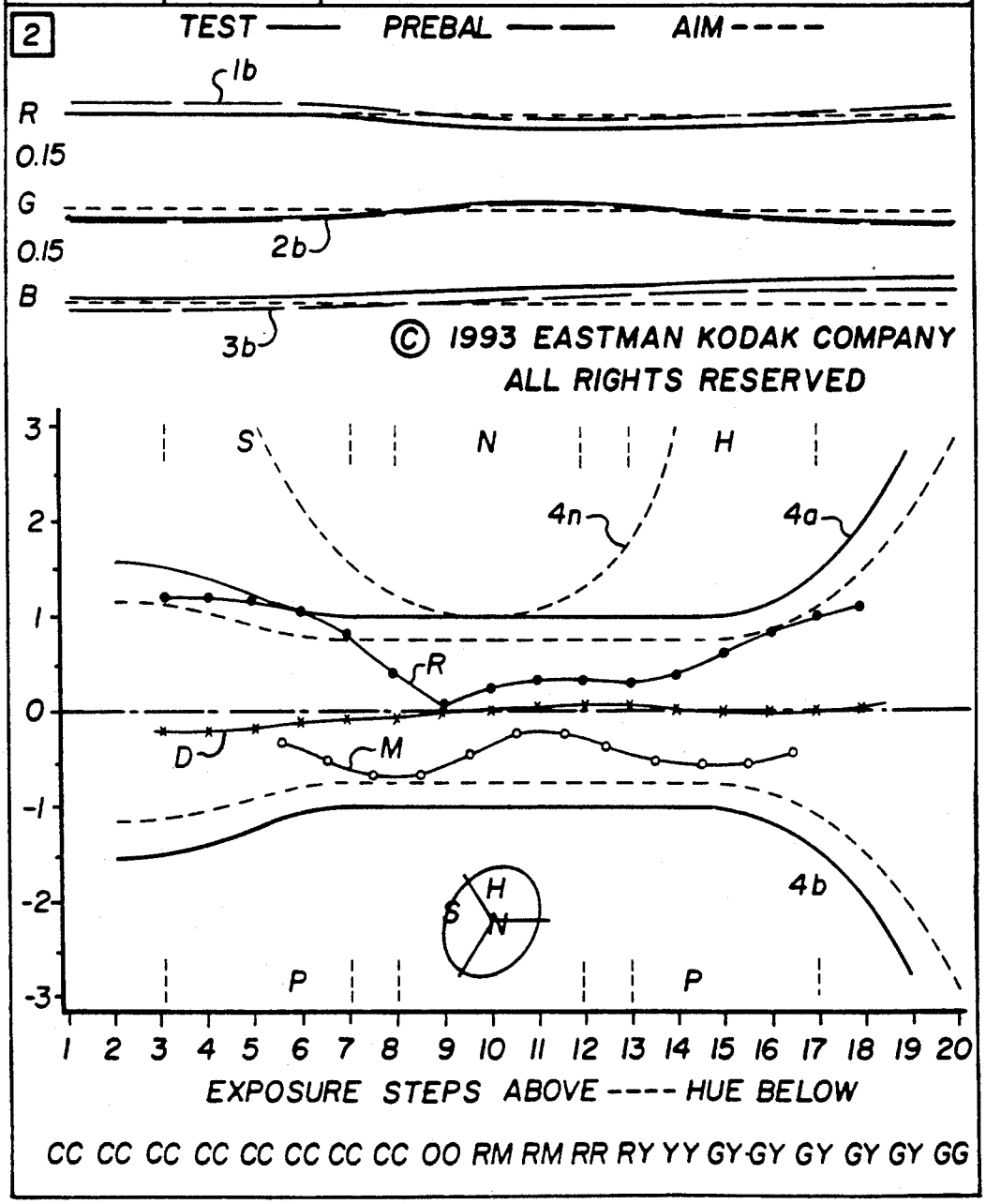
Figure 4:
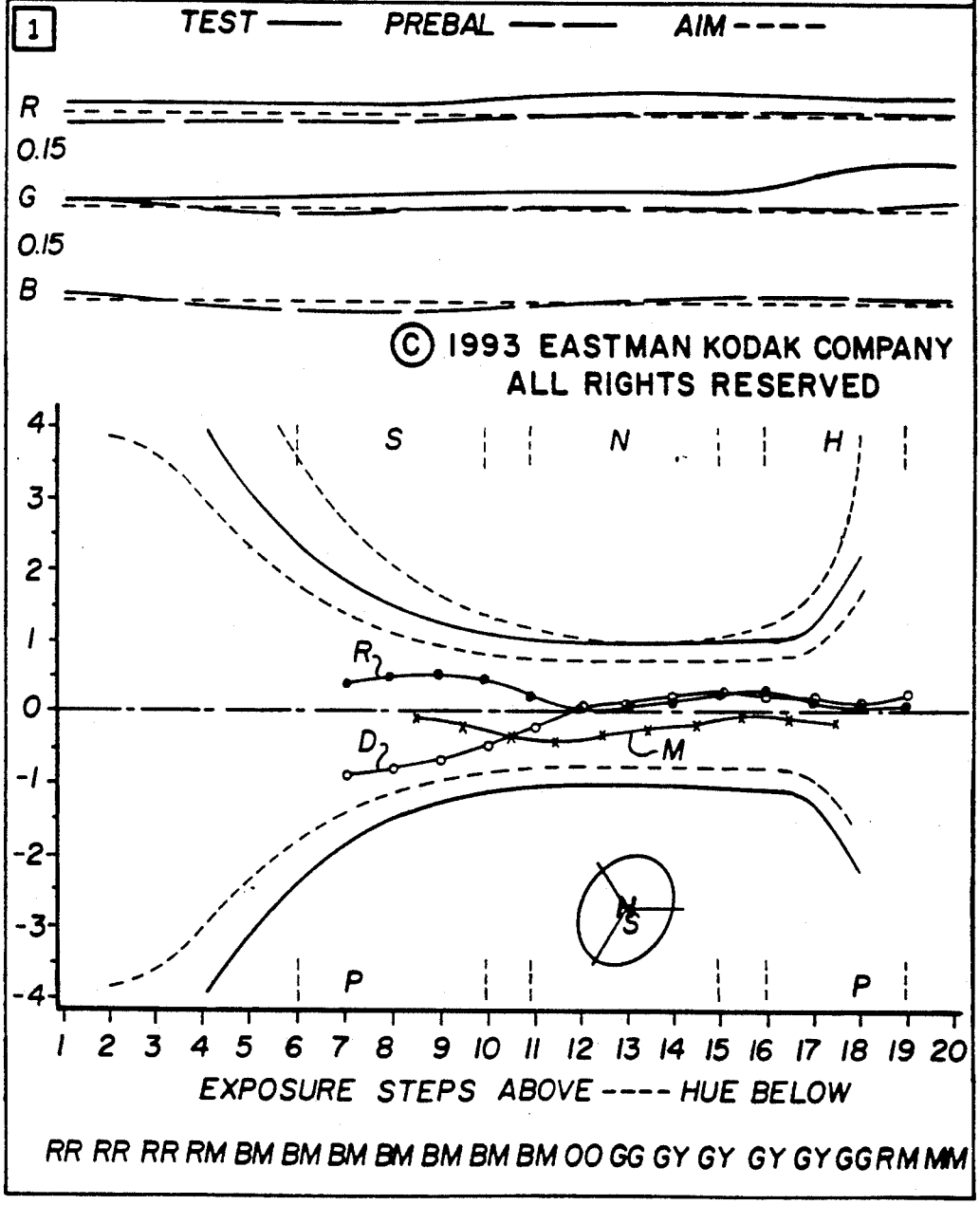

In FIGS. 1–4, four composite displays according to the invention introduce the Sensitometric Quality Indicator Parameters (SQIP) which are plotted as R, D and M in the lower section of the composite displays and related Auxiliary Quality Parameters (AQP) which are presented as the trilinear snapshot 10 in the lower sections of the composite displays; and as NDO, NRO, NMO, DT, RT, DRT, CHUE, TCM, TCE, RCE, RCM, OSE, PSPD and PLVL in the box at the upper portions of the composite displays. The definition, application, and control of these parameters are the principal features of this invention and subjects of this description. As used in this description, "display" refers to a visual presentation to an operator in a manufacturing operation embodying the invention, which may be presented on a television monitor, on a hard-copy print, or both. Each composite display organizes the information necessary for disposition (acceptance or rejection) of the sensitometric quality of a batch of color photographic product, using as an underlying basis the characteristic response of a representative test sample to a traditional series of white-light, stepped, exposure levels shown in FIGS. 5–8. FIGS. 1–8 illustrate the universality of application of the SQIP/AQP to color photographic materials, e.g., a camera reversal film (FIGS. 1,5), a print material (FIGS. 2,6), a camera negative film (FIGS. 3,7), and a laboratory internegative film (FIGS. 4,8).

SENSITOMETRIC RESPONSE FOR A CAMERA REVERSAL FILM

Figure 5:
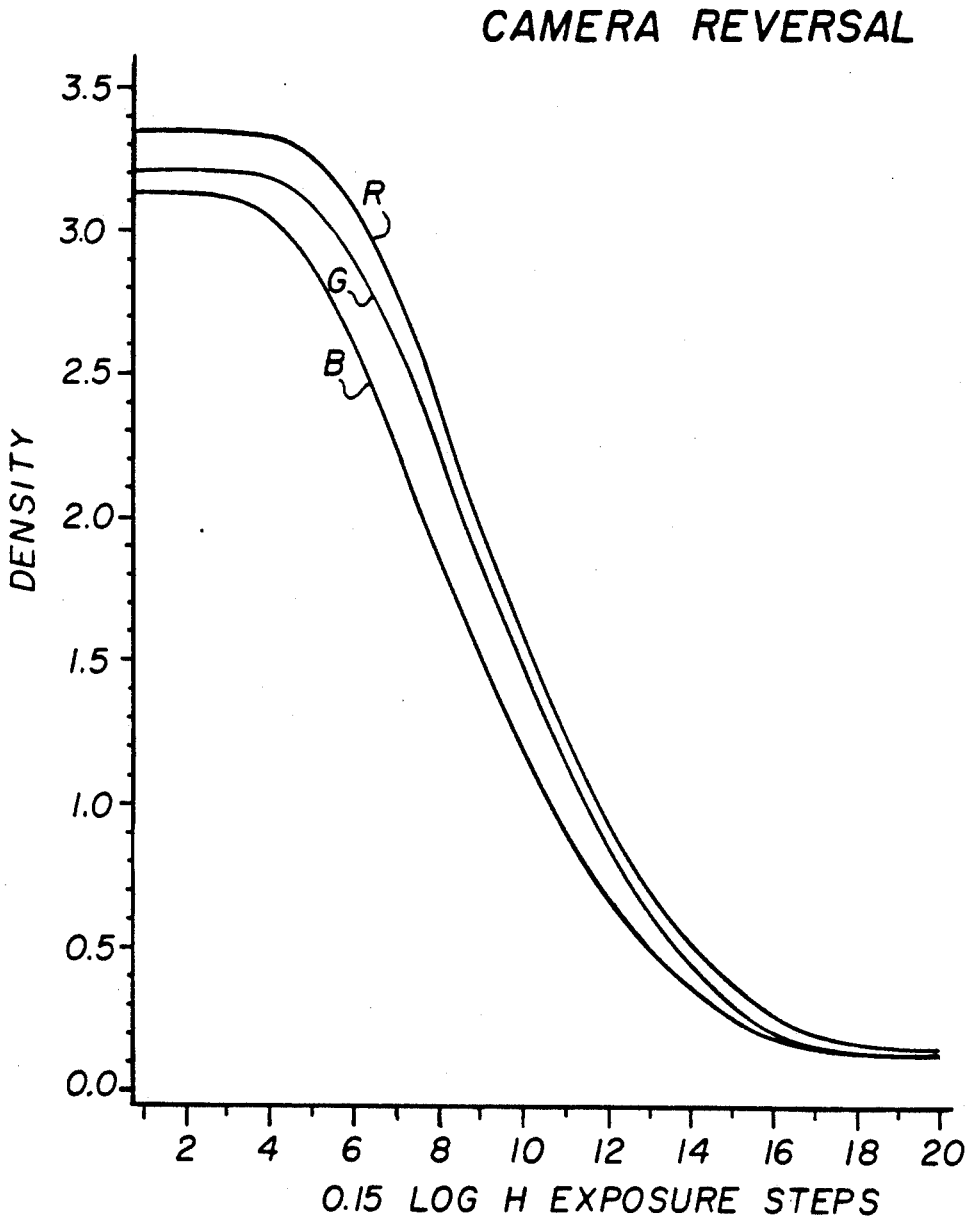
FIG. 5 (PRIOR ART)
FIGS. 5–8 are red (R), green (G), and blue (B) density versus LOG H exposure plots that display in the conventional manner the measured densities required to produce the four corresponding composite displays in FIGS. 1–4.
Figure 9:
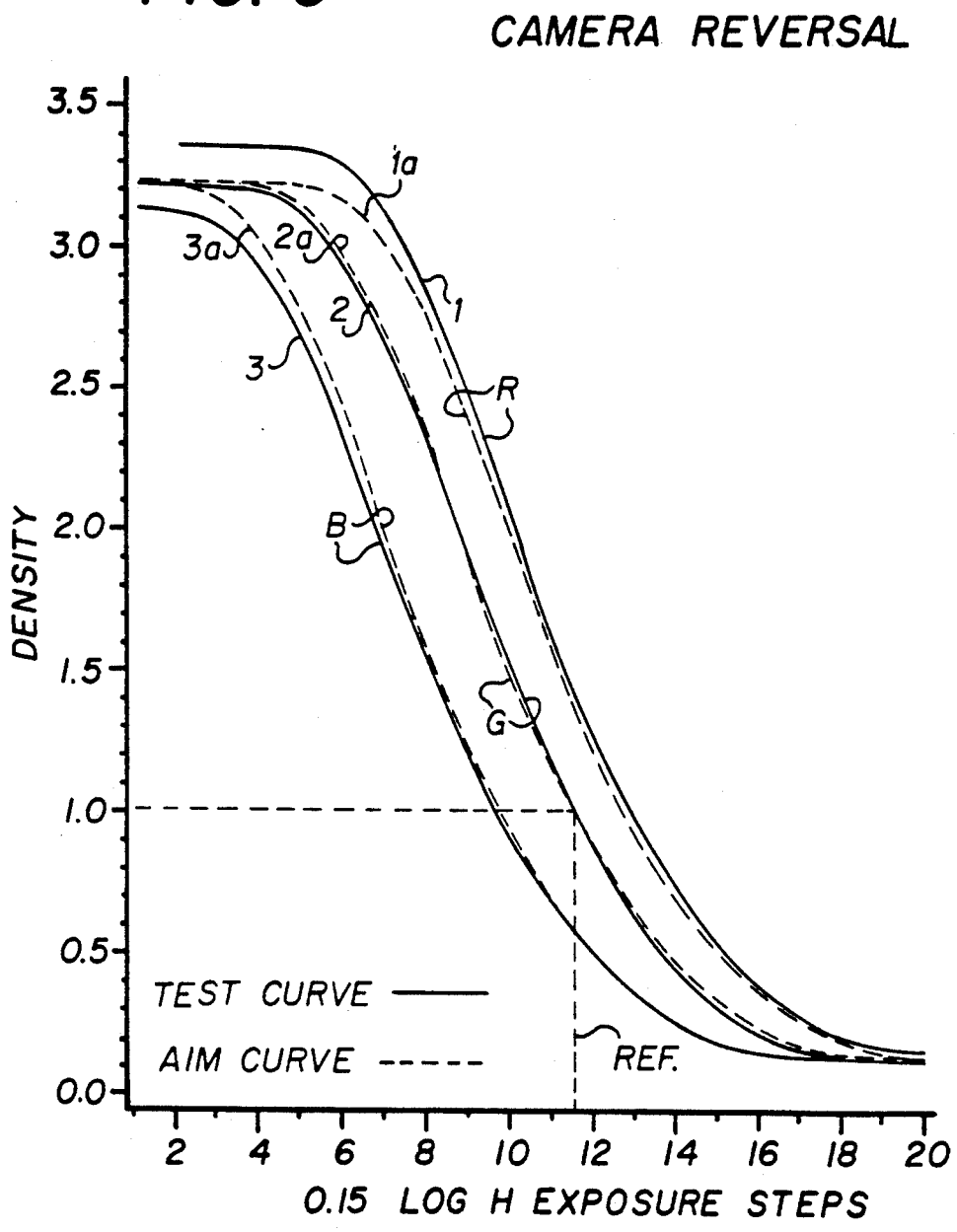
FIG. 9 repeats FIG. 5, including aim (target) density curves. The color density curves are offset horizontally for clarity.

Repeating the test sample responses of FIG. 5 for a camera reversal film and adding target or aim curves, FIG. 9 shows the red, green, and blue density curves offset horizontally from one another to visually disentangle them for clarity: the reds are arbitrarily shifted one exposure step to the right of the greens; the blues, one step to the left of the greens. (As used in this description, "density" refers to optical density, either transmission or reflection, depending on the context.) Along the abscissa of this traditional density vs. logarithm of exposure (LOG H) plot are twenty exposure steps: step 1 having zero exposure, and steps 2 through 20 having uniform incremental separations of 0.15 LOG H. (Any increments that span the light-sensitive range of the product would suffice. Increments of 0.15 LOG H are convenient because they are one half of the traditional camera stop of 0.3 LOG H.) The 20 exposed areas of a product sample are chemically processed ("developed") and the resulting optical densities measured thrice through standardized red, green, and blue optical filters to obtain the solid-line response curves, 1, 2, and 3, in FIG. 9. The target red, green, and blue responses, called the aim, are designated by the dashed lines, 1*a*, 2*a*, 3*a*. The significance of the reference coordinates in FIG. 9 will be discussed later.

Overview of an SQIP/AQP Composite Display

Figure 1:
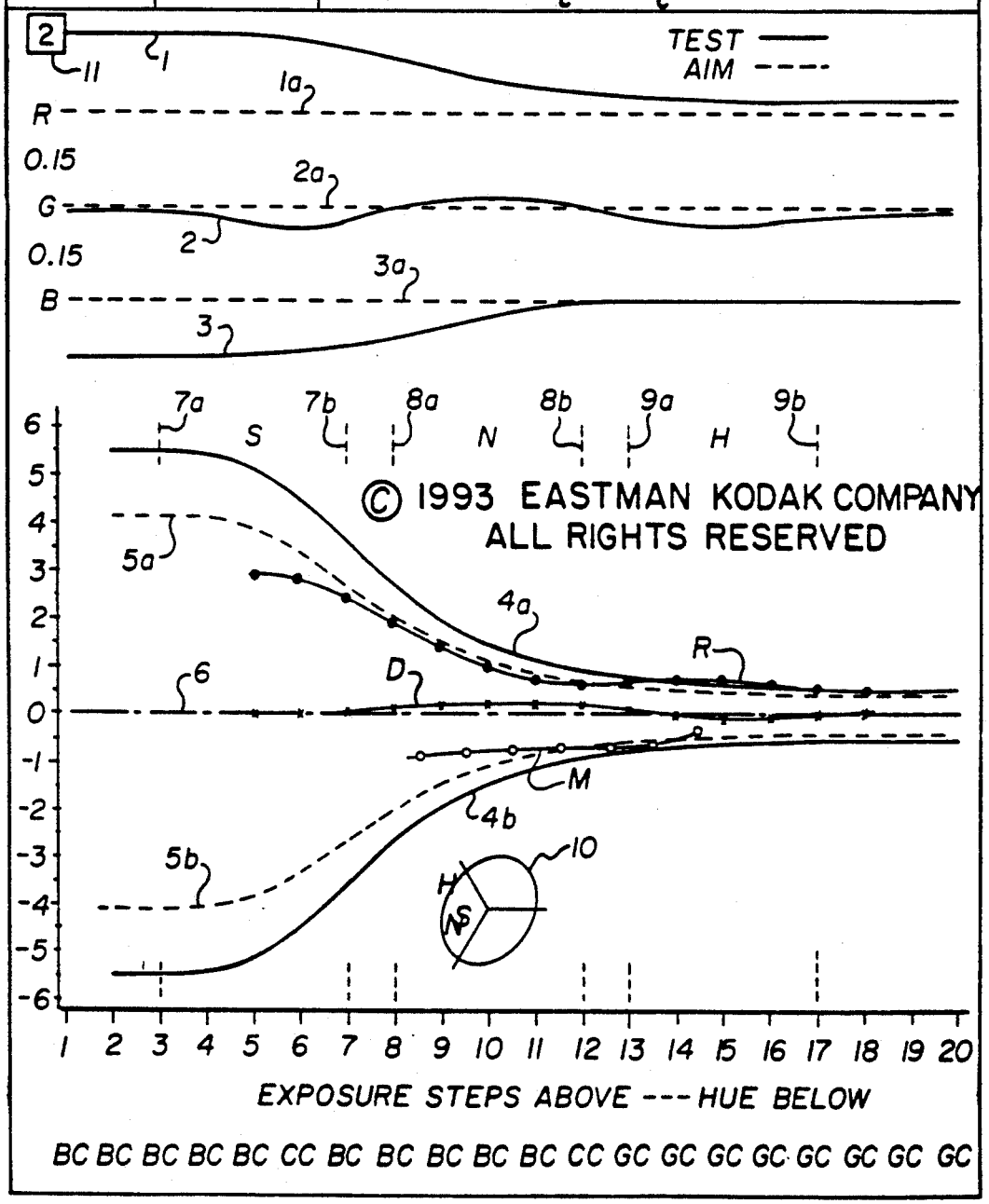
FIGS. 1–4 are specially-annotated composite displays of Sensitometric Quality Indicator Parameters (SQIP) and Auxiliary Quality Parameters (AQP) for four different color photographic products.

To save space and to visually magnify errors, the density plots are often replaced by density deviations from aim (errors), plotted in clothesline form as in the upper middle section, the Deviation Plot, of FIG. 1 (lines 1, 2, and 3). The aim red (R), green (G), and blue (B) densities are represented by the three vertically-separated horizontal dashed lines 1*a*, 2*a*, and 3*a*. The magnitudes of the deviations are indicated by the 0.15-density spacing labels at the left between the dashed lines, and the exposure step numbers are found immediately below the SQIP Plot in the lower section of the composite. At the top of the composite appears the AQP Table, some of the entries in which are intrinsic elements of a Quality Objective Function to be defined later.

On the SQIP Plot in the lower middle section of the composite, the symbols, "D", "R", and "M", identify three of the plotted parameters which applicants have discovered to be particularly useful in accordance with the invention. Those skilled in the art will understand from their specifications that D, R, and M can be plotted singly or in pairs without departing from the invention.

The SQIP Plot assists in the disposition of a batch of product, while its companion Deviation Plot, above, shows the errors in the underlying density curves. In accordance with the invention, a batch is rejected if any plotted D, R, or M point falls outside the pair of outer limit lines, 4*a* and 4*b* (the "release horn"), which are symmetric about the zero-line, 6. A second pair of reduced limits, 5*a* and 5*b* (the "inner horn"), drawn as dashed lines at a fraction of the distance from the zero-line to the release horn, can be used to stimulate corrective action or to identify special high-quality product. Analytical techniques for determining the shape of the release horn will be described later.

The plotting symbols, D and R, stand for the orthogonal parameters, Average Density Error (ADE) and Color Radial Error (CRE), respectively. The symbol M stands for Contrast Mismatch Error (CME). The plotting symbols D, R and M also are used in the appended claims. These parameters can be defined over all exposure steps, but are significant only over step ranges relevantly predefined for each product, as will be explained subsequently. Below the exposure step axis, two-letter labels called HUE report the color direction of the Color Radial Error for each exposure step. The four SQIP (CRE, HUE, ADE, CME) will now be systematically defined in that order.

COLOR RADIAL ERROR (CRE)

The first step in deriving CRE is an orthogonal transformation, $$\begin{bmatrix} x \\ y \\ z \end{bmatrix} = \begin{bmatrix} -\sqrt{3/2} & +\sqrt{3/2} & 0 \\ -1/2 & -1/2 & +1 \\ +1/\sqrt{2} & +1/\sqrt{2} & +1/\sqrt{2} \end{bmatrix} \begin{bmatrix} r \\ g \\ b \end{bmatrix} \quad (1)$$

where r, g, and b are the red, green, and blue density deviations from aim for an exposure step, and x, y, and z are useful intermediate variables.

Figure 10:
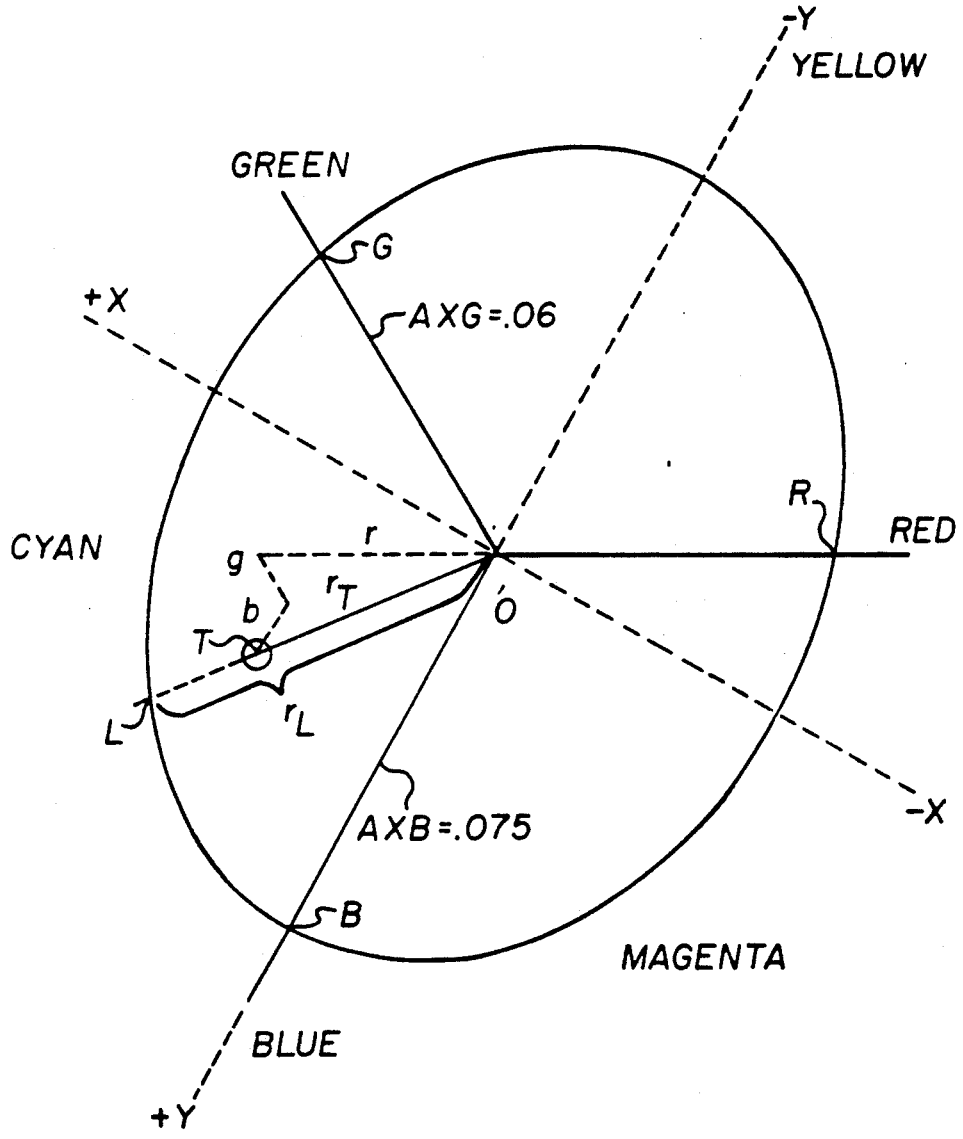
FIG. 10 locates exposure step 11 (from FIGS. 1 and 9) in the color density balance plane with superimposed Cartesian (x,y) and trilinear (r,g,b) coordinate axes, with an elliptical boundary limit, and with annotations contributing to the definition of Color Radial Error (CRE).

In FIG. 10, x and y in Eq. 1 are interpreted as Cartesian coordinates (x,y) in a color-balance plane where the transform scaling permits trilinear red, green, and blue color axes to be superimposed on an x-y plane having non-erect axes rotated 150 degrees counterclockwise. The sample test point T, from exposure step 11 of FIGS. 1 and 5, is located using its (r,g,b) triplet of density errors as trilinear coordinates, a procedure equivalent to locating the same point with the transformed coordinates (x,y) of Eq. 1. FIG. 10, then, permits a simple pictorial mapping of any density error triplet (r,g,b) into a color balance plane to assist in the evaluation of color error, both of direction and extent.

While any closed curve could be used as a boundary, the color density balance limit illustrated in FIG. 10 is an ellipse with its major axis colinear with the trilinear blue axis (and the Cartesian y-axis), and with its center in the origin, O. At least two possible reasons may be cited for ellipses having extra tolerance along the blue-yellow (or any) axis: visual sensitivity and testing precision. The ellipse is a practical approximation of a limit in the color plane that actually depends in a complex way upon eye sensitivity, testing variability, and photographic system. The extent of rotation of the Cartesian axes in the orthogonal transform of Eq. 1 is a matter of convenience: in this case, the chosen rotation causes the positive y-axis to coincide with the blue semi-major axis of the limiting ellipse.

The second step in deriving CRE is a transformation to polar coordinates ($r_T$,"HUE") in the x-y plane (FIG. 10). HUE, the implied angular coordinate, will be discussed shortly. The radius of the test point $r_T$ (line segment OT) is seen to be a fraction of the colinear radius of the ellipse $r_L$ (line segment OL), suggesting the definition of CRE:

$$CRE = \frac{r_T}{r_L} \quad (2)$$

When CRE is less than or equal to 1.0, the test point is within the ellipse, but when CRE is greater than 1.0, it is outside the ellipse; however, in the derivation of release horn limits (4*a* and 4*b* in FIG. 1), it will be seen later that the reference limit (in this case, the reference ellipse) strictly sets the CRE tolerance only at a reference point along the LOG H axis (see vertical dashed line in FIG. 9). The eccentricity of the reference ellipse is defined for a particular product by specifying the two radii along the green and blue trilinear axes in density units, specifically, AXG (line segment OG) and AXB (line segment OB) in FIG. 10. The radius along the red trilinear axis (line segment OR) is equal to AXG by symmetry. When the reference limit is elliptical, the standard algebraic formula for an ellipse and some simple trigonometric considerations lead to a useful alternate expression for CRE:

$$CRE = \left[ \frac{(r-g)^2}{AXG^2} + \frac{(b-r)(b-g)}{AXB^2} \right]^{1/2} \quad (3)$$

Only the color density deviations (r,g,b) at an exposure step and the reference ellipse's trilinear axes (AXG-,AXB) are needed to make this calculation. If a non-elliptical reference limit is chosen the fundamental definition of CRE in Eq. 2 can always be applied.

HUE OR COLOR DIRECTION

Figure 11:
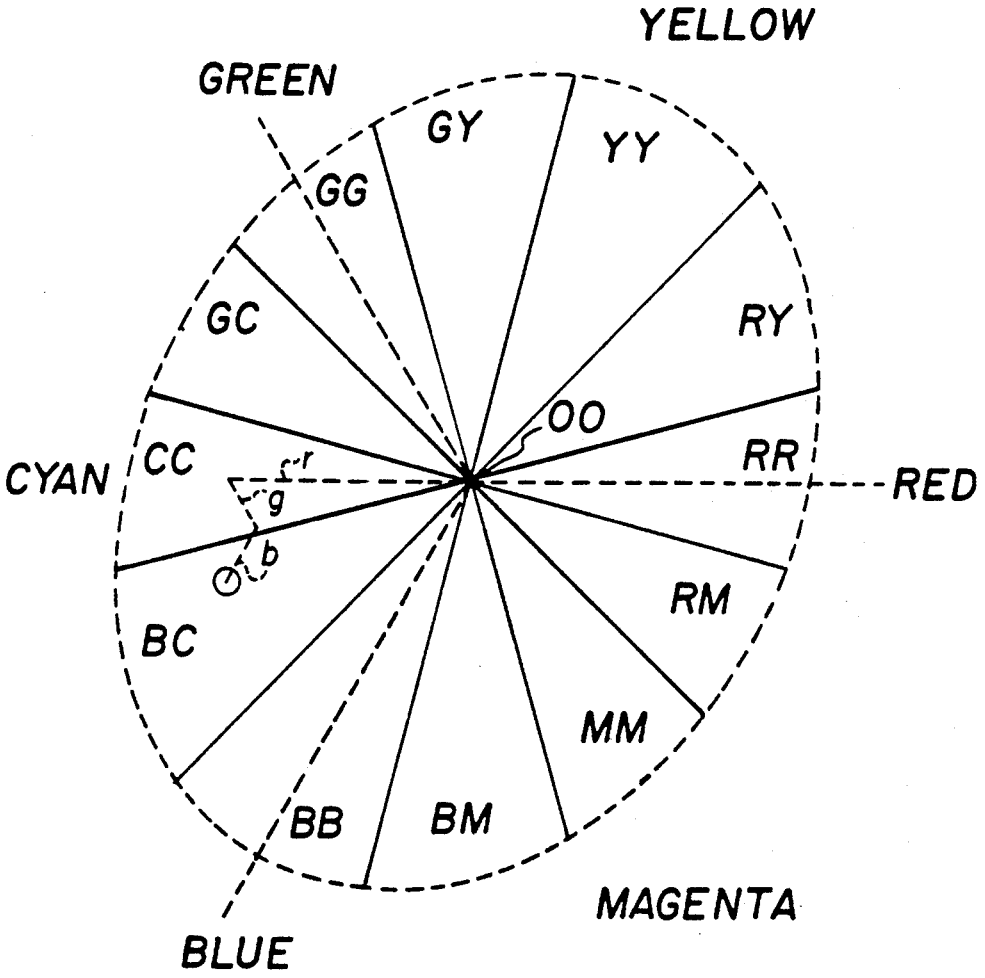
FIG. 11 defines HUE, a color direction parameter able to take on one of thirteen two-letter values corresponding to the twelve color sector labels and the origin label shown in the figure.

The angular polar coordinate, companion to $r_T$, is approximated by HUE, a two-letter color sector label appearing below each exposure step number in FIG. 1. FIG. 11 shows how the color plane is partitioned into twelve 30-degree color sectors with clockwise consecutive labels, RR, RM, MM, BM, BB, BC, CC, GC, GG, GY, YY, and RY, and with 00 for the origin. The red trilinear axis bisects the RR sector. For the test point in FIG. 11, repeated from FIG. 10, HUE is BC (blue-cyan), the same two-letter label found below exposure step 11 in FIG. 1. The set of labels between primary (RR,GG,BB) and complementary (CC,MM,YY) colors, namely, (RM,BM,BC,GC,GY,RY), are easily recalled because they always begin with a primary color's initial.

In this description, any product's aim densities are considered visually neutral (gray) for the purpose of establishing the relative color direction of the HUE labels. An alternate approach would be to report the color direction of the final viewed material in any photographic system: e.g., a print material's HUE on an exposure step would represent its real color error direction, whereas, a camera negative's HUE would report the color error direction of its print, as if the negative's error had been propagated to a perfect batch of print material, exposed and processed in a manner that is optimal for aim materials.

AVERAGE DENSITY ERROR (ADE)

The orthogonal intermediate variable (z) of Eq. 1 is scaled to make ADE consistent with its name:

$$ADE = \frac{z\sqrt{2}}{(3)(ADRL)} = \frac{(r+g+b)}{(3)(ADRL)} \quad (4)$$

The Average Density Reference Limit (ADRL) is a normalizing divisor chosen to be the highest acceptable ADE at the same reference point along the LOG H axis where the reference limit (ellipse in FIG. 10) for CRE is defined. When ADE is less than or equal to 1.0, the test is acceptable for ADE, at least at the reference point; but when ADE is greater than 1.0, the test fails for ADE at the reference point. In the coming derivation of release horn limits (4*a* and 4*b* in FIG. 1), the role of the reference point will be clarified.

It is helpful to visualize the reference tolerances for CRE and ADE as a reference cylinder (see FIG. 12), suggested by the sequential orthogonal and polar transformations of Eq. 1 and FIG. 10. Product that is acceptable for CRE and ADE must fall within or on the cylinder (at least at the reference LOG H point).

CONTRAST MISMATCH ERROR (CME)

Figure 13:
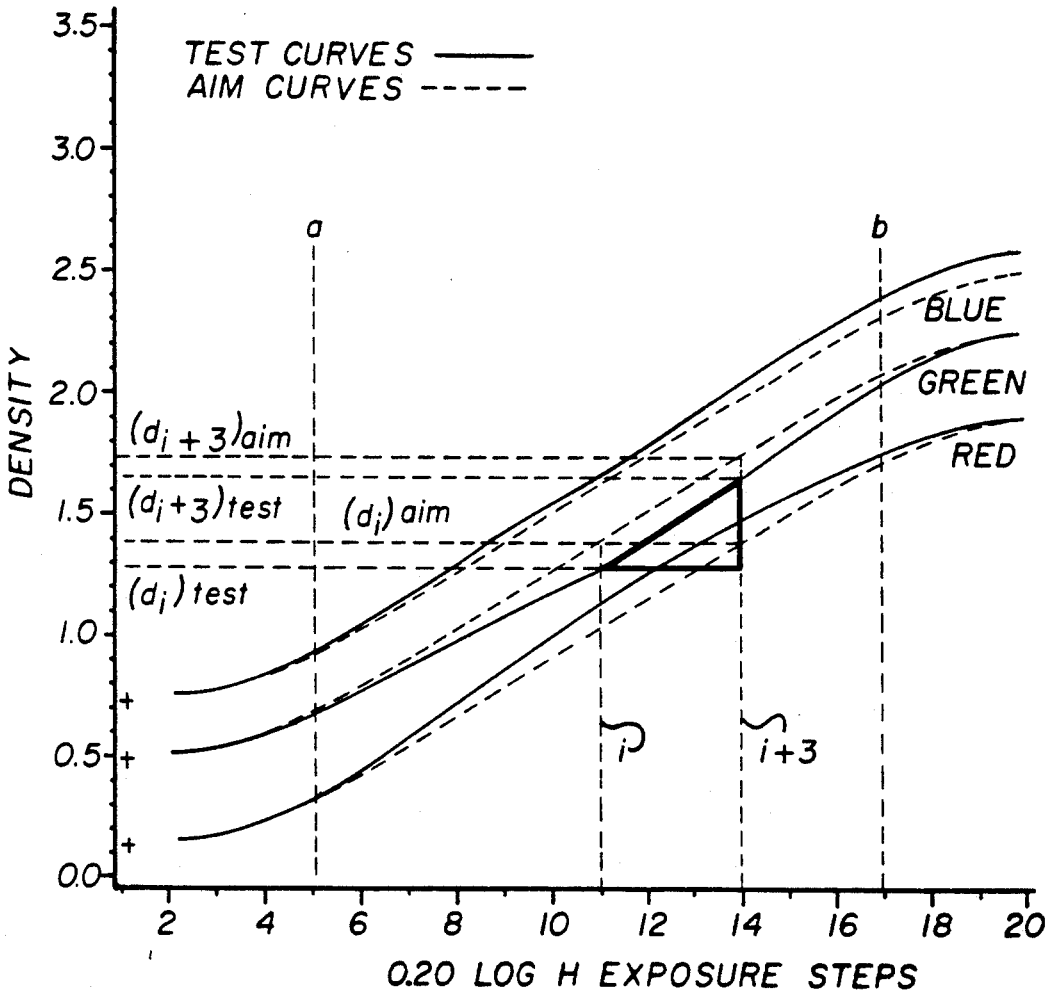
FIG. 13, through a geometric construction applied to the green-density response curves for a camera negative, helps define color contrast error and mismatch.

CME relates to the contrast (slope) mismatch among the three color density curves and is defined for each in a succession of overlapping n-step increments along the LOG H axis. The value of n is preferably taken as three (i.e., three regular exposure increments) and is called the Contrast Step Interval (CSI). First, the average Contrast Error (CE) in percent of each color curve is calculated for a particular n-step interval. FIG. 13 shows the procedure for the green-density curve of a camera negative where a relevant exposure step range, a through b, has been predefined. (A camera negative is used as an example because the slope of its density-response curves is lower than that of a camera reversal, allowing a clearer diagram.)

$$(CE_G)_i = (100)\left[\frac{(d_{i+3} - d_i)_{test} - (d_{i+3} - d_i)_{aim}}{(d_{i+3} - d_i)_{aim}}\right]_G \quad (5)$$

where $(CE_G)_i$=the average green contrast error in percent over a typical 3-step interval beginning with the $i^{th}$ step, $d_i$=the green density value at the $i^{th}$ step, $d_{i+3}$=the green density value at step i+3.

Red and blue CEs for the same step interval are calculated by applying the same procedure to the red and blue density curves.

Next, three two-way comparisons of the three color contrast errors are made by subtracting them from each other. The square root of half of the sums of squares of the three differences defines the value of Contrast Mismatch (CM) for the particular interval beginning at the $i^{th}$ step:

$$(CM)_i=(0.5S_i)^{\frac{1}{2}} \quad (6)$$

where $CM_i$=the contrast mismatch in percent for the interval beginning at the $i^{th}$ step, $$S_i=(CE_R-CE_G)_i^2+(CE_G-CE_B)_i^2+(CE_B-CE_R.)_i^2.$$

The presence of the 0.5 factor in the definition of CM may be unexpected, but it achieves an irresistible logical simplicity. When the color contrast errors for any interval $(CE_R, CE_G, CE_B)_i$ are such that one, $(CE_G)_i$ say, differs by the same percent from the other two, then the $(CM)_i$ is that same percent.

CME (Contrast Mismatch Error) is calculated by scaling CM with a normalizing divisor, the Contrast Mismatch Reference Limit (CMRL):

$$CME = \frac{CM}{CMRL} \quad (7)$$

The value of CMRL is chosen to fail any test having an absolute value of CME greater than unity at the same reference LOG H chosen for CRE and ADE. Note again, for the camera reversal in FIG. 1, that CME plots as an "M" in the center of each successive three-step interval within the predefined relevant step range.

FIG. 1 shows the Ms plotted in the negative direction. This reduces the visual entanglement of the three plotted lines for D, R, and M by arbitrarily plotting the Ms below zero; the Rs, as polar coordinates, are always above zero by definition; the Ds can plot above or below zero. Of course, a zero value (perfection) is always possible for any D, R, or M point.

HORN LIMITS FOR VIEWED MATERIALS

To allow for different tolerances at different exposure steps along the LOG H axis, the applicants have discovered a pair of release limit lines can be defined for each product (see 4*a* and 4*b* in FIG. 1). The lines taken together have been dubbed "the release horn," "the horn limits," or just "the horn." for the SQIP definitions to be consistent, the horn limits must pass through plus and minus unity at the reference point along the LOG H axis, indeed, the point at which the tolerancing values for ADE, CRE, and CME are defined. Only the reference ellipse's trilinear radii, AXG and AXB for CRE, and the reference divisors, ADRL for ADE and CMRL for CME, must be provided for each product: the horn "automatically" adjusts the tolerances along the LOG H axis.

For consistency, the reference point is preferably an approximation of the point along the LOG H axis where a standard gray card with 18% reflectance would fall in a normal exposure for an average picture. A consideration of transparent viewed materials, such as print, camera reversal, and reversal duplicating films, has led to a practical selection of 1.0 density on the aim green density curve for the reference point. (In a neutral exposure, 1.0 on the red and blue density curves would necessarily fall at about the same LOG H point.) For photographic papers, a selection of 0.7 aim green density has worked well. The exact location of the reference point is not critical to horn shaping, but it is the calibrating point at which reference tolerances must be set for ADE, CRE, and CME.

The shape of the horn for a viewed material such as the camera reversal of FIG. 1 depends upon a lightness weighting of the densities. The need for lightness weighting can be intuited by imagining the small density error tolerance for a white wedding dress compared to that for a black tuxedo. Because it characterizes the essential shape of a product's density response and because its spectral density more closely matches the eye's spectral sensitivity, the green-density aim curve (item 2*a* in FIG. 9) is preferred to the red and blue aim curves for use in the derivation of horn limits. The following equation allows for lightness weighting while indexing the value of the horn at the reference point at ±1.0:

$$L_i=\pm(10)^{(w)(d_i-d_o)} \quad (8)$$

where $L_i$=horn limit value at the $i^{th}$ exposure step, $d_o$=the reference density, say 1.0, $d_i$=the density on the $i^{th}$ exposure step, w=the exponential power of the lightness weighting action.

If w is set equal to zero in Eq. 8, no lightness weighting of density occurs and the horn limits are just a parallel pair of straight lines located at +1.0 and −1.0. A value of $w=\frac{1}{3}$, however, is an effective choice for many products because it approximates the dependency of visual density-error tolerance on absolute density level. The horn in FIG. 1 (lines 4*a* and 4*b*) used $w=\frac{1}{3}$ in its derivation as will all others discussed in these descriptions. Eq. 8 may be applied to all viewed materials such as camera reversal, reversal duplicating, and print films as well as photographic paper; in a later discussion Eq. 8 will be modified slightly to accommodate materials not viewed directly, such as camera negative, and laboratory internegative and intermediate films. The applicants have discovered the horn derivation scheme after considerable effort to find a practical use for the quantity, CIE 1976 lightness, L*, as referenced on page 116 of R. W. G. Hunts's fourth edition of *The Reproduction of Colour in Photography, Printing & Television*. The empirical data enabling the definition of CIE 1976 lightness reinforces the use of one third as the preferred exponent (w) in Eq. 8.

For simplicity, the preferred horn configuration is symmetrical about the zero line on an SQIP Plot, although, for the ADE parameter, an asymmetric horn could be considered, particularly if the ADE, CRE, and CME parameters were presented in three separate plots, rather than in the preferred single plot with common normalized ordinate values. Not preferred because it would hide their true nature, the horn limits could be transformed to symmetric straight lines by dividing the ADE, CRE, and CME values for each exposure step by the horn limit value for that step, thereby scaling the data on each step, rather than adjusting the limit on each step.

AUXILIARY QUALITY PARAMETERS (AQP)

The following twelve numbered sections define thirteen AQP, collected in the AQP Table mentioned earlier in connection with an overview of the composite display in FIG. 1.

AQP 1: THE TRILINEAR SNAPSHOT

Since full density curves (e.g., FIG. 5) on each test are not explicitly required for dispositioning color materials via the composite display, it is helpful to include vertical lines on the SQIP plot to identify exposure ranges of interest. One pair of lines may bracket the shadow (darker) areas of a photographed scene (*7a* and *7b* in FIG. 1); a second pair, the normal (middle-tone) areas (*8a* and *8b* in FIG. 1); and a third pair, the highlight (lighter) areas (*9a* and *9b* in FIG. 1). The initial letters, S, N, and H, label the shadow, normal, and highlight exposure ranges. Ranges may be chosen, for instance, so most relevant pictorial information falls between the left-most and right-most verticals (*7a* and *9b* in FIG. 1). FIG. 1 illustrates disjoint S-N-H ranges, but they can overlap if it seems useful.

The average color density balance for each of the exposure ranges is shown in a Trilinear Snapshot, the small ellipse (item 10 in FIG. 1) with the same eccentricity as for CRE (see FIG. 10). The average value of the coordinates of all the color balance points within a range defines the average balance point, but the average coordinates must be scaled by dividing by the average value of the horn limit over the range. This places the point in the snapshot at the best compromise fraction of the way to the elliptical limit. While trilinear color axes can be labeled (not done in FIG. 1), no absolute grid or scale marks can be used in the trilinear snapshot, because each range may have a different scaling. However, concentric figures (not shown in FIG. 1), similar to the limit, may denote fractions or percentages of the limit, e.g., 25%, 50%, 75%, 100%, 125%, etc.

AQP 2: NDO, NRO, and NMO

The numbers of D, R, and M values (NDO, NRO, NMO) outside the release horn limits and within predefined relevant step ranges are counted. Similarly, NDP2, NRO2, and NMO2 are the counts for points outside the inner horn. To conserve space, FIG. 1 shows the latter counts separated by slashes from the former counts without specific labels.

AQP 3: DT

"D Total" or DT is the horn-weighted, normalized, root mean square of stepwise values of ADE within its predefined relevant step range:

$$DT = \left[ \frac{\sum_i (ADE_i/L_i)^2}{\sum_i (1/L_i)^2} \right]^{1/2} \tag{9}$$

AQP 4: RT

"R Total" or RT is the horn-weighted, normalized, root mean square of stepwise values of CRE within its predefined relavant step range, logically identical to the range for DT. Its definition is analogous to that of DT:

$$RT = \left[ \frac{\sum_i (CRE_i/L_i)^2}{\sum_i (1/L_i)^2} \right]^{1/2} \tag{10}$$

AQP 5: DRT

Treating DT and RT like uncorrelated sample standard deviations, the root of their sum of squares provides an overall, single-number, quality measure called "DR Total" or DRT, a parameter with little analytical prowess but with hypotenuse-style representation of a right triangle's legs (DT and RT):

$$DRT = [(DT)^2 + (RT)^2]^{\frac{1}{2}} \tag{11}$$

DRT is not shown in FIG. 1.

AQP 6: CHUE

Cluster Hue (CHUE) is the two-letter color-sector HUE label for that point in the color plane representing the average of the coordinates of all the color density balance points plotted from exposure steps within a predefined step range. In FIG. 1, CHUE happens to be CC (cyan). See FIG. 11 to review HUE labels in the color density balance plane.

AQP 7: TCM

Total Contrast Mismatch (TCM) is the root mean square of all values of CM (see Eq. 6) within its predefined relevant step range. Horn weighting, color weighting, and normalization are not usually applied to TCM to more purely reflect absolute slope errors:

$$TCM = \left[ \sum_i (CM)_i^2 / N \right]^{1/2} \tag{12}$$

where $CM_i$ = CM for the $i^{th}$ contrast step interval,

N = the number of intervals in the CM step range.

AQP 8: $TCE_R$, $TCE_G$, and $TCE_E$

Total Contrast Error (TCE), one for each of the red, green, and blue test density curves in FIG. 5, is the root mean square of the values of CE (see Eq. 5) for a specific curve within the predefined relevant step range for TCM. As an example, for green TCE:

$$TCE_G = \left[ \sum_i (CE_G)_i^2/N \right]^{1/2} \tag{13}$$

AQP 9: $RCE_R$, $RCE_G$, and $RCE_E$

Residual Contrast Error (RCE), one for each color density curve, is the minimum TCE obtainable by mathematically adjusting the average contrast to an optimum within the predefined relevant step range. The adjustment is restricted to a simple percentage change in the overall slope without a change in the inherent shape of a density curve, in effect, a tilting of the density curve. In a manner analogous to Eq. 5 and FIG. 13, for each contrast step interval along the green density curve:

$$(RE_G)_i = (100)\left[ \frac{(f)(d_{i+3} - d_i)_{test} - (d_{i+3} - d_i)_{aim}}{(d_{i+3} - d_i)_{aim}} \right]_G \tag{14}$$

where $(RE_G)_i$=the $(CE_G)_i$ of Eq. 5 and FIG. 13 except f=the factor adjusting the test green contrast, which will now be derived.

From Eq. 5, substitute the definition of $CE_i$ into Eq. 13 and include the contrast adjusting factor (f) of Eq. 14 to obtain the derivation basis:

$$TCE^2 = \frac{100^2}{N} \sum_i \left[ \frac{(f)(d_{i+3} - d_i)_{test} - (d_{i+3} - d_i)_{aim}}{(d_{i+3} - d_i)_{aim}} \right]^2 \tag{15}$$

What value of the factor, f, will make TCE a minimum? For notational convenience, separate the expression in the brackets into two terms by dividing each term in its numerator by its denominator, $(d_{i+3}-d_i)_{aim}$, and setting, $$t_i = \frac{(d_{i+3} - d_i)_{test}}{(d_{i+3} - d_i)_{aim}} \tag{16}$$

to obtain, $$TCE^2 = \frac{100^2}{N} \sum_i [(f)t_i - 1]^2 \tag{17}$$

Expanding Eq. 17, $$TCE^2 = \frac{100^2}{N} \left[ (f)^2 \sum_i (t_1)^2 - 2(f) \sum_i (t_i) + \sum_i (1) \right] \tag{18}$$

Take the first derivative of Eq. 18 with respect to factor f:

$$(2)(TCE)\frac{dTCE}{df} = \frac{100^2}{N}\left[ (2)(f) \sum_i (t_i)^2 - (2) \sum_i (t_i) \right] \tag{19}$$

To find conditions at the minimum TCE, set the derivative equal to zero and simplify to get:

$$f = \frac{\sum_i (t_i)}{\sum_i (t_i)^2} \tag{20}$$

So the contrast adjusting factor, f, will minimize TCE over the exposure step range of the summation for one of the three color density curves. The process must be repeated for the other two colors to obtain their unique factors. The minimum TCE is given the name, Residual Contrast Error (RCE).

Specifically, for the green density curve, $RCE_G$ is calculated exactly like $TCE_G$ in Eq. 13 except the residual errors, the REs of Eq. 14, replace the CEs for each contrast step interval. It should be noted that the same value of the contrast adjusting factor, f, is used for every step interval along the green density curve. This does the simple tilting of the curve while preserving its inherent shape.

Red and blue RCEs are calculated similarly, with each requiring its own unique value for the contrast adjusting factor. The RCE for a color curve is always equal to or less than its companion TCE, the discrepancy indicating the degree to which a simple contrast correction will achieve aim curve shape. If TCE is 6.3%, say, and RCE is 1.1%, tilting eliminates most of the contrast error; but if TCE is 6.3% and RCE is 5.7%, tilting cannot reduce contrast error very much, which implies the average contrast is close to aim but the density curve must sag, bow, or waver with respect to the aim (within the predefined relevant step range). TCE, then, includes both tilt and shape errors, while RCE includes only the residual shape errors after tilt correction.

AQP 10: RCM

Residual Contrast Mismatch (RCM) is a special TCM value recalculated using each of the color curves after each has been optimally tilted in the RCE calculations. (Practically, this means the REs replace the CEs in determining the CMs via Eq. 6.) RCM can be larger than or equal to TCM, but it is usually smaller.

AQP 11: OSE

Overall Slope Error (OSE) in percent, one for each color density curve, is derived predictably from the contrast adjusting factor (f) of Eq. 20:

$$OSE = (100)\left[ \frac{1}{f} - 1 \right] \tag{21}$$

The OSE applies over the predefined step range for TCM.

AQP 12 and 13: PSPD and PLVL

FIG. 1 includes space for these prebalancing parameters to be described later. They are not ordinarily used in the disposition of camera reversal films.

INCLUDING CONVENTIONAL PARAMETERS

The inclusion of the deviations from aim of conventional parameters for each color density curve has been found useful in a composite display such as FIG. 1. For example, three such parameters are photographic speed, some alternative overall contrast measure, and the value of density at exposure step 1 (i.e., no exposure). In FIG. 1, the speed deviation parameter is ER (Emulsion Rating), and step 1's density deviation is DM (Dmax for reversals or Dmin for negatives). While our new AQP 11 parameter, OSE, is the present contrast error measure listed in FIG. 1, products could use alternative known measures such as Best-Fit Slope, the slope of the least-squares straight line defined over a relevant step range, reported as a percent deviation from aim. DM and ER speed are also reported as deviations from aim: DM in density units times 100, and speed in LOG H units times 100. For the camera reversal in FIG. 1, the ER speed deviation is determined at a 1.0 density level for each color density curve. Depending on a specific product's use, speed and overall contrast may be assessed in other conventional ways not to be described here: in every case, however, three values, one each for red, green, and blue, are determined, just as is true for DM.

The applicants have discovered a scheme for tolerancing this type of tricolor parameter, which will be discussed later, along with the Error Tally Box located in FIG. 1 (item 11) above and to the left of the density deviation plot.

A COLOR PRINT MATERIAL

Figure 14:
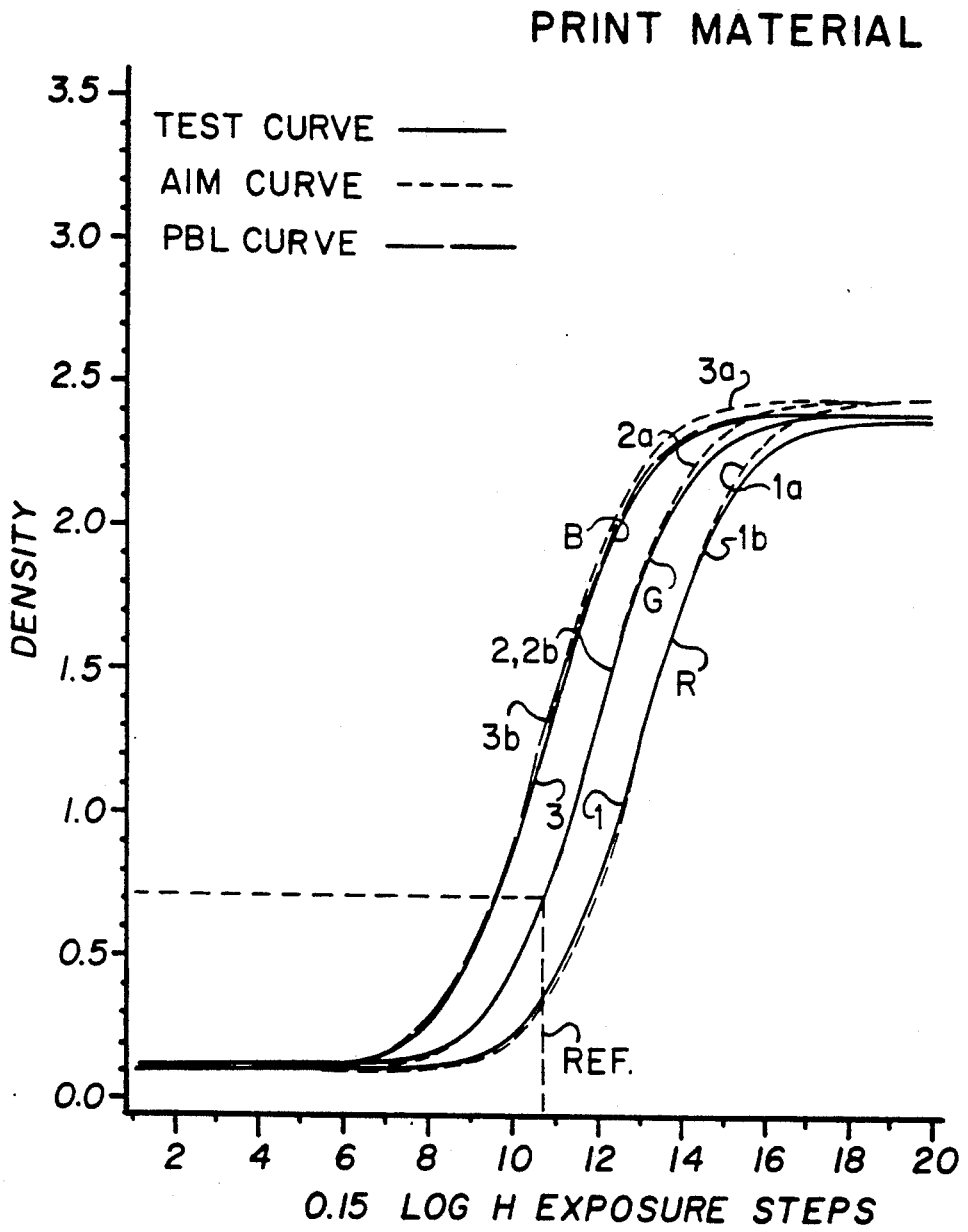
FIG. 14 repeats FIG. 6, adding aim densities, speed-prebalance densities, and a reference LOG H location at 0.7 green density. The color density curves are offset horizontally for clarity.

FIGS. 2 and 14 show a composite display and density response curves relating to a test sample of a color print material, where the use of the AQP 12 parameter, PSPD (Prebalancing Speed), provides advantages in accordance with the invention. In this specification, "print material" includes, for example, photographic papers and films. As in FIG. 9, FIG. 14's red, green, and blue density curves are arbitrarily offset for clarity, but FIG. 14 includes broken lines, 1*b*, 2*b*, and 3*b*, identical to the original test curves, 1, 2, and 3, except for their being horizontally shifted so as to better match the aim curves, 1*a*, 2*a*, and 3*a*. The red, green, and blue PSPD values shown in FIG. 2 record the sample test speed relative to the aim in units of LOG H times 100. The amounts of lateral shifting, with appropriate algebraic sign, are the PSPD errors. For a better appreciation of the relative location of original, shifted, and aim curves, refer to the Deviation Plot of FIG. 2. To formalize the procedure for speed shifting, the following paragraphs develop a Quality Objective Function capable of being tuned to provide an objective criterion for deciding when the best-compromise speed balance has been found.

THE QUALITY OBJECTIVE FUNCTION

In accordance with our invention, the Quality Objective Function (F in Eq. 22) is composed of the weighted sum of five algebraic terms: the first incorporating the density errors, that is, the r, g, and b step-density deviations of Eq. 1; and the last four incorporating Auxiliary Quality Parameters (AQPs 3, 4, 7, and 8).

$$F = f_1\left[\frac{HT}{w_1}\right]^2 + f_2\left[\frac{DT}{w_2}\right]^2 + f_3\left[\frac{RT}{w_3}\right]^2 + f_4\left[\frac{MT}{w_4}\right]^2 + f_5\left[\frac{CT}{w_5}\right]^2 \tag{22}$$

where $f_j$=the product-specific weights selected for the "best" quality compromise (more on the selection of these weights later), $w_j$=the normalizing weights that scale each term with respect to its approximate tolerance. Plausible starting weights might be: $w_1=w_2=w_3=0.65$, $w_4=w_5=10$.

In the first term of F, HT is the normalized horn-weighted and color-weighted root-mean-square error of the red, green, and blue test densities over a relevant exposure step range:

$$HT^2 = \frac{\frac{\sum_i (r/L)_i^2}{AXG^2} + \frac{\sum_i (g/L)_i^2}{AXG^2} + \frac{\sum_i (b/L)_i^2}{AXB^2}}{3 - \sum_i (1/L_i)^2} \tag{23}$$

where $r_i$, $g_i$, $b_i$=density errors on exposure step i, $L_i$=horn limit value on step i (see Eq. 8), AXG, AXB=trilinear radii of reference ellipse for CRE (see FIG. 10).

DT and RT are defined in Eqs. 9 and 10. CT is the square root of the horn-weighted and color-weighted sum of squares of the TCE over all colors:

$$CT^2 = WTCE_R^2 + WTCE_G^2 + \frac{AXG^2}{AXB^2}(WTCE_B^2) \tag{24}$$

where, similar to Eq. 13 for $TCE_G$, except horn-weighted, $$WTCE_G^2 = \frac{\sum_i [(CE_G)_i/L_i^*]^2}{\sum_i [1/L_i^*]^2} \tag{25}$$

and $L_i^*$=horn limit value in the center of the contrast step interval beginning at the ith exposure step (see FIG. 13), i=a step number in the relevant predefined range for TCE and TCM, e.g., in FIG. 13, $a \leqq i \leqq b-3$.

$WTCE_r$ and $WTCE_B$ are calculated in the same way as $WTCE_G$ in Eq. 25, except the $CE_R$'s and the $CE_B$'s, in turn, are used in Eq. 25 instead of the $CE_G$'s. MT is like TCM (see Eq. 12) except for horn-weighting:

$$MT^2 = \frac{\sum_i [CM_i/L_i^*]^2}{\sum_i [1/L_i^*]^2} \tag{26}$$

To eliminate the color weighting in any term of the objective function, AXB should be set equal to AXG for that term. Similarly, to eliminate the horn weighting in any term, the $L_i$ should all be set equal to one. Normally the subjective advantages of color and horn weighting will preclude their elimination, however.

Since each of the five terms on the right side of the Quality Objective Function (Eq. 22) is a quadratic function of at most sixty test density errors ($r_i$, $g_i$, $b_i$), the objective function can be expressed as the sum of five quadratic forms, one for each term:

$$F=f_1y'Q_1y+f_2y'Q_2y+f_3y'Q_3y+f_4y'Q_4y+f_5y'Q_5y \quad (27)$$

where $y'=1\times 60$ row vector of density errors ($y'$ is the transpose of the column vector, y), $=[r_1,g_1,b_1,r_2,g_2,b_2, \ldots ,r_{20},g_{20},b_{20}]$, $Q_j=60\times 60$ symmetric matrices constructed with each non-zero element relating in value and location to the coefficients of the unique products of $r_i,g_i$, and $b_i$ found in the algebraic expansion of each term in F, $f_j$=the product-specific weights of Eq. 22.

A composite matrix, Q, organizes the aggregate penalty on any vector of density errors so as to include the weight ($f_j$) placed on each quality term in the objective function of Eq. 27:

$$F = y'[f_1Q_1 + f_2Q_2 + f_3Q_3 + f_4Q_4 + f_5Q_5]y \quad (28)$$
$$= y'Qy \quad (29)$$

where the composite Q matrix is defined as $$Q=f_1Q_1+f_2Q_2+f_3Q_3+f_4Q_4+f_5Q_5 \quad (30).$$

The algebraic expansion of any quadratic form can be expressed as follows:

$$y'Qy = \sum_m (y_m^2 q_{mm}) + \sum_{n>} \sum_m (2y_m y_n q_{mn}) \quad (31)$$

where the $q_{ij}$ are the elements of the symmetric Q matrix, and the $y_i$ are the components of the error vector, y.

The simplest example of this type of expansion is:

$$[y_1y_2]\begin{bmatrix} a & b \\ b & c \end{bmatrix}\begin{bmatrix} y_1 \\ y_2 \end{bmatrix} = ay_1^2 + 2by_1y_2 + cy_2^2 \quad (32)$$

The construction of each of the five $Q_j$ matrices in Eq. 27 by the expansion of the corresponding terms of Eq. 22 can be understood by examining an example set of density errors for an arbitrary exposure step ($r_i,g_i,b_i$), and expanding the square of their sum involving arbitrary coefficients:

$$(Ar_i + Bg_i + Cb_i)^2 = \quad (33)$$
$$A^2r_i^2 + B^2g_i^2 + C^2b_i^2 + 2ABr_ig_i + 2BCg_ib_i + 2CAb_ir_i =$$
$$[r_ig_ib_i]\begin{bmatrix} a & d & f \\ d & b & e \\ f & e & c \end{bmatrix}\begin{bmatrix} r_i \\ g_i \\ b_i \end{bmatrix}$$

where, to simplify the matrix elements, $a=A^2$, $b=B^2$, $c=C^2$, $d=AB$, $e=BC$, $f=CA$.

Note the symmetry of the matrix about the main diagonal. Note also the corresponding locations: the coefficients of the squared terms are on the main diagonal; the coefficients of the cross-product terms are halved and set symmetrically off the main diagonal. After a systematic organization of the algebraic expansion of the jth term in Eq. 22, the corresponding $Q_j$ matrix of Eq. 27, 28, and 30 is constructed in a pattern similar to that of Eq. 33. The composite Q matrix of Eq. 29 and 30 is then easily obtained by multiplying each $Q_j$ matrix by its scalar coefficient ($f_j$), and performing the indicated matrix addition.

SPEED PREBALANCING

With the completion of the development of a Quality Objective Function, it is now possible to apply it to speed prebalancing, the operation preceding the calculation of the SQIP and the final AQP for the color print material of FIGS. 2 and 14. This speed-prebalancing procedure will also be needed for internegative and intermediate films to be considered later in these specifications. The process of horizontally shifting a red, green, or blue density curve to better match its aim curve is equivalent to adding (or subtracting) the right amount of a special twenty-component vector of small density changes to the original twenty step densities. The vector is special in that it can approximate the shifting of a curve horizontally. To be specific, define:

$$\hat{y}=Ec \quad (34)$$

where $\hat{y}=60\times 1$ column vector of estimated 20-step density adjustments (speed shifts) to match the aim, $=[r_1,g_1,b_1,r_2,g_2,b_2, \ldots ,r_{20},g_{20},b_{20}]$, $c=3\times 1$ column vector of prescriptive speed changes in the same' order as the unit speed effects are stacked in the E matrix and in corresponding units, i.e., the number of 0.01 LOG H increments.

$E=3\times 60$ unit speed-effects matrix (approximate), derived for each unique set of test densities by shifting the test curves 0.01 LOG H faster, subtracting the original step densities from the shifted curves' step densities, and organizing the matrix elements ($e_{ji}$) as follows:

$$\begin{bmatrix} e_{R1} & 0 & 0 & e_{R2} & 0 & 0 & \cdots & e_{R20} & 0 & 0 \\ 0 & e_{G1} & 0 & 0 & e_{G2} & 0 & \cdots & 0 & e_{G20} & 0 \\ 0 & 0 & e_{B1} & 0 & 0 & e_{B2} & \cdots & 0 & 0 & e_{B20} \end{bmatrix}$$

$$e_{Ri} = (R_S - R_O)_i,\ e_{Gi} = (G_S - G_O)_i,\ e_{Bi} = (B_S - B_O)_i$$

R, G, and B stand for red, green, and blue density. An 'S' subscript denotes step i's density on the shifted curve; an 'O' subscript, step i's density on the original unshifted curve. (To shift the test curves 0.01 LOG H to the left, some convenient interpolating routine such as cubic splines is required to find each shifted curve's step densities: cf. chapter 1 of Joel H. Ferziger's *Numerical Methods for Engineering Application*. The choice of 0.01 LOG H as a trial shift is arbitrary: some shift must be chosen to get an initial estimate of E, the unit speed-effects matrix).

How can Eq. 34 be used in conjunction with the Quality Objective Function (F) in its most parsimonious form (Eq. 29) to find the optimum speed shifts for a set of test density curves?

Let $F=[y+\hat{y}]'Q[y+\hat{y}]$ (35)

and thus $F=[y+E'c]'Q[y+E'c]$ (36)

Eq. 35 and Eq. 36 are the result of combining Eq. 29 and Eq. 34 with this rationale: add a remedial vector of density corrections ($\hat{y}$) to the density errors of the original test (y) by making prescriptive speed shifts (c). If the right choice of c is made, the Quality Objective Function (F) will be minimized. One excellent choice is found by recognizing the problem solution fits the form of the Generalized Least Squares (GLS) or Aitken Equations when the control variables (c) are unconstrained:

$$c=-[EQE']^{-1}EQy \quad (37)$$

The optimal LOG H shifting of each color density curve is estimated by applying the Generalized Least Squares (GLS) matrix equation (Eq. 37) twice, first to yield an approximate solution vector $c_1$, and second, to refine the first solution by using $c_1$ to improve the accuracy of the unit speed-effects matrix (E). After the first application of the GLS procedure, the estimate of the required red, green, and blue speed shifts, $c_1$, is used to derive a new unit speed effects matrix (E) with exactly the same element pattern and technique of calculating the non-zero elements except:

1) The estimated speed shifts in $c_1$, divided by 100 to convert to LOG H, are used in place of the trial offset, 0.01 LOG H, to shift the test curves faster or slower.
2) The "shifted minus original" step-density differences are divided by the corresponding red, green, or blue element of $c_1$ to obtain an improved unit speed effect for each color curve.

The improved unit speed-effects matrix, is used in a second application of the GLS procedure to obtain the final estimate, $c_2$, of the best red, green, and blue speed shifts to simulate an optimal balance. $c_2$ is then used to calculate the shifted curves step densities (items 1*b*, 2*b*, and 3*b* in FIG. 2 and 14:

$$D_S=D_T+E\,c_2 \quad (38)$$

where $D_S$=shifted 60×1 column vector of step densities, ordered $R_1 G_1 B_1 R_2 G_2 B_2 R_3 G_3 B_3 \ldots R_{20}G_{20}B_{20}$ $D_T$=60×1 column of original test densities ordered like $D_S$.

In FIG. 2, all parameters but ER (the conventional speed error) are calculated using the shifted densities $D_S$, so the composite display reflects the expected sensitometric quality after the necessary speed balancing by a customer. The red, green, and blue values of the AQP 12 parameter, PSPD, are equal to the components of vector $c_2$, with opposite algebraic sign. The, PSPD values (LOG H times 100) are the effective speed errors of the batch of color print material relative to its aim as found through the above minimization of the Quality Objective Function. This mathematical procedure for speed prebalancing can be tuned to mimic a real printing procedure by adjusting the weights ($f_j$) embedded in the objective function (see Eqs. 22, 27, 28, and 30). More about the tuning of weights will follow the sections describing a reversal duplicating film.

Although the speed-prebalancing procedure could include more iterations to further refine the accuracy of the unit speed-effects matrix, the applicants have found in practice that one iteration is sufficient.

A CAMERA NEGATIVE

Figure 15:
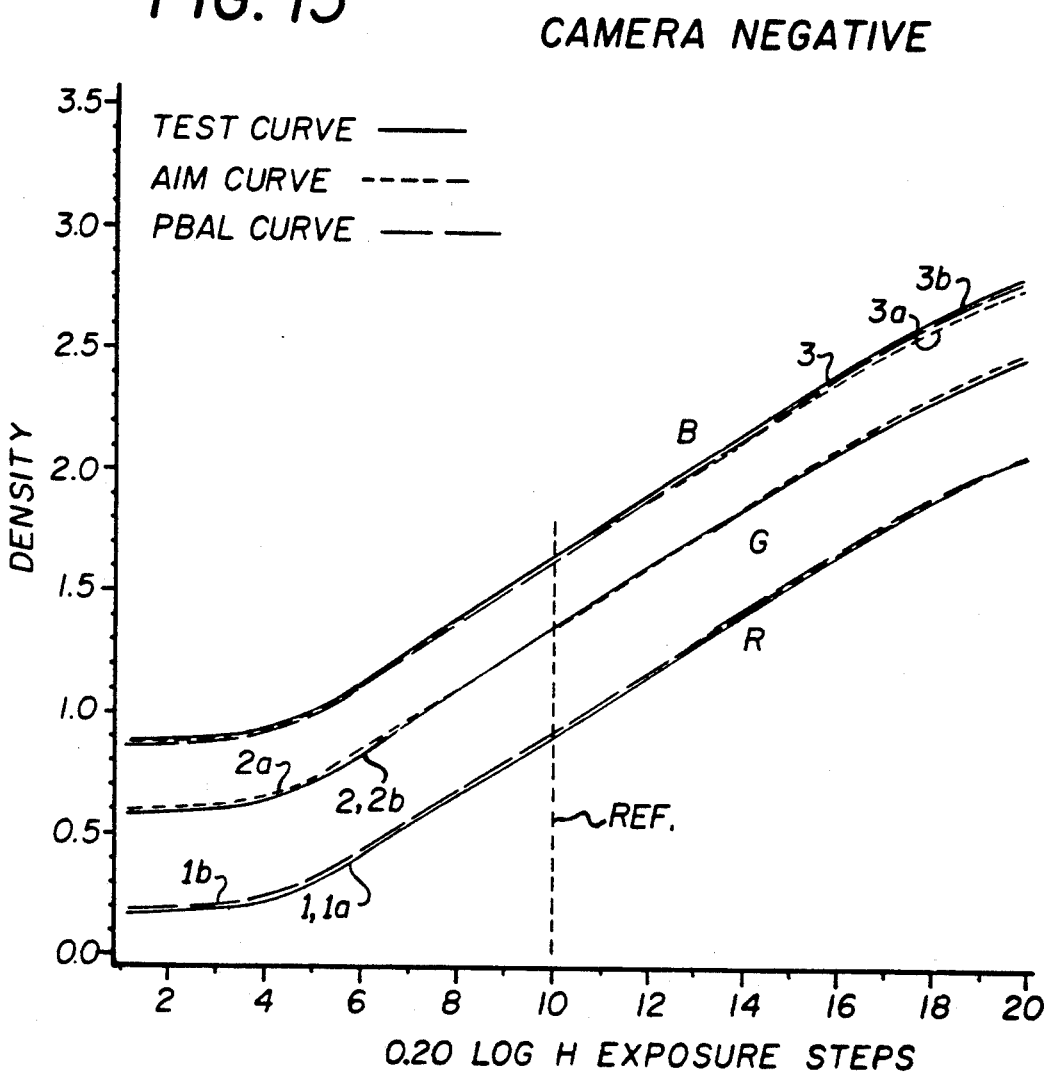
FIG. 15 repeats FIG. 7, adding aim densities, level-prebalanced densities, and the reference LOG H location of a normally-exposed, 18%-reflecting gray card.

A composite display and density response curves for a test sample of a camera negative are shown in FIGS. 3 and 15. FIG. 15 is like FIG. 7, except for the addition of aim curves, 1*a*, 2*a*, 3*a*, and broken lines, 1*b*, 2*b*, 3*b*, the latter triplet having the same shapes as the original test curves, 1, 2, 3, but shifted vertically to better match the aims. The vertical shifting may be more easily seen in the Deviation Plot of FIG. 3. In FIG. 3, the red, green, and blue PLVL (Prebalancing Level) values record the level of the test curves relative to the aim curves in density units times 100; i.e., the amounts of vertical shifting, with appropriate algebraic sign, define the PLVL errors (AQP 13). The vertical shifting simulates a photo processing laboratory's color balancing changes required to obtain an acceptable print from the camera negative as compared to an aim negative: the PLVL values, therefore, predict the printing incompatibility of a batch of camera negative. As might be expected, the tunable Quality Objective Function (Eqs. 22, 27, 29) is at the heart of the formal procedure for level shifting, whose development will be delayed to permit the examination of horn limits for camera negatives.

HORN LIMITS FOR A CAMERA NEGATIVE

Contrasted with the easy application of Eq. 8 for a camera reversal (FIG. 5) or a print material (FIG. 6), three factors complicate the derivation of the release horn limits (lines 4*a* and 4*b* in FIG. 3):

1) The camera negative densities must be printed to the appropriate print material before the densities can be lightness weighted as in Eq. 8. The print-through densities in the print material can be estimated via conventional tone reproduction calculations by forcing a gray card of 18% reflectance in an original scene to print at a standard density level: about 0.7 for photographic paper; about 1.0 for a transparent print material.
2) The impact of a density error at any exposure step of the negative will be altered in severity by the contrast (point slope) of the print material's density response curve at the print-through density. Print-through densities falling at contrasts higher than that at the standard 18% print-through density will have error impacts amplified, relatively, and conversely.
3) In general, camera negatives provide generous exposure latitude, with exposure error forgiveness extending from even as much as two camera stops underexposure to three stops overexposure. This means that the exact point along the LOG H axis at which the 18% gray card from a randomly chosen scene will fall is indeterminate.

Figure 16:
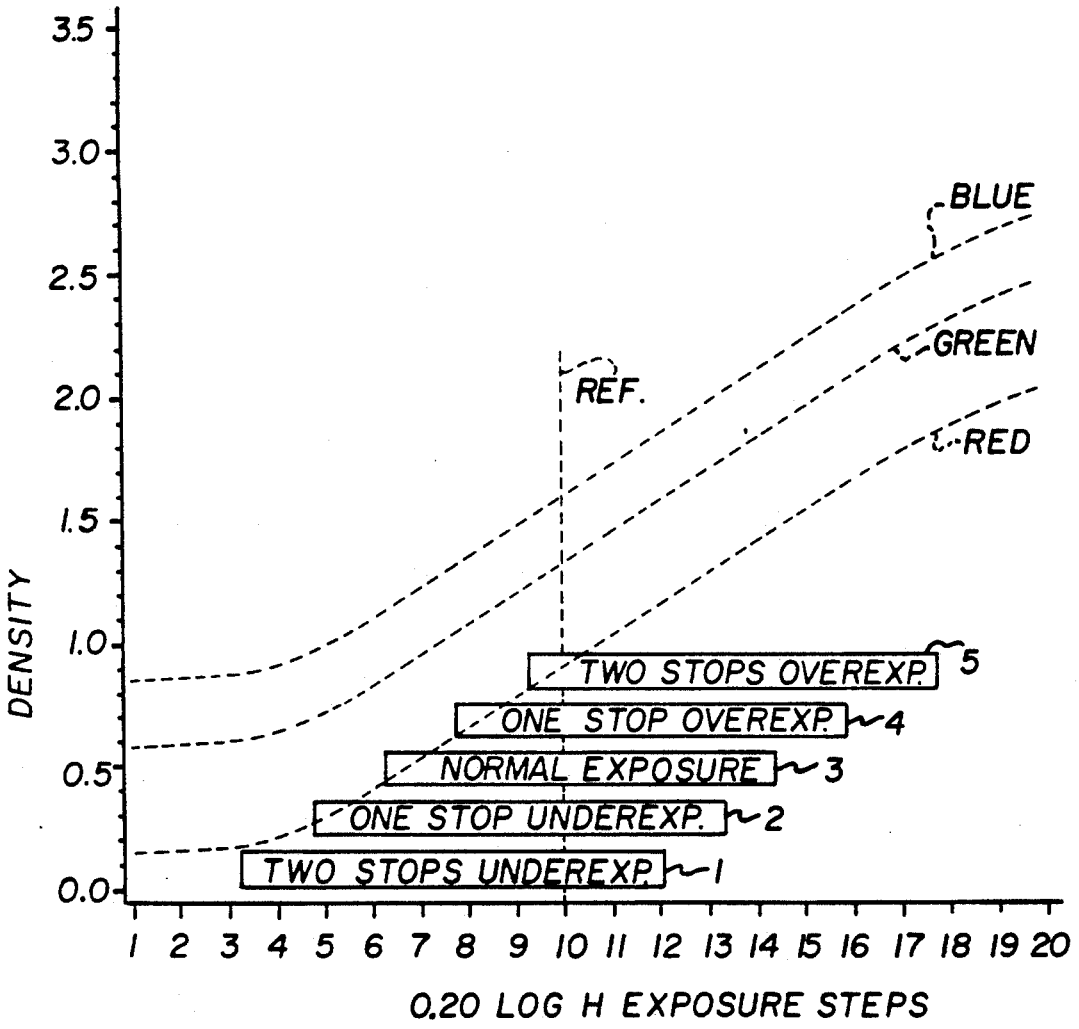
FIG. 16 illustrates for a camera negative a wide range of exposure latitude, ranging, in this example, from two stops underexposure to two steps overexposure.

A schematic illustration of complicating factor three appears in FIG. 16, with the choice of reference point (for CRE, ADE, and CME tolerancing) linked unsurprisingly to the "normal" exposure. FIG. 16 shows each exposure condition from two stops underexposure through two stops overexposure (boxes 1 to 5) occupying a 1.5 LOG H range, with the right end of each box representing the exposure level of a photographed object with 100% reflectance. In each box, the 18%-reflecting gray card would fall in the middle, the point about 0.75 LOG H to the left of the 100% reflectance point, i.e., LOG(0.18) = −0.75, at one half of the 1.5 range. The normal exposure range, box 3, the only one bisected by the dashed vertical reference-limit line, is deliberately linked to the reference point, which also coincidentally falls at exposure step 10. It should be noted that the box length of 1.5 LOG H represents an example scene only: in fact, recorded scene-brightness ranges may be larger or smaller, depending upon scene content, lighting ratios, and camera quality.

Eq. 8 must be altered somewhat to satisfy the first two complicating factors:

$$L_i = \pm(c_o/c_i)(10)^{(w)(d_i - d_o)} \tag{39}$$

where $L_i$ = horn limit value at the $i^{th}$ exposure step, $d_o$ = the reference print-through density, say 0.7, at which an 18% gray card's image falls, $d_i$ = the print-through density of the $i^{th}$ exposure step of the camera negative, $c_o$ = the print material's contrast at the reference print-through density point, $c_i$ = the print material's contrast at the print-through density for the $i^{th}$ step of the camera negative, w = the exponential power of the lightness weighting action as in Eq. 8.

Figure 6:
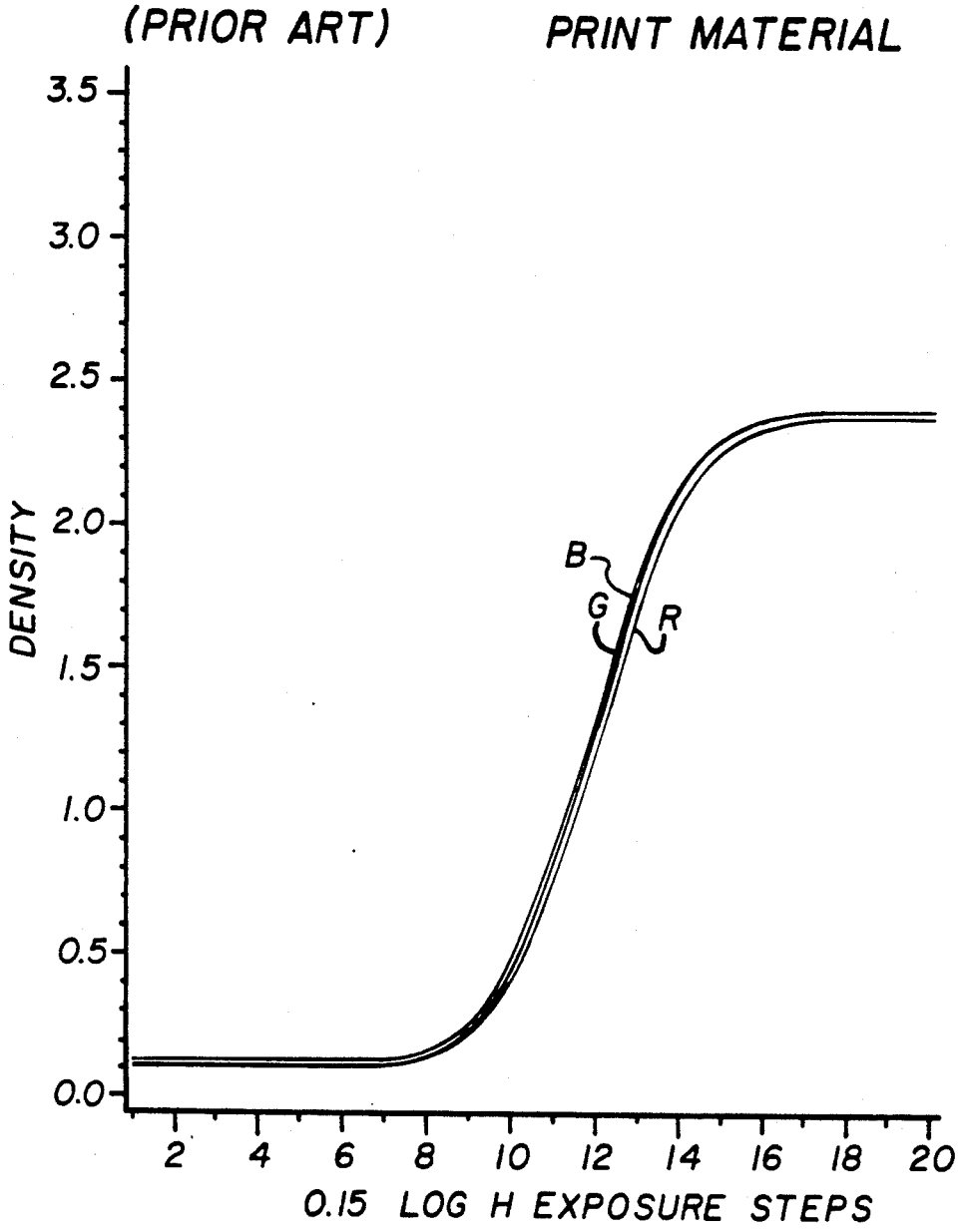
FIG. 6 (PRIOR ART)

A lightness-weighting power (w) of about one third is effective for use with the print-through densities of Eq. 39, just as it was with the original densities of the camera reversal of FIG. 5 and of the print material of FIG. 6, because the lightness weighting is consistently being applied only to densities to be viewed by the human eye. Again, only green-density aim curves (item 2*a* in FIG. 15 and the green-density aim of the print material) are needed to derive horn limits.

Figure 17:
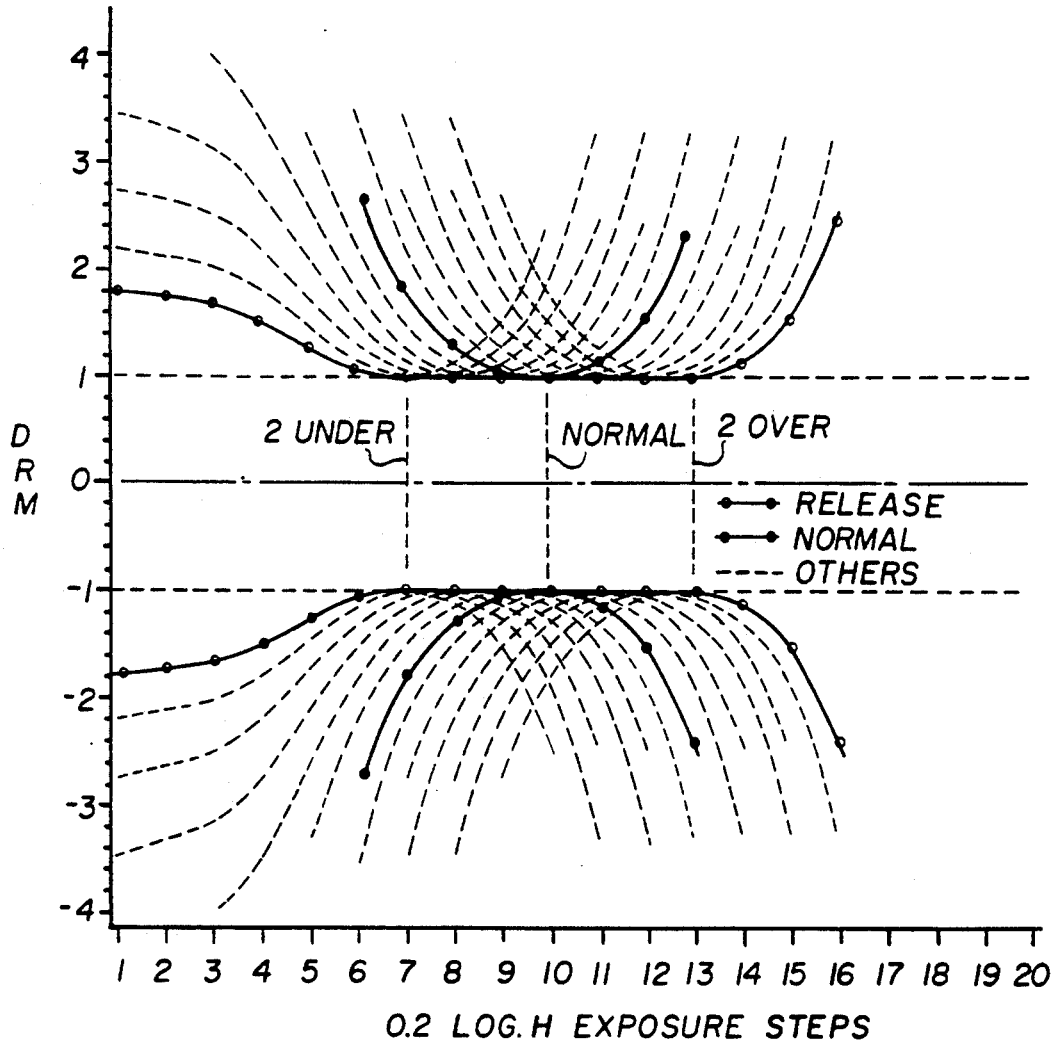
FIG. 17 shows a scheme for deriving the release limit lines (R) and the normal limit lines (N) needed for a composite display like FIG. 3 of a camera negative, allowing for wide exposure latitude.

FIG. 17 shows how to overcome complicating factor three for camera negatives, the issue of exposure latitude. Many symmetrical cusp-shaped horns must be derived, each calculated via Eq. 39 as one of the horns from possible exposures ranging from two stops under to two stops over, for example. Choosing the most restrictive, conservative, limit values for each exposure step results in the solid lines labeled "R", the release horn. The horn for a normal exposure, labeled "N", will be used in the coming discussion of level prebalancing. As in FIG. 16, the location of the normally-exposed 18% reflectance gray exactly at exposure step 10 is just by way of example, not by way of necessity or recommendation: practically, however, it would usually fall fairly near the center of the LOG H range for a product's standard exposure.

LEVEL PREBALANCING

As introduced previously, level prebalancing shifts each of the red, green, and blue density curves up or down to "match" the aim density curves over the step range where a normal picture should be exposed. The specific horn used with level prebalancing for the camera negative of FIG. 15 is the "normal" (N) horn of FIG. 17, derived via Eq. 39. The matching is done by minimizing the value of the Quality Objective Function (Eqs. 22, 27), but, in the case of level prebalancing, only the first term of the function is necessary or useful:

$$F = f_1(HT/w_1)^2 \tag{40}$$

where $f_1$ and $w_1$ can be set to 1.0 arbitrarily.

(The second and third terms of Eqs. 22 or 27 can be used in place of or in addition to the first term. The following derivation is based on the preferred use of the first term.)

The optimal level shifting of each color density curve is estimated by applying the Generalized Least Squares (GLS) matrix equation (Eq. 37):

$$c = -[EQE']^{-1}EQy \tag{41}$$

where y = 60×1 column vector of density errors $= [r_1, g_1, b_1, r_2, g_2, b_2, \ldots, r_{20}, g_{20}, b_{20}]'$, Q = the composite quality weighting matrix of Eq. 30 (with only a single term), c = 3×1 column vector of prescriptive density level changes in the same order as the unit effects are stacked in the E matrix and in corresponding units, i.e., the number of 0.01 density increments, E = 3×60 unit level-effects matrix as follows:

$$\left|\begin{array}{c|c|c| preferred the simplicity and usefulness of calculations relating to a normal exposure.

A LABORATORY INTERNEGATIVE

Figure 18:
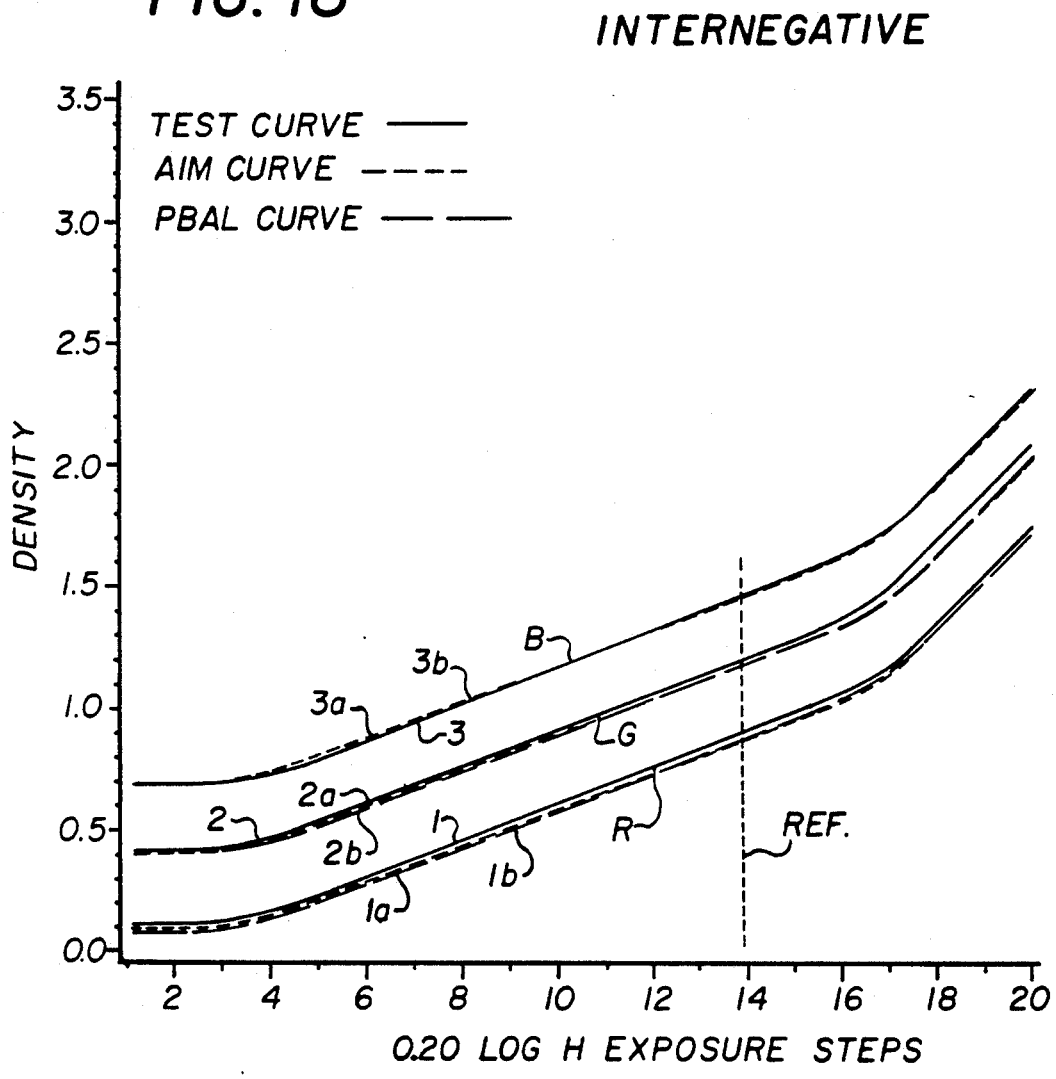

Care must be taken in applying Eq. 39 and FIG. 17 to the horn-limit derivations for non-viewed laboratory materials such as internegatives and intermediates. For internegatives, that are exposed to a reversal film or flat copy, the reversal film or flat copy is treated like an original scene and the exposure error latitude for the internegative is taken as a laboratory's practical exposure tolerance (i.e., permissible 18% gray-card reference LOG H range), probably less than ±0.3 LOG H. A composite display and density response curves for a test sample of an internegative film are shown in FIGS. 4 and 18. FIG. 18 is similar to FIG. 8, except for the addition of aim curves, 1*a*, 2*a*, 3*a*, and broken lines, 1*b*, 2*b*, 3*b*, the latter triplet having the same shapes as the original test curves, 1, 2, 3, but shifted horizontally and vertically to better match the aims. In FIG. 4, the red, green, and blue PSPD values record the sample test speed relative to the aim in units of LOG H times 100, as determined through a tuned speed prebalancing procedure (see Eq. 37 and related text). Also in FIG. 4, the red, green, and blue PLVL values record the level of the test curves relative to the aim curves in density units times 100, as determined through a tuned level-prebalancing procedure (Eq. 41 and related text). It is important to realize that the two prebalancing steps are applied sequentially: first for speed, relating to the operation of exposing the internegative; and second for level, assessing printing incompatibility after the original curves have been shifted for speed. Finally after a shifting of the original curves a second time for level, the SQIP and AQP parameters are calculated—except for conventional speed and DM (Dmin) parameters, which are most conveniently evaluated before any shifting.

A LABORATORY INTERMEDIATE

Figure 19:
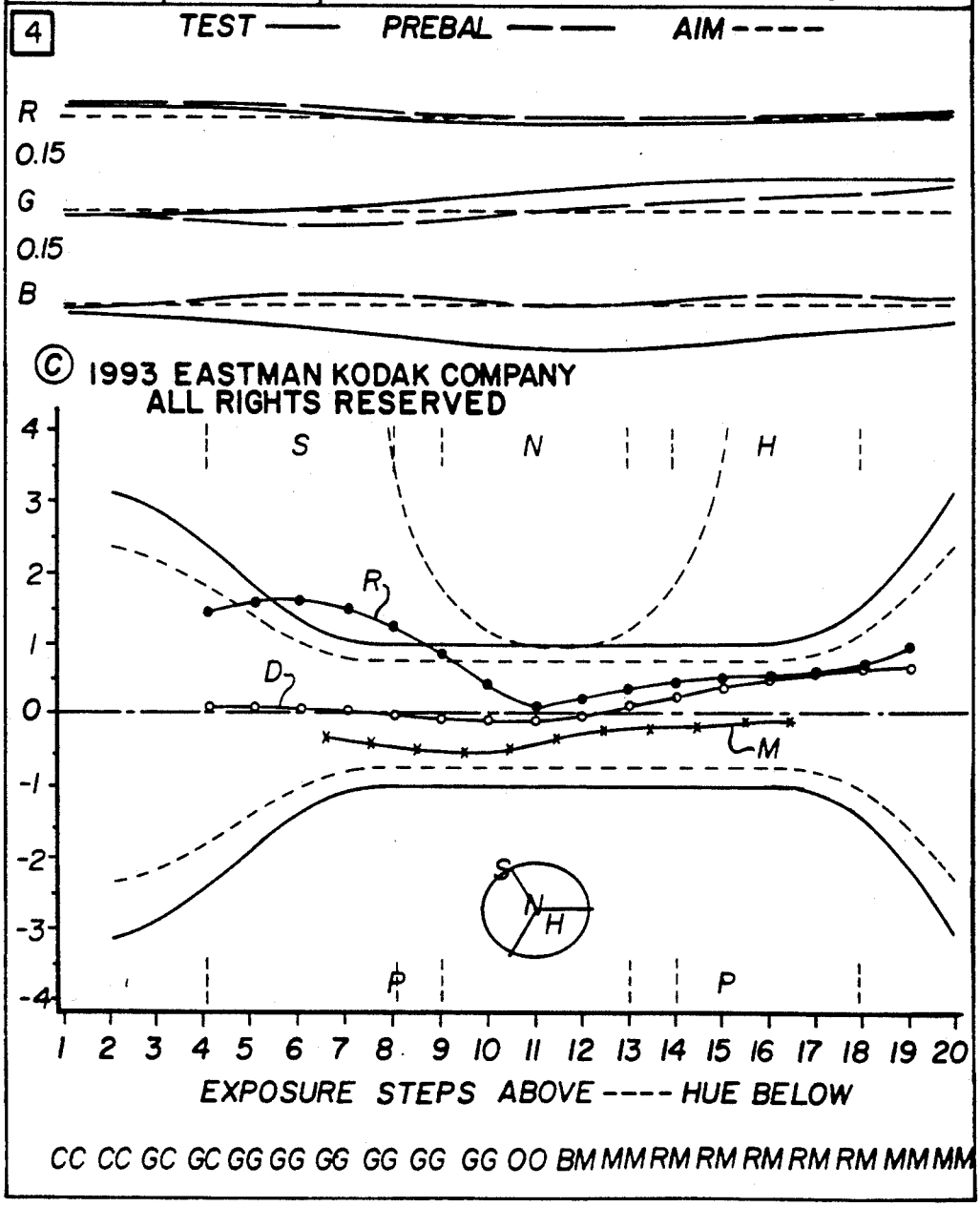
FIG. 19 is the composite display for an intermediate film used in a motion picture printing laboratory.
Figure 20:
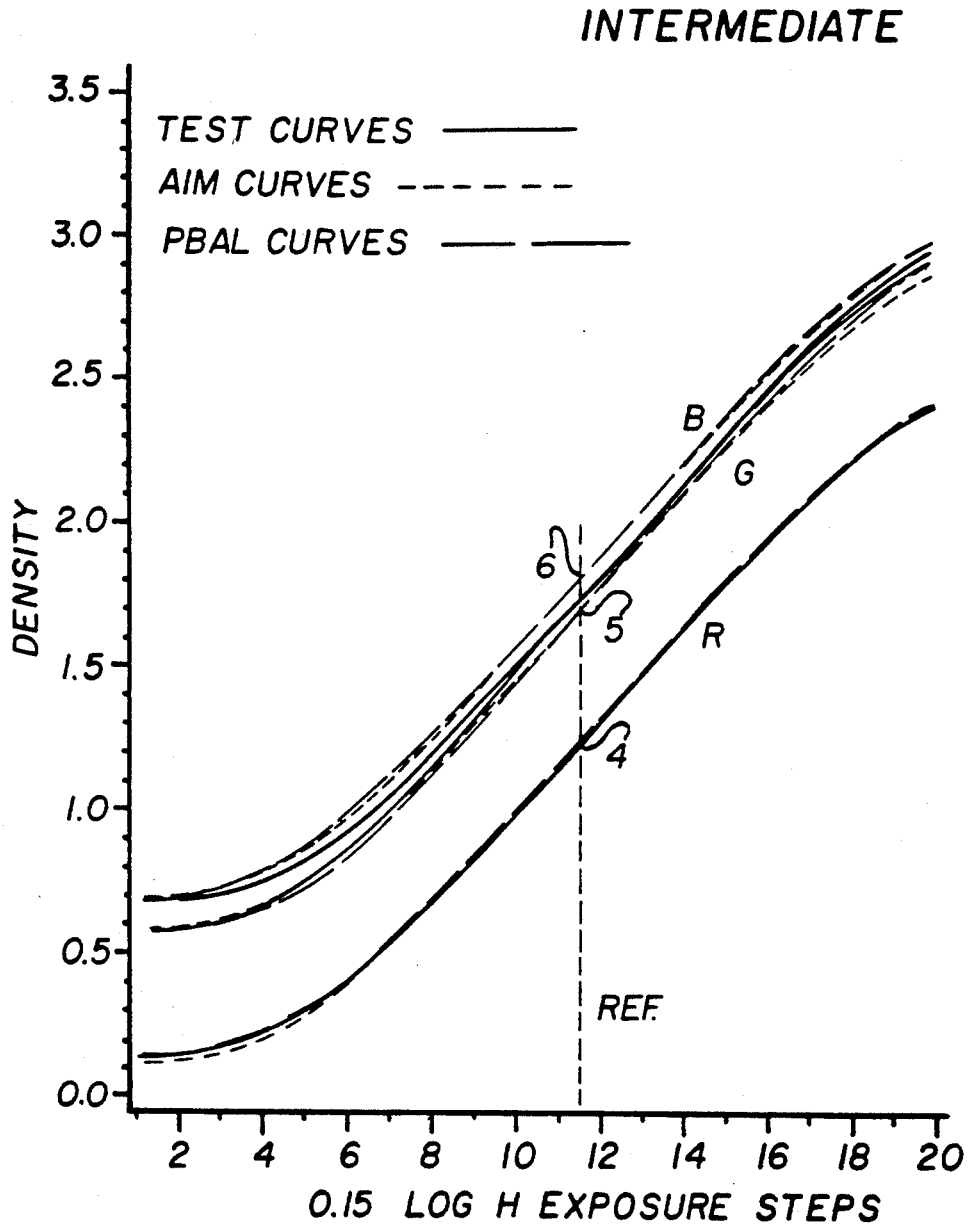
FIG. 20 shows the conventional density versus LOG H plot for the intermediate film sample of FIG. 19, with aim densities, prebalanced densities, and the reference LOG H location of a normally-exposed, 18%-reflecting gray card.
Figure 21:
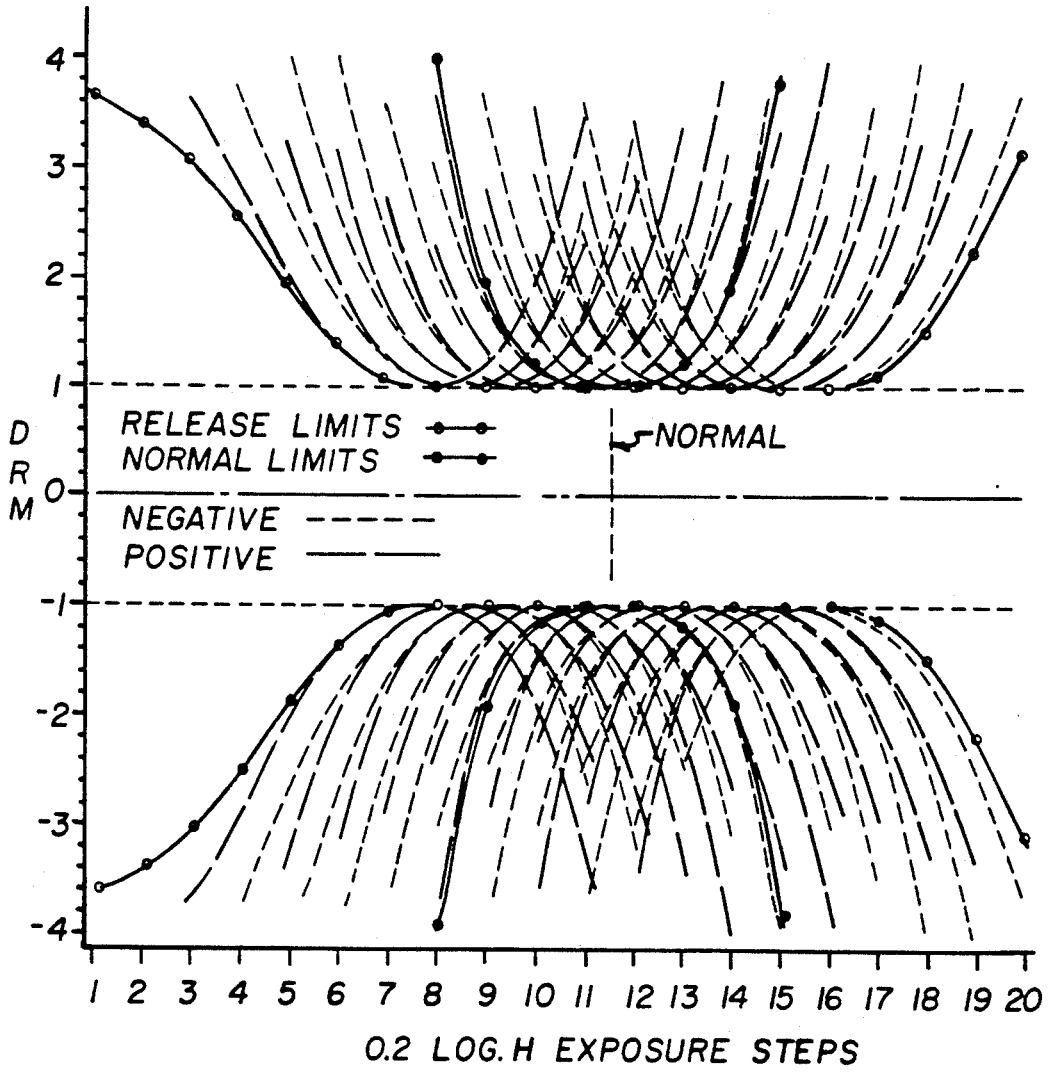
FIG. 21, similar to FIG. 17, shows the horn-limits derivation scheme for intermediate film with the complications arising from its use in both master positive and duplicate negative stages of the motion picture production process.

A laboratory intermediate film, with contrast near unity, is shown in FIGS. 19 and 20. It requires speed and level prebalancing like the laboratory internegative just described, but its horn-limits derivation is complicated slightly by its use in two consecutive stages of printing: first, to produce a master positive from a camera negative, and second, to produce a duplicate negative from the master positive. These two stages of a ciné-negative duplicating procedure enable the special optical effects and the original negative protection needed by the motion picture industry. In practice, the following assumptions have been effective in deriving the horn limits:

1) Assume the worst case wherein a laboratory does not correct for original negative exposure error on a scene-to-scene basis when exposing the intermediate positive.
2) Assume the center of the expected camera-negative range of LOG H reference points (recorded 18% gray-card locations) will be printed to the center of the linear section of the density-response curves of the intermediate film (points 4, 5, and 6 in FIG. 20.)
3) Assume some tolerance for error must be allowed for executing assumption 2 at both master positive and duplicate negative printing stages under laboratory conditions. This might amount to ±0.10 to ±0.15 LOG H at either stage, with the possibility of the errors adding so as to double the error at the duplicate negative stage.
4) In finding the most restrictive release (and normal) horn in the scheme of FIG. 17, the lightness-weighted cusps from printing both the master positive and the duplicate negative through to the final print material must be included to account for the opposite tone scales in each stage: the higher densities of the master positive, for instance, carry shadow detail, while the higher densities of the duplicate negative carry highlight detail. The short dashes in FIG. 21 portray the symmetrical cusps from the anticipated range of duplicate negative print-throughs, while the longer dashes do likewise for the range of master positive print-throughs.

REVERSAL DUPLICATING FILM

The density-response curveshapes of many products requiring moderate speed prebalancing to simulate customer usage (such as the print material of FIG. 6, the internegative of FIG. 8, and the intermediate of FIG. 20) may be essentially unchanged when they are color balanced in real printing equipment. Some such products, like the reversal duplicating film in FIGS. 22 and 23, however, do exhibit subtle curveshape changes when they are subjected to exposures of differing color balance. This causes the previously-described mathematical speed-prebalancing procedure to be inaccurate whenever the prescriptive speed shifts produce a color balance shift (an unequal shifting of red, green, and blue density response curves). We have found the inaccuracy can be corrected by a Curveshape Correction Model (CCM), specifically tailored to suit a specific product.

A CURVESHAPE CORRECTION MODEL (CCM)

In general, the further a product batch deviates from aim speed balance, the larger the required shape correction during speed prebalancing. One approach to a CCM is embodied in the following procedural steps which include two standard mathematical techniques, the Method of Principle Components and Multiple Linear Regression, described in many textbooks, such as *Applied Regression Analysis, Second Edition*, by Norman Draper and Harry Smith.

1) Using a typically acceptable batch of a product, collect the density-response data from a color-compensating (cc) filter ring-around set of exposures in the six usual color directions, namely, red, green, blue, cyan, magenta, and yellow.
2) Obtain the aim step densities for the product.
3) Speed shift (horizontally) all the test curves in 1 by color to match the corresponding aim curves, recording the LOG H shifts. See later section for suggested methodologies.
4) Calculate the color balance coordinates (G,B) for each test from the red, green and blue speed shifts in 3:
   G = green shift − red shift
   B = blue shift − red shift
5) Concatenate the red, green, and blue shifted densities to form a 60-component density vector for each test. (This assumes, of course, the use of 20 exposure steps per color.)
6) Deviate each shifted test in 5 from the mean of the shifted ring-around set, stacking the deviation vectors in a 60-column matrix, one test per row. (If more than one ring-around set has been exposed, the sets may be stacked at this point to increase the signal-to-noise ratio of the procedure.)

7) Calculate the Principle Component unit density vectors via the classical Method of Principle Components for the shifted test deviation population in the matrix of 6, retaining also the "scores" or amounts of the unit vectors required to reconstruct each test deviation on the mean (zero). Experience has shown that only the first four (or fewer), most significant, unit vectors are needed to adequately "explain" the shape variations encountered in the shifted deviation matrix of 6.
8) With the scores as independent variables, and with functions of G and B, the color balance coordinates, as regressor variables, select four good-fitting regression models to estimate the scores for each of the four Principle Component vectors of 7 through a limited trial-and-error search. Nine functions of G and B should be tried: G, B, $G^2$, $B^2$, $G^3$, $B^3$, GB, $G^2B$, $GB^2$, not all of which are relevant to every model. Save the coefficients of each relevant regressor variable for each of the four models.
9) The four principle-component vectors of 7 and the four sets of best regression coefficients from 8 are the important elements of the CCM. The intercept term in each regression, though determined, is dropped from consideration, as it relates to the bias of the grand average of all tests from the aim color balance, a bias which should be close to zero with a balanced ring-around test design, and indeed must be set to zero, anyway. The intercept cannot be allowed a non-zero value, because the estimate of the amounts of the unit shaping vectors required must be zero when G and B are zero, that is, when no color balance shift is needed to match the aim.

Two criteria in the cc filter ring-around design will help to minimize CCM bias: one, try to make the center point of the color filter gamut, the average exposure point, as close to the aim color balance as possible, and two, deviate from the aim balance in a symmetrical way, choosing the same number of test points and the same approximate increments in each of the six usual color directions. To promote adequate delineation of the toe and shoulder areas, it is useful to adjust exposures to center the density response curves within the LOG H axis range, perhaps even removing some neutral filtration when the heavier color filters are used, to ensure an effective compromise location.

Two speed-matching methods deserve consideration in connection with CCM procedural step 3. For print materials such as the reversal duplicating film of FIGS. 22 and 23, matching a test curve to its corresponding aim curve at a specific density level (e.g., 1.0) has proven to be successful in developing a useful CCM. If a CCM is needed for certain internegatives and intermediates, the speed-prebalancing technique (see Eq. 37 and related text) can be tuned to give a more realistic speed match.

Figure 22:
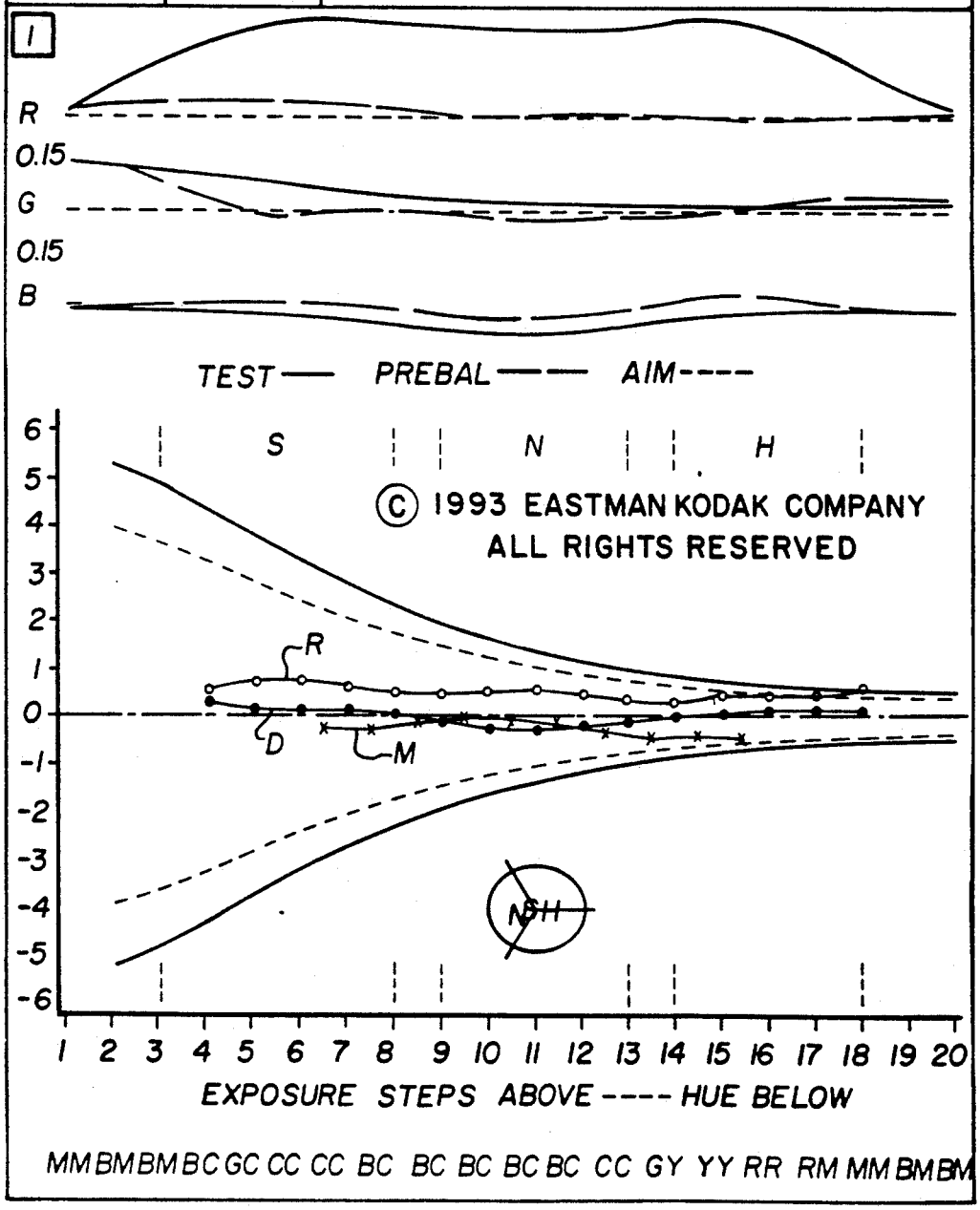
FIG. 22 is the composite display for a reversal duplicating film.
Figure 23:
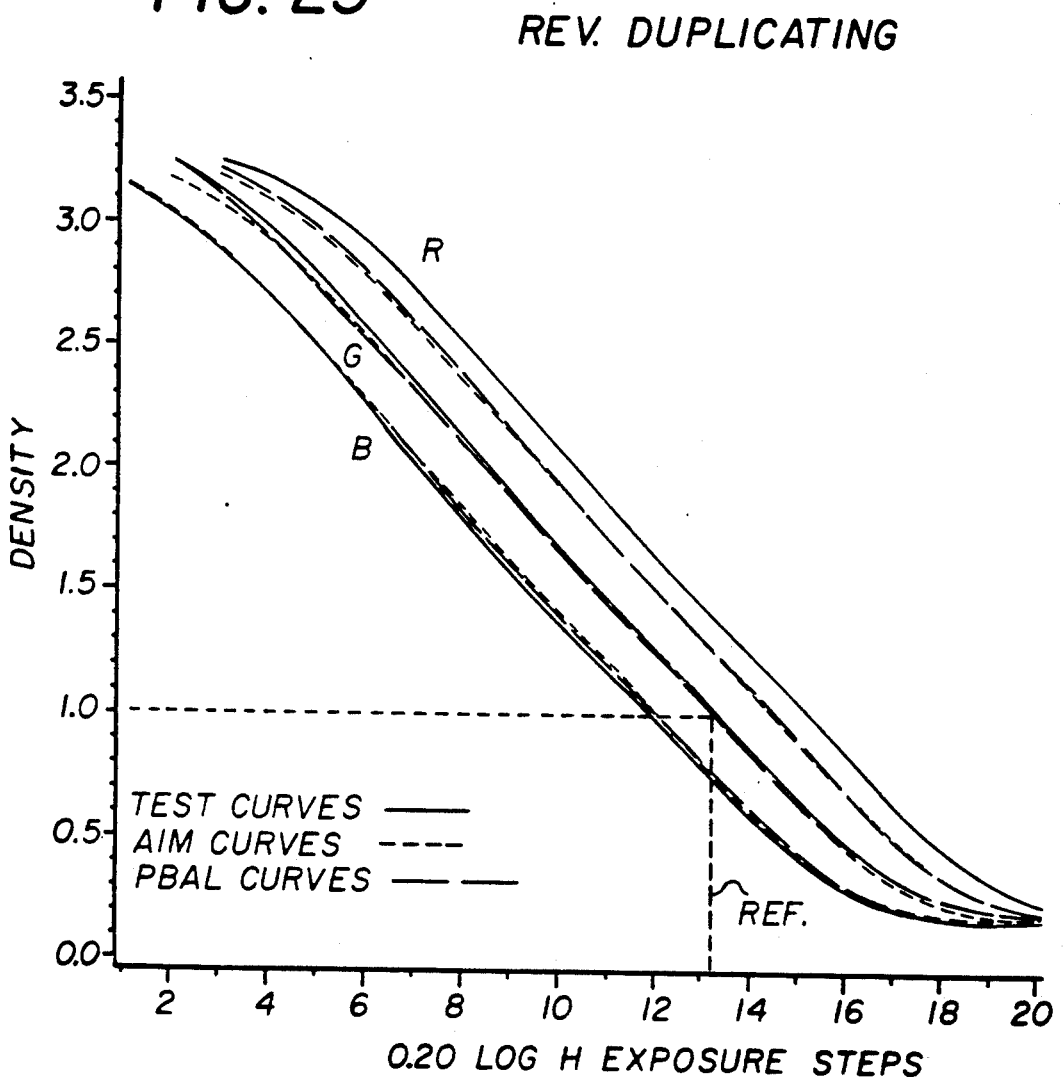
FIG. 23 shows the conventional density versus LOG H plot (colors offset) for the reversal duplicating film sample of FIG. 22, with aim densities, speed-prebalanced densities, and a typical reference LOG H location at 1.0 green density.

Here is an outline of the method for modifying the overall speed-prebalancing procedure to apply the CCM to a particular test sample like that shown in FIGS. 22 and 23:

1) Shift the test curves by color to match the corresponding aim curves, using the same method as used in the development of the product's CCM from the cc filter ring-around sets.
2) From the LOG H speed shifts in 1, calculate the G and B color balance coordinates:

G = green shift − red shift
B = blue shift − red shift.

3) Estimate the amounts of the Principal Component unit vectors required to correct the shape of the shifted test curves by inserting the values of G and B into the regression equations.
4) Correct the shape of the shifted test curves by subtracting the amounts of the unit vectors in 3, by color, from each exposure step.

After the CCM is applied as described above, the speed prebalancing method of Eq. 37 and related text is applied to the shifted and shaped versions of the red, green, and blue test density curves. The red, green, and blue PSPD parameters then become the net results of the shifting done in both procedures. This assumes the amount of speed balancing left to do in the final speed-prebalancing procedure is small enough to ignore any additional effects on curveshape, a rational compromise in practice, because the CCM's curveshape impact is always small for any reasonable product excursion from aim speed balance, and because the bulk of the speed shifting always occurs in the initial CCM procedure.

Figure 24:
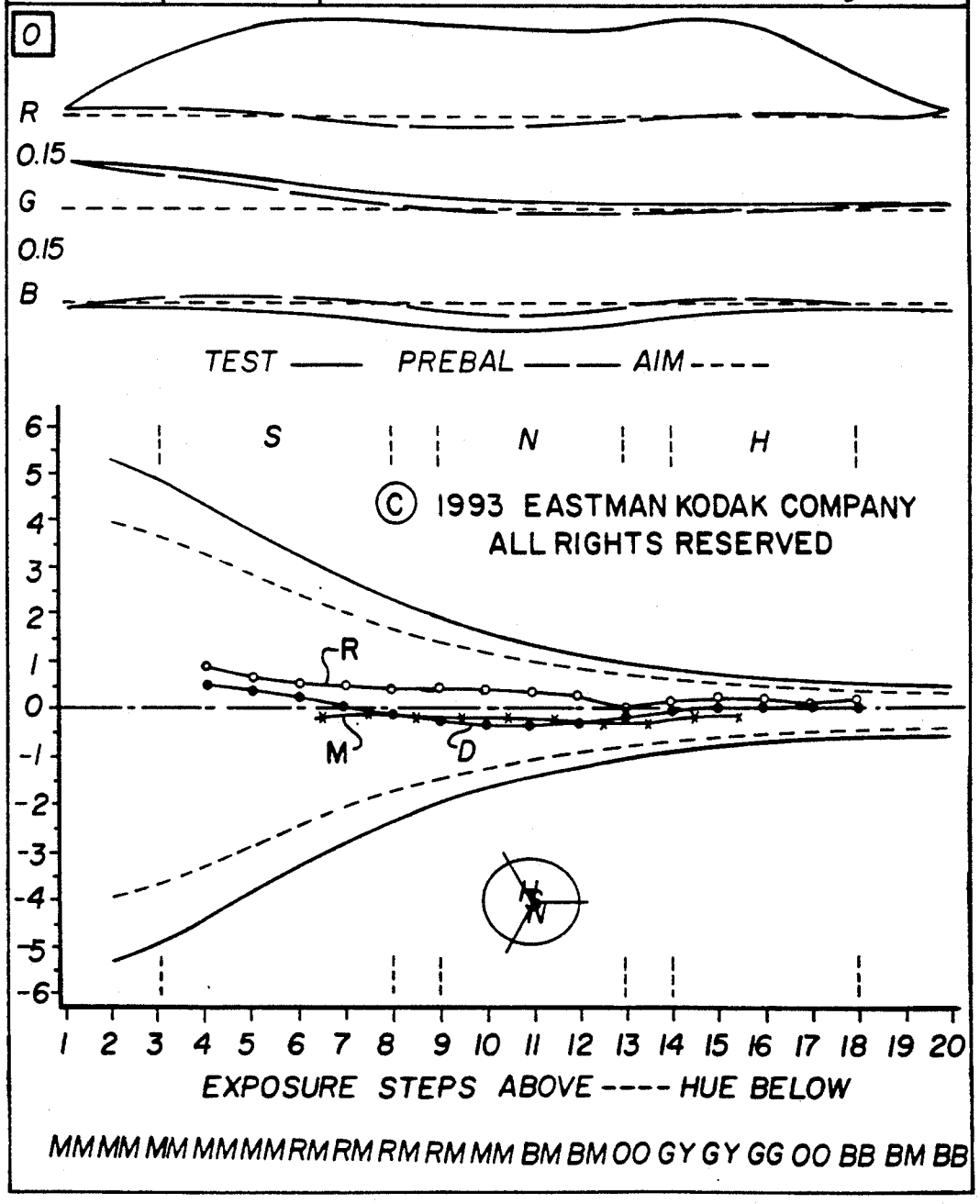
FIG. 24 is a composite display for the same reversal duplicating film sample shown in FIGS. 22 and 23 except that a product-specific Curveshape Correction Model used to refine the FIG. 22 composite has been eliminated.

A CCM's impact on the SQIP and AQP parameters for the reversal duplicating film of FIG. 23 may be appreciated by comparing FIG. 22 (with CCM) to FIG. 24 (no CCM). The incidental slow red speed of this film sample disturbs the color speed balance enough to significantly affect the quality appraisal if the CCM is not used.

SIZING THE SPEED-PREBALANCING WEIGHTS

In this description, four types of color photographic products (print material, internegative, intermediate, and reversal duplicating films) have required speed prebalancing to generate red, green, and blue PSPD values that estimate a printing laboratory's optimum practical balancing adjustments for a particular batch of product. The sizing of the product-specific weights ($f_j$) to be applied to each of the five terms of the Quality Objective Function (Eqs. 22 and 27) requires reasoning, and sometimes, a bit of trial and error.

Obviously, setting any term's weight at zero eliminates the quality impact of that term on the speed-prebalancing procedure. With internegatives, for instance, it has been useful to zero out the first three terms containing HT, DT, and RT, so as to force the procedure to try to match the shapes of the test and aim curves without regard to overall density levels. This occurs because the remaining two terms emphasize contrast only: the MT term weighs TCM, total contrast mismatch; and the CT term weighs the total contrast errors—the TCE values for individual color density curves. Equal weight on MT and CT was found to be an effective compromise in practical internegative trials.

The speed-prebalancing procedure is sensitive only to the ratio of, or relative size of, each term's weight in relation to the weight of each of the other terms. In that regard, it has rarely been found useful to exceed a ten-to-one weight ratio for any pair of terms with non-zero weights.

As another example, the sizing of objective function weights for intermediate film depends upon the typical user's need to find the exposure that produces standard red, green, and blue density levels for a given batch of product. These standard levels always fall near the center of the linear section of the density response curves, in the middle of the product's exposure range.

The speed adjustments necessary for the batch can therefore be reasonably estimated by using equal weights on the second and third terms containing DT and RT while zeroing the weights on the other terms; i.e., the speed-prebalancing procedure minimizes DT and RT. Alternatively, the first term only (containing HT) could be weighted, because, by itself, it would also cause the speed-prebalancing procedure to tend to match mid-scale densities of a batch of product to its aim densities.

The basic intention in sizing the weights on the terms of the objective function is to cause the speed-prebalancing procedure to produce relevant estimates of the practical color speed deviations from aim of a batch of product.

CYLINDRICAL TOLERANCES

Figure 12:
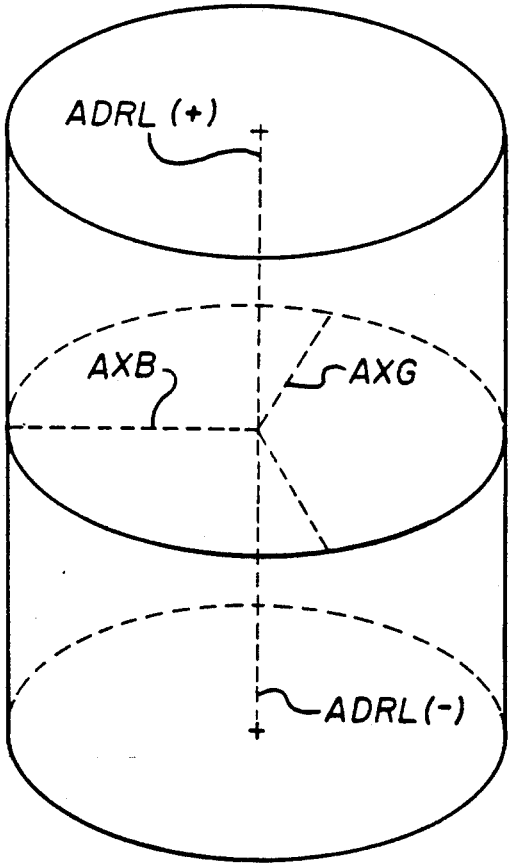
FIG. 12 combines the elliptical reference limits for Color Radial Error (CRE) with the orthogonal limits for Average Density Error (ADE) to demonstrate the concept of cylindrical reference limits for parameters having red, green, and blue counterparts.

An earlier part of this description introduced the concept of a reference cylinder as an aid in visualizing the tolerances at the reference LOG H point of the two orthogonal SQIP, CRE and ADE (see FIG. 12). Such a cylinder can be scaled to serve as a tolerancing boundary for any parameter reported as red, green, and blue deviates from aim values (errors), i.e., OSE, PSPD, PLVL, ER speed, DM, and densities on an exposure step. In fact, the cylinder that tolerances a tricolor set of density deviates on any exposure step is scaled in size by the horn limits value on that step. A horn value of two on an exposure step, for instance, would correspond to a tolerancing cylinder with twice the linear dimensions of the reference cylinder (horn value of one, by definition).

Although, in principle, the shape of a cylinder's cross section may be any closed curve, this description will continue to emphasize an elliptical color-balance limit for simplicity and practicality. Eq. 1, 2, 3, and FIG. 10 helped develop the concept of a normalized Color Radial Error (CRE) specifically as a color density balance parameter, but the concept is usefully applied to any parameter reported as a set of tricolor deviates. When applied to such parameter sets, the concept of a normalized Average Density Error (see Eq. 4) can be flexibly generalized by defining a generic, normalized, Average Level Error (ALE):

$$ALE = \frac{(l_1)(r) + (l_2)(g) + (l_3)(b)}{ALRL} \quad (43)$$

where

ALE = Average Level Error,

ALRL = Average Level Reference Limit, r, g, b = any suitable tricolor deviates, $l_1$, $l_2$, $l_3$ = color deviate weights, such that $l_i \geqq 0$ and $\Sigma(l_i) = 1$.

The Average Level Reference Limit (ALRL) is a normalizing divisor chosen to be the highest acceptable ALE for a particular tricolor parameter set. When ALE is less than or equal to 1.0, the test is acceptable for ALE; but when ALE is greater than 1.0, the test fails for ALE. Eq. 4 can now be understood as a special case of Eq. 43, a case where $l_1 = l_2 = l_1 = \frac{5}{8}$ and density is the specific tricolor parameter. Sometimes it's useful to weigh only the green deviate, for instance, so a parameter can be flagged if it fails for its absolute green deviation (ALE > 1.0), and/or for its companion error dimension, Color Radial Error (CRE > 1.0). Another type of weighting might be related to visual lightness, e.g., $l_1 = 0.35$, $l_2 = 0.50$, $l_3 = 0.15$, the weights adding to 1.0, as required.

When the weights are not equal to $\frac{5}{8}$, CRE and ALE are not orthogonal, so the cylinder concept is blurred; but it is useful to use the term "pseudocylinder" in this case, retaining the idea of a color balance "cross section" and a separate level "dimension", ALRL, the normalizing divisor for ALE. Single letters can conveniently flag parameter values that breach tolerances. For example, a "C" can signal a Color Radial Error only; "L", an Average Level Error only; and "B", simultaneous C and L errors (both). Capital letters (C,L,B) can flag breaches of the release limits, while small letters (c,l,b) can flag breaches of an inner limit, set at some fraction of the release limit. This letter system works with any set of color deviate weights in the ALE calculation and has been applied in the AQP tables at the top of each composite display (see FIGS. 1–4, 19, 22, 24, 34, 35).

Although it may not be considered essential, the HUE of any set of tricolor deviates can be determined through the same process as was demonstrated for the HUE parameter shown below each exposure step of a SQIP Plot on any composite display. HUE is always a two-letter color sector label such as GG, RM, or CC (see FIG. 11).

At least three numbers are needed to tolerance a "cylinderized" tricolor parameter set: AXG and AXB for Color Radial Error, and ALRL for Average Level Error. When non-equal color deviate weights are used in the ALE calculation, obviously the three weights ($l_i$) must also be specified.

If a parameter's color balance is trended in the trilinear color plane, points may be flagged, highlighted, or legend-referenced when their companion ALE value breaches its tolerance. This alleviates the major shortcoming of past trilinear trends, namely, the need to look elsewhere to determine fully the disposition of product represented by a test point.

AN ALTERNATIVE VARIABLE FOR THE SQIP PLOT

The "D" (ADE) line on any SQIP Plot may be replaced with an "L" (ALE) line, a parameter indicating, as one alternative, the scaled visual response to the density errors of an exposure step: "Will this step (or its print-through) appear visually lighter or darker than the aim?". This differs from the "D" signal: "Is the red, green, and blue density of this step higher or lower than the aim on the average?" "D" (ADE) weighs the color deviations equally, while "L" (ALE) might weigh them according to their approximate effect on visual lightness. When "L" replaces "D", the tolerancing divisor, ALRL, must be specified in addition to ADRL, which is still required to calculate AQP 3, DT.

TOLERANCING NON-TRICOLOR PARAMETERS

Unsuited to cylinderizing, trendable root-mean-square types of AQPs, such as DT, RT, TCM, RCM, TCE (3 each) and RCE (3 each), require but a single number for each parameter's release limit—abbreviated DTL, RTL, TCML, RCML, TCEL, RCEL. A simple character such as an asterisk (*) can flag out-of-tolerance parameter values, or some other method of highlighting may be used. An inner tolerance value may be set at some fraction of the release limit, with its own breaching flag, such as a plus sign (+). These flags may be seen in the AQP tables at the top of the composite display figures.

THE ERROR TALLY BOX

Previously cited as item 11 in FIG. 1, the Error Tally Box can now be said to count all the numeric AQP (NDO, NRO, NMO, DT, RT, TCM, RCM, TCEs, RCEs, OSEs, PSPDs, PLVLs) and the conventional parameters (such as DM, ER, BFS) that fall outside their release limits. AQP 5, DRT, is not included in the error box tallies in the composite display figures of this description: as a weaker parameter, it was omitted arbitrarily from the AQP tables to conserve space.

MONOCHROME PHOTOGRAPHIC PRODUCTS

Because there is no color density balance (i.e., CRE) and no color contrast mismatch (i.e., CME) for monochrome materials, the composite display is simplified. The SQIP Plot reduces to a plot of stepwise density error and a monochrome contrast error that is calculated as in Eq. 5. Density error and contrast error must each be normalized by appropriate tolerancing divisors analagous to ADRL in Eq. 4 and CMRL in Eq. 7 to enable plotting against a common ordinate scaling. Obviously, all tricolor parameters are eliminated in favor of single monochrome values, e.g., speed, % BFS, DM, PSPD, PLVL, TCE, and RCE, all of which may be toleranced directly without any consideration of cylinderized tolerances. TCM and RCM are eliminated. Horn limit derivations are unchanged except that they are based on the aim density curve for the monochrome material rather than a green density aim.

LOGIC OVERVIEW FOR COMPOSITE DISPLAY

Figure 25:
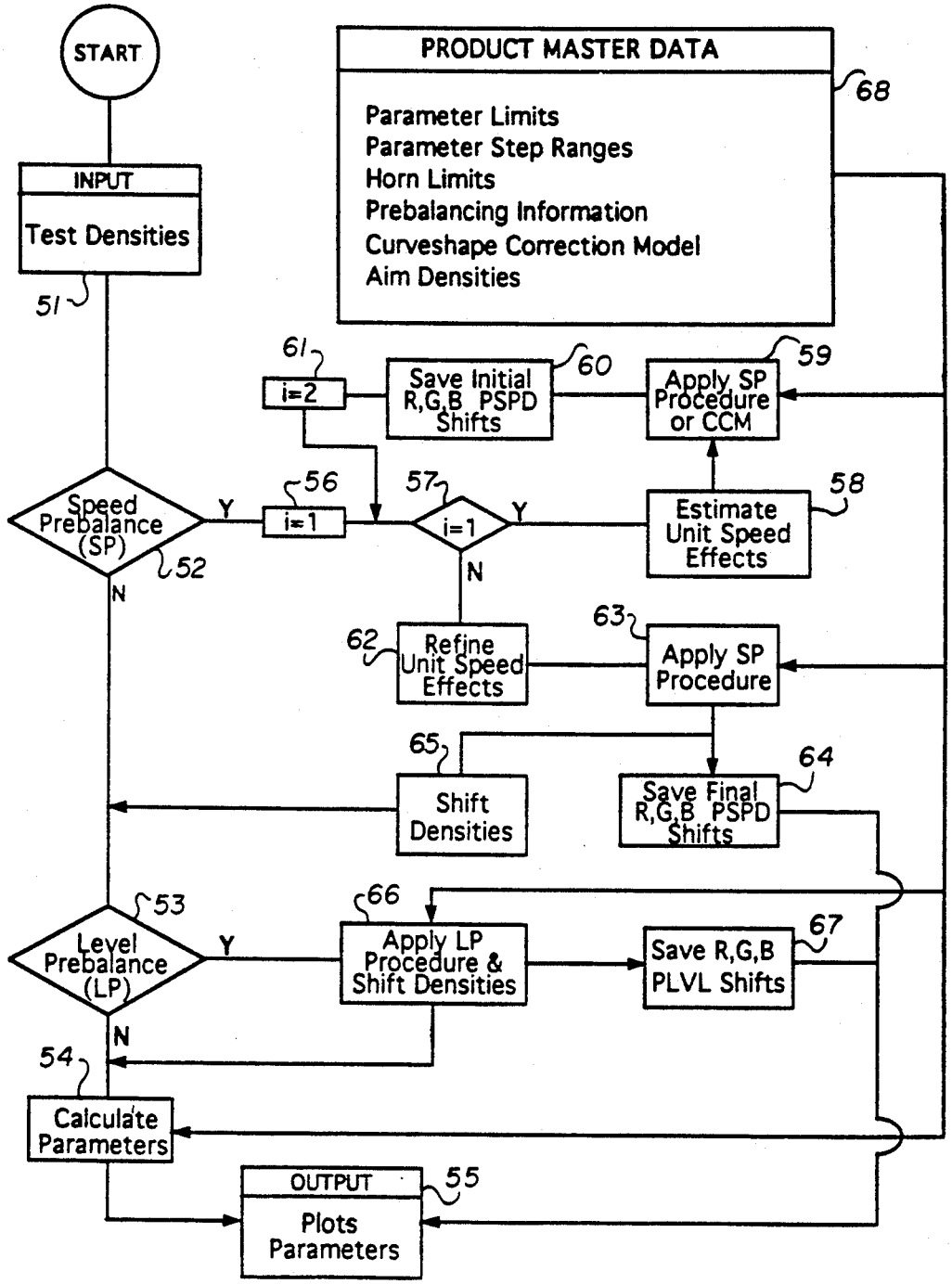
FIG. 25 outlines the logic flow of parameter calculations leading to a composite display for Sensitometric Quality Indicator Parameters and Auxiliary Quality Parameters.

In FIG. 25, a simplified logic flow diagram is presented to review the process of preparing a composite display for a product test sample, which activity—as can be appreciated by those skilled in the art—is accomplished readily using a general-purpose computer.

If neither speed nor level prebalancing is applicable to a particular product, the N (no) forks of decision boxes 52 and 53 are activated so test densities from box 51 and master data from box 68 are supplied directly to a computer symbolized by box 54 for the parameter calculations previously described, as needed to produce the composite display organized in box 55. Activities in boxes 56–67 are unneeded.

If speed prebalancing is applicable, the Y (yes) fork of decision box 52 diverts the logic flow through boxes 56–61 for the first iteration of the previously described speed-prebalancing procedure: the loop index is set to 1 in box 56 and tested in decision box 57 which directs flow along the Y fork to box 58 where an estimate of the red, green, and blue unit speed-effect vectors are calculated. The estimated speed effects are used in the regular speed-balancing procedure in box 59, although an alternate procedure based on the previously described curveshape correction model (CCM) could be used if necessary for the accurate appraisal of any particular product. The initial estimates of the speed shifts (red, green, and blue PSPD values) required to match the product aim curves are saved in box 60 and the loop index raised to 2 in box 61, causing the decision box 57 to divert flow along the N fork to box 62. Box 62 refines the unit speed effect estimates in the manner previously described. In box 63, the speed-prebalancing procedure calculates the final estimate of the optimum PSPD shifts, passing them to box 64 to be saved for final output and to box 65 so the test curve densities can be calculated after appropriate speed shifting.

If level prebalancing is applicable, the Y (yes) fork of decision box 53 diverts the logic flow through box 66 which in the manner previously described passes the PLVL shifts to box 67 to be saved for output. Box 66 also returns the vertically shifted test densities to the main flow for the previously described parameter calculations in box 54, which still has access to the original, unshifted, test densities of box 51.

Besides box 54, boxes 59, 63, and 66 must have access to the product master data in box 68 in order to perform the necessary calculations. In practice, the data of box 68 are determined in the manner previously described for each product, manually or using a general-purpose computer, and then stored in a suitable conventional manner, such as in a computer memory, until needed.

PRODUCT MASTER DATA

Figure 7:
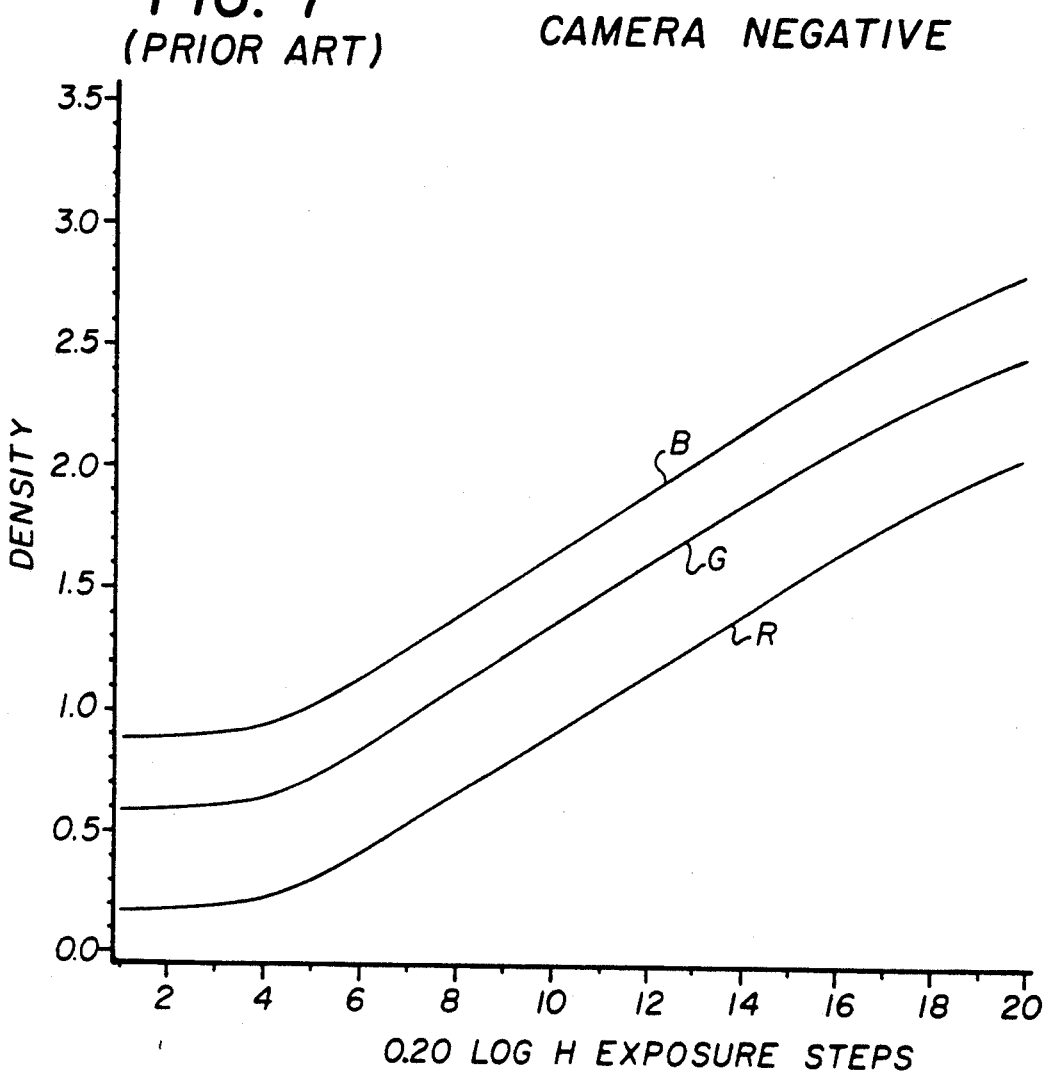
FIG. 7 (PRIOR ART)
Figure 8:
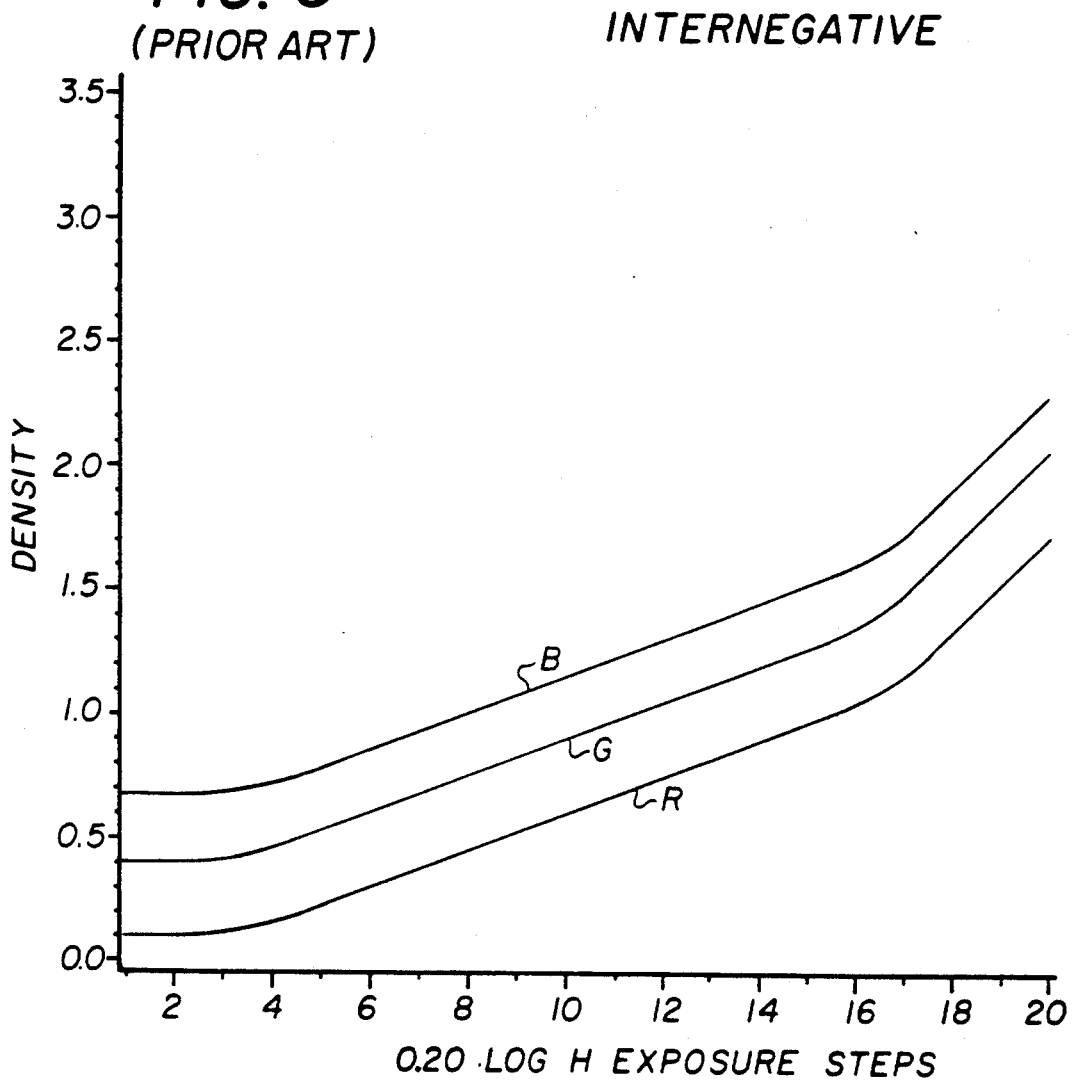
FIG. 8 (PRIOR ART)

To review the required limits and exposure step ranges for each parameter, the table in FIG. 26 is presented, using the camera negative of FIGS. 3 and 7 as a concrete example. Similar tables would be prepared for other products. In addition to the specifications in the table, the actual horn limits, the product aim densities, and the test sample densities are required to produce a composite display. Each of the following notes is prefixed by numbers or letters referring to the table's row or column labels:

A) Relevant exposure step ranges must be specified for all parameters except speed.

B) Root-mean-square type parameters and CMRL have this single-number tolerance.

C) The inner tolerances are set at some fraction of the release tolerances.

D–F) Cylinderized parameters are toleranced by three numbers. Except for those entries labeled percent (%), the numbers in these columns are arbitrarily multiplied by 100 to take up less space.

G–I) The three color deviate weights enrich the tolerancing flexibility for cylinderized parameters.

J–N) When a product is speed prebalanced, at least one of these Quality Objective Function weights must be greater than zero. (All three must be greater than or equal to zero.)

1–3) These parameters relate to the SQIP Plot.

4–5) These auxiliary quality parameters relate to CRE and ADE.

6–9) These auxiliary quality parameters all relate to contrast.

10) The step range here shows the number of adjacent exposure step increments contained in the contrast step interval. CMRL is the normalizing divisor for contrast mismatch.

11) The horn limits are used in the SQIP Plot.

12) See AQP 6, Cluster Hue.

13–14) These are AQPs related to speed and level prebalancing.

15–17) These are conventional parameters. The photographic speed parameter must be named and defined for each product. If OSE is shown on the composite display, BFS would generally be omitted.

18–20) Trilinear snapshots have these exposure step ranges.

21) See J–N above.

TIME TRENDS FOR AUXILIARY QUALITY PARAMETERS

Figure 28:
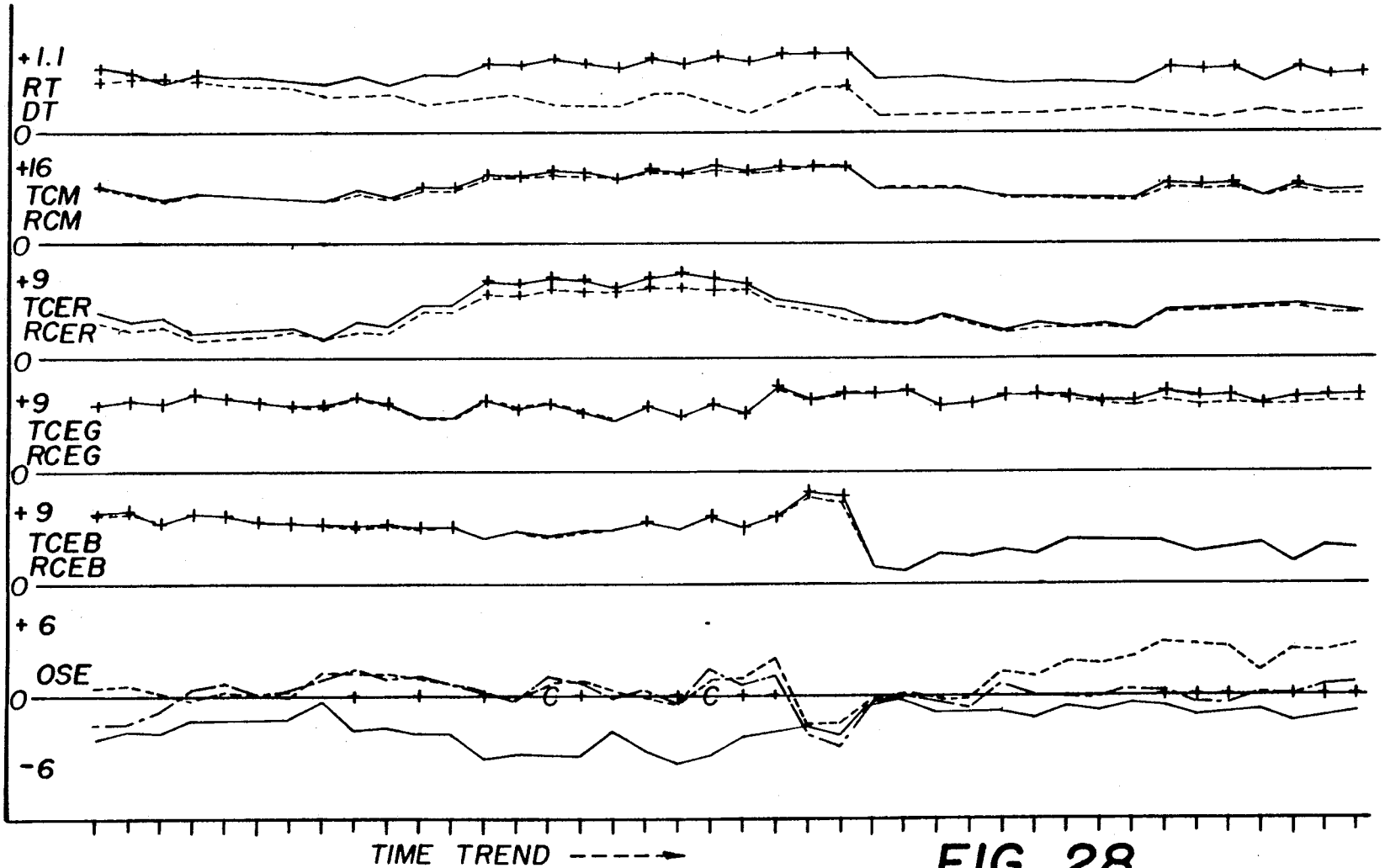
Figure 29:
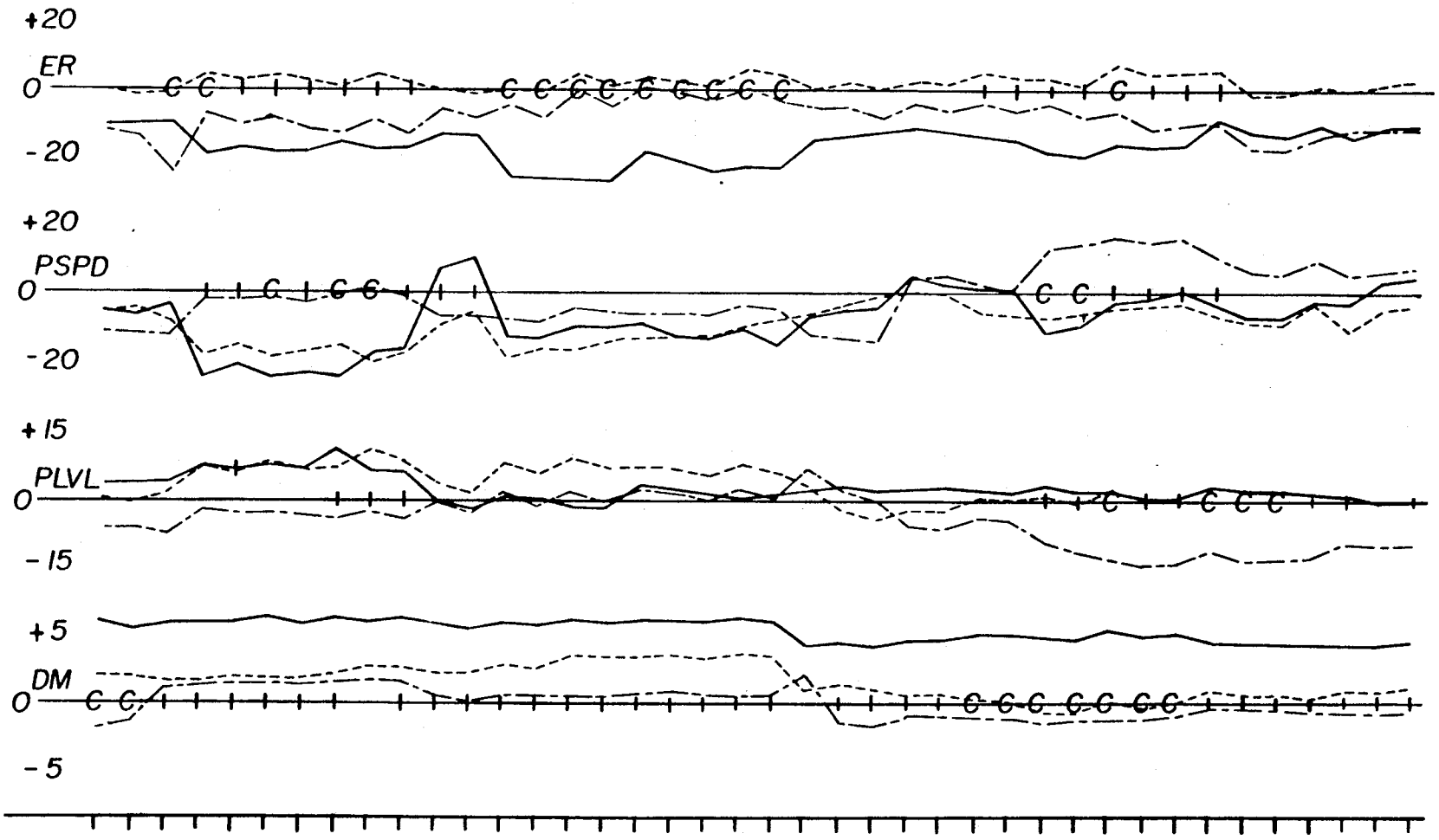

FIGS. 27-29, using an internegative as an example, show the comprehensive quality review available through AQP trend plots with sophisticated failure flagging. (In practice, these figures would be reduced and stacked vertically in a single, letter-sized document, more convenient for reviewing and filing.) In FIGS. 28-29, failing root-mean-square type parameters are flagged by asterisks (*); those exceeding inner limits only are indicated by plus signs (+). Failing tricolor parameters are flagged with a C, L, or B (color balance, level, or both); those exceeding inner limits only are indicated by plus signs (+). Three of the non-plotted parameters at the top of FIG. 27 need explanation: the first line, labeled "FLAG," reports the error box tally; the second line, "AIM#," reports the set number of the aim densities used with each test sample (only one aim is used in the example); and the tenth line, "RMAX," reports the exposure step number having the highest CRE-to-horn-value ratio, just for a little extra insight. Along the bottom of the trend plots, there is space for the identification of forty samples. Ordinarily, these time trends, and for that matter, all composite displays make use of color in the rendering of the lines, flags, and labels, each color chosen carefully to quicken comprehension. The judgement process is especially efficient when electronic screen displays or paper documents are rapidly generated by computer.

PRODUCTION CONTROL OF QUALITY PARAMETERS

In accordance with the invention, a manufacturing process for a photographic material contains an information feedback loop for making process adjustments when the density response of a product is unacceptable. The acceptability criteria are incorporated in the Quality Objective Function of Eq. 27 and 29, which any control scheme must seek to minimize.

Figure 31:
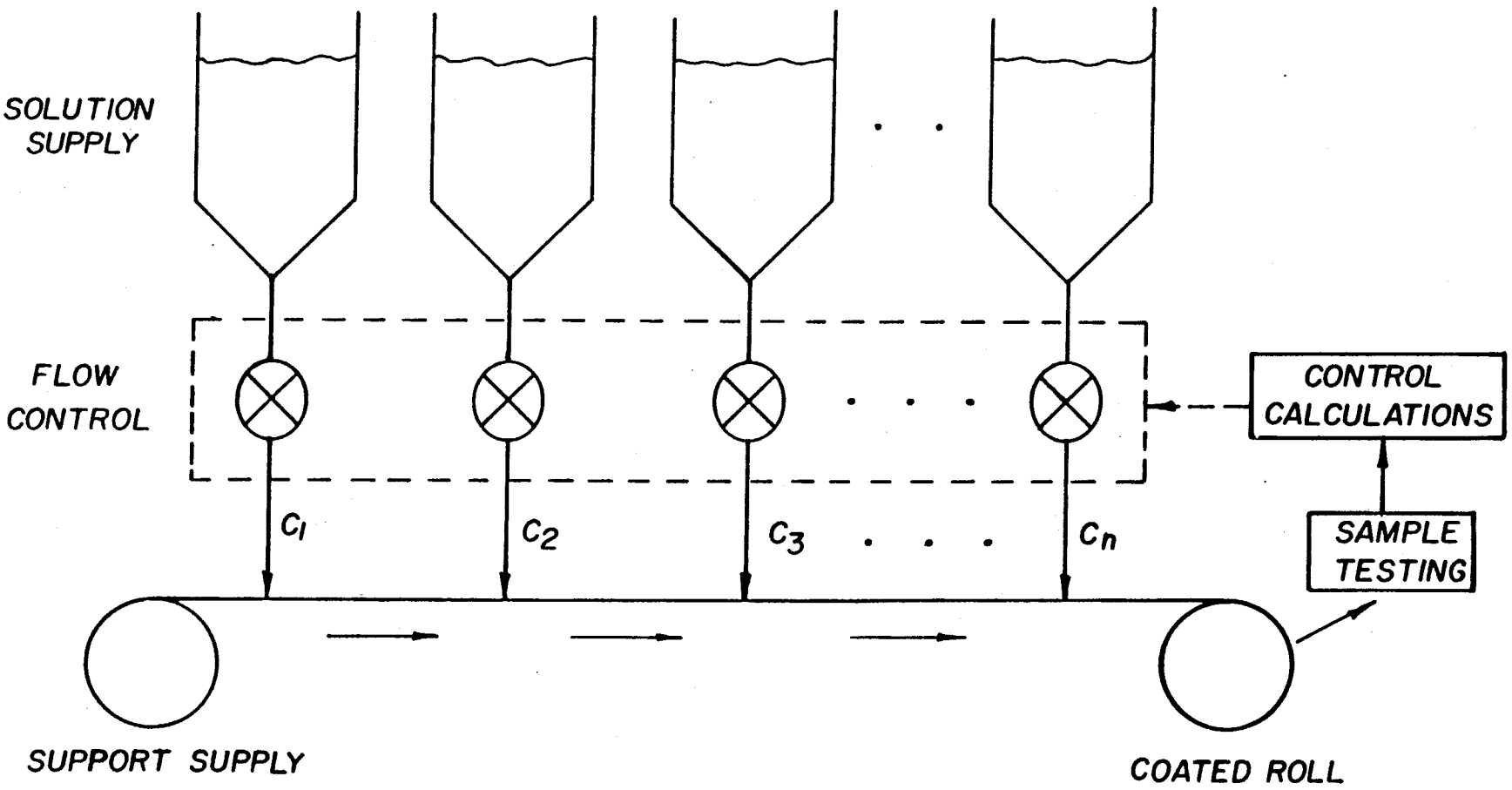
FIG. 31 gives a simplified symbolic diagram of a coating process for a photographic product, depicting one method of sensitometric control by adjusting the mass flow of coated solutions.
Figure 32:
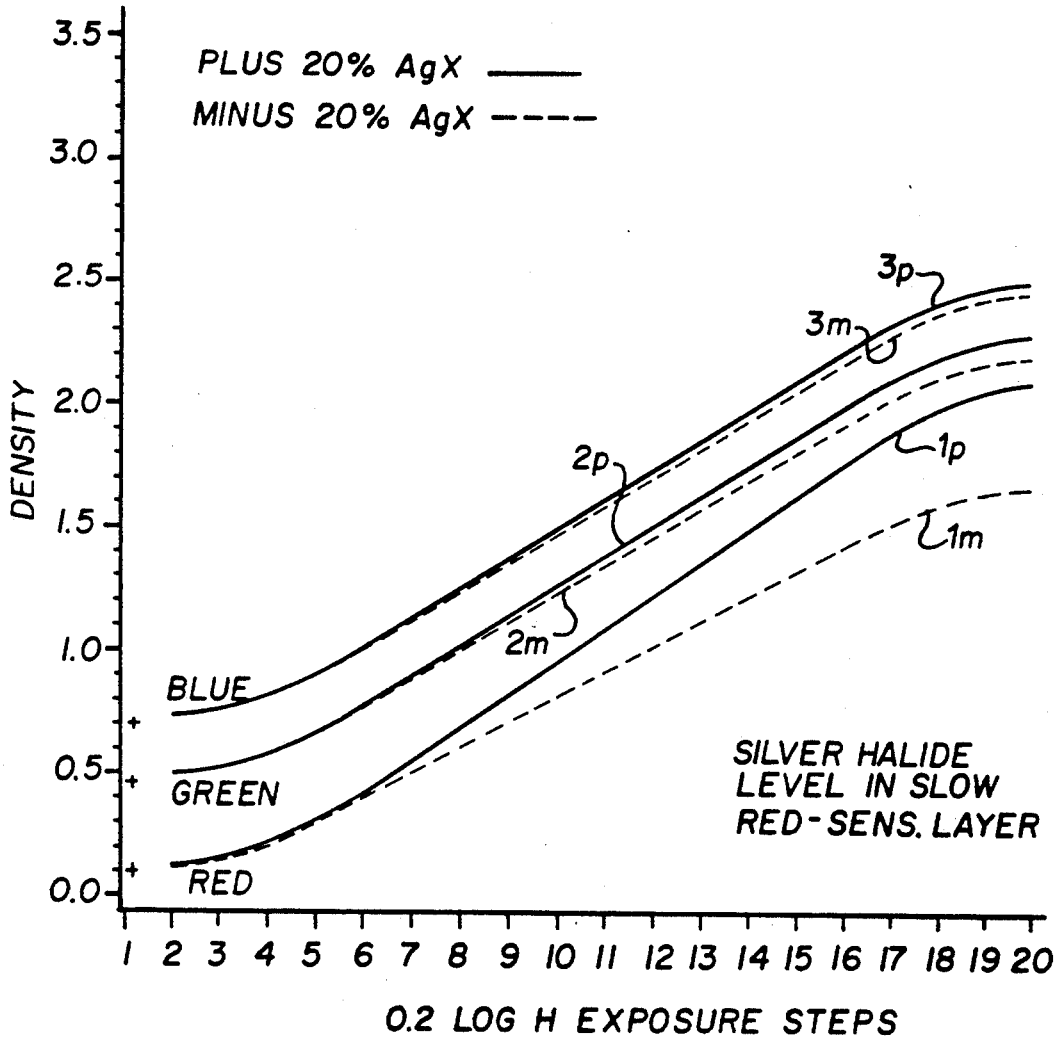
FIG. 32 illustrates the sensitometric calibration of one possible process control variable: silver halide level in the slow-speed, red-sensitive layer of a camera negative.

FIG. 31 shows a schematic diagram for a coating process with a possible vector of n control variable (CV) changes, $[c_1, c_2, c_3, \ldots, c_n]$. Each of the CVs must be calibrated to estimate the predicted effect of a unit change on the red, green, and blue density responses. Depending on convenience and relevance, unit changes of flow-rate percent, area concentration (mg/m$^2$), blend percent, etc., may be chosen. For any particular solution delivery configuration, some control variables are suited to on-line changes, while others are only suited to off-line reformulations. FIG. 32 shows a sample calibration for a camera negative where +10% (1*p*, 2*p*, 3*p*) and −10% (1*m*, 2*m*, 3*m*) level changes in the silver halide (AgX) emulsion components were made in a red-sensitive, slow layer. Assuming linearity throughout the change range, the unit effect would be a 60-component row vector of densities, $$[r_1, g_1, b_1, r_2, g_2, b_2, \ldots, r_{20}, g_{20}, b_{20}],$$

each r-g-b triplet corresponding to a particular exposure step where the density response of the −10% variant is subtracted from that of the +10% variant, by color, and the three differences divided by 20 to obtain the unit effect in each color for that step. Division is by 20 because there is a 20% difference between the +10% and −10% variants. Normally, the required prescriptive CV changes are small, so the assumption that CV density effects are linear in the vicinity of the aim is practical. On the other hand, if the assumption of linearity is questionable for a particular control variable, it probably should not be used anyway.

In addition to silver halide laydown, other examples of sensitometric control variables are dye-forming couplers to control density-response curveshape and level, and soluble red, green, or blue light-absorbing dyes to reduce effective photographic speed. Any chemical capable of empirical sensitometric calibration, whether or not isolated in its own delivery stream during coating operations, is a possible control candidate. If it provides linear control of some portions of the density response curves, it may, in combination with other control variables, contribute significantly to a scheme for overall curveshape control.

CONTROL VARIABLE PRESCRIPTIONS

An n×60 CV unit effects matrix (E) is formed by stacking the individual CV unit effects, so the estimated density changes for a vector of CV prescriptive changes is identical to Eq. 34:

$$\hat{y} = E'c \tag{44}$$

where $\hat{y}$ = 60×1 column vector of estimated 20-step density adjustments with the same ordering as for Eq. 34, $E'$ = E transpose, the transpose of the n×60 CV unit effects matrix defined in the preceding text, c = n×1 column vector of CV prescriptive change amounts in the same order as the unit effects are stacked in the E matrix.

In a manner identical to the combining of Eq. 29 and Eq. 34 and the subsequent application of the Generalized Least Squares procedure to obtain Eq. 37, Eq. 29 and Eq. 44 are combined to arrive at the following equation when the control variables are unconstrained:

$$c = -[EQE']^{-1}EQy \tag{45}$$

Practically, it is often necessary to apply constraints on the control variables (c) to moderate prescriptions. This places the solution in the domain of the optimization procedure known as Quadratic Programming. The derivation of Generalized Least Squares and Quadratic Programming solutions is outside the scope of this description, but the methods are understood by those skilled in the art and are explained in most textbooks dealing with the problems of optimization such as *Matrix Algebra Useful for Statistics* by Shayle R. Searle and *Foundations of Optimization* by Douglass J. Wilde and Charles S. Beightler.

However a prescriptive CV vector is obtained, the predicted densities ($y_P$) after the changes are found by adding the adjustments to the original test densities ($y_T$):

$$y_P = y_T + E'c \tag{46}$$

A composite display for the predicted results can then be prepared.

PARSIMONIOUS PRESCRIPTIONS

A parsimonious prescription is a vector of CV changes that may not be optimum, i.e., not minimize the Quality Objective Function, but does correct the density response of a test sufficiently to bring it well within the SQIP/AQP tolerances for a particular product.

Making CV changes no larger than necessary helps reduce solution waste and/or usage imbalance by adhering to the solution batch sizing plan for a coating incident as closely as possible. Parsimonious prescriptions also reduce the risk of inadvertent adjustments of chemical laydowns that could compromise image quality, color fidelity, or coated physical quality while wringing the last bit of density correction from a CV prescription. Then, too, the more moderate a remedial response, the less damaging an erroneous test signal or a human error. Many techniques may foster prescription parsimony:

1) Place hard constraints on the available CV changes. (As mentioned earlier, this brings into play the Quadratic Programming algorithm.)
2) Place soft constraints on the CV changes, adjustably dampening them while using the Quality Objective Function (Eqs. 22 or 29) as a referee. The method will be explained in a later section.
3) Based upon an analysis of testing variability and CV calibration uncertainty, hedge the prescriptive amounts by some percent.
4) Using the Quality Objective Function (Eqs. 22 or 29) as a referee, simplify the prescriptions by eliminating any CV change too small to be significant, or any change combinations whose net effect is insignificant—always checking the final predicted densities for acceptability in a composite display. This idea will be explored further.
5) When a particular batch test fails to meet aim speed, and the available CVs cannot effectively compensate, then temporarily shift the aim curves left or right as much as justifiable to allow the CVs to compensate for other density-curve defects. Actually, it is better to preshift the test curves by the justifiable amount, in the opposite direction, to keep the prescription optimization problem as near as possible to the aim, where the CV calibrations should be most accurate.
6) Relax the prescriptions as in item 5 above except preshift the test curves vertically by some justifiable amount to avoid excessive CV changes that would otherwise inefficiently compensate for overall level errors in any density curve.
7) In the case of a coating process where solutions are applied and dried so that tests can be made on some incomplete combination of red, green, and blue color-sensitive layers, use any such early density-curve data to strategically modify aims for later coating passes on the same product batch. Obviously, the aim modifications must be small enough to fall well within justifiable limits and must be anticipated by appropriate CV changes prior to initiating the later coating passes. As in item 5 above, desired aim modifications may better be applied to the test results with opposite polarity before calculating prescriptions, to better index the problem for speed with respect to the CV calibrations.
8) Instead of pre-shifting the test density curves after observing the practical failure of initial prescription trials as in items 5 and 6 above, make optimal shifting a part of the prescription process. This can be done by adding, at most, six extra rows to the effects matrix, (E), rows containing unit effects for red, green and blue "pseudospeed" and/or "pseudolevel" calibrations. These artificial unit effects are the same $3\times60$ matrices as those needed earlier for speed and level prebalancing. For pseudospeeds, as required for speed prebalancing, the prescription procedure is done twice: the first time to get tentative speed shifts for refining the initial estimated unit speed effects, and the second time to get the final prescription.

In item 8, the use of pseudospeed CVs may be complicated by curveshape correction requirements in the same way as described for speed prebalancing. If so, the preliminary approximate pseudospeed prescription provides an estimated speed balance shift. From this, via the Curveshape Correction Model (CCM), the aim density curve-shapes are adjusted temporarily for use in the final prescription calculations. The predicted densities without artificial pseudospeed/level shifts are obtained by first applying the full prescription to the test curves (including pseudospeeds, but not pseudolevels, if any), and then shifting for speed by the prescribed pseudospeed amounts with algebraic signs reversed.

SOFT CONSTRAINTS

Item 2 above, involving soft constraints, can be implemented by adding a second term to the Quality Objective Function of Eq. 36, $$F=[y+E'c]'Q[y+E'c]+\beta c'Uc, \tag{47}$$

thereby dampening the values in the prescription vector (c) found in the least squares solution:

$$c=-[EQE'+\beta U]^{-1}EQy \tag{48}$$

where

U = nxn diagonal matrix whose elements, $u_1 \geqq 0$ (n is the dimension of vector c, as before), $\beta \geqq 0$, the overall prescription dampening coefficient.

It is helpful to think of each of the diagonal elements of U as a product of three factors. The first factor is the corresponding diagonal element of [EQE'], a factor normalizing the dampening action on each CV to account for the different impact of each CV's unit effect on the Quality Objective Function. The second factor is identical for all diagonal elements and arbitrarily scales the strength of the overall coefficient ($\beta$) to make it effective over some convenient range such as from 0 to 10, or from 0 to 100. The third factor is unity except when specifically altered for a control variable (i.e., a diagonal element of U) in light of a particular product's needs. Some examples of this include: one, setting the factor to zero in the case of pseudospeed and pseudolevel CVs, so as to fully reflect the optimum density-curve translations; two, setting the factor for a particular CV to a level lower than for other CVs to constrain it less, perhaps because varying its usage rate would not incur waste or inconvenience; and three, setting the factor for a particular CV to a level higher than for other CVs to constrain it more, perhaps because its change could adversely impact cost or image quality.

Any value for the overall dampening coefficient ($\beta$) must ultimately be justified by the acceptability of the predicted densities as measured in a composite display. Overzealous prescription dampening can obviously fail to cure ailing quality.

IGNORING INSIGNIFICANT CV CHANGES

Item 4 in the section on parsimonious prescriptions suggests that the Quality Objective Function (Eq. 29) can be used to decide when to zero out a prospective CV change having a small impact on quality. The following procedure has been found useful in implementing this idea:

1) Calculate the value of the Quality Objective Function for a synthesized product sample with just a small overall slope error (e.g., 0.25% or 0.50%) in the green density curve. Make this the "threshold" value below which prospective CV changes may be ignored (zeroed).
2) Make a provisional list of "CV zero candidates" by selecting only those whose individual impact upon a set of aim densities produces a value of the Quality Objective Function below the threshold value.
3) Test the combined effect of all the CV zero candidates on a set of aim densities. If the value of the Quality Objective Function is below the threshold, all candidates may be zeroed; if not, retain as zero candidates all but the one with the largest individual effect on the Quality Objective Function and test the combined effect of the remaining zero candidates. Continue this pattern of candidate elimination until the combined effect of the remaining zero candidates falls below the threshold value.

Obviously, this procedure may not detect every possible combination of prospective CV changes (zero candidates or not) whose combined effects are insignificant, but it is conservative. When used in conjunction with soft constraints (previous section), which tend to minimize inefficient individual or combined CV changes, its effectiveness is amplified.

A PRESCRIPTION EFFECTIVENESS RATING

The value of the Quality Objective Function (Eq. 29), before (b) and after (a) applying the CV prescription, can be used to measure Prescription Effectiveness (PE):

$$PE = 100[1 - \sqrt{(F_a/F_b)}], \tag{49}$$

which expresses PE as a percent improvement in the square root of the Quality Objective Function. If speed and/or level prebalancing applies to a particular product, the sixty-component density deviation vector (y) should be calculated after prebalancing, the quality implications of which can be evaluated separately. The square root operation is recommended in Eq. 49 because the Quality Objective Function has been defined as the weighted sum of squares of important quality parameters (Eq. 22).

LOGIC FLOW FOR PRESCRIPTIONS

Figure 30:
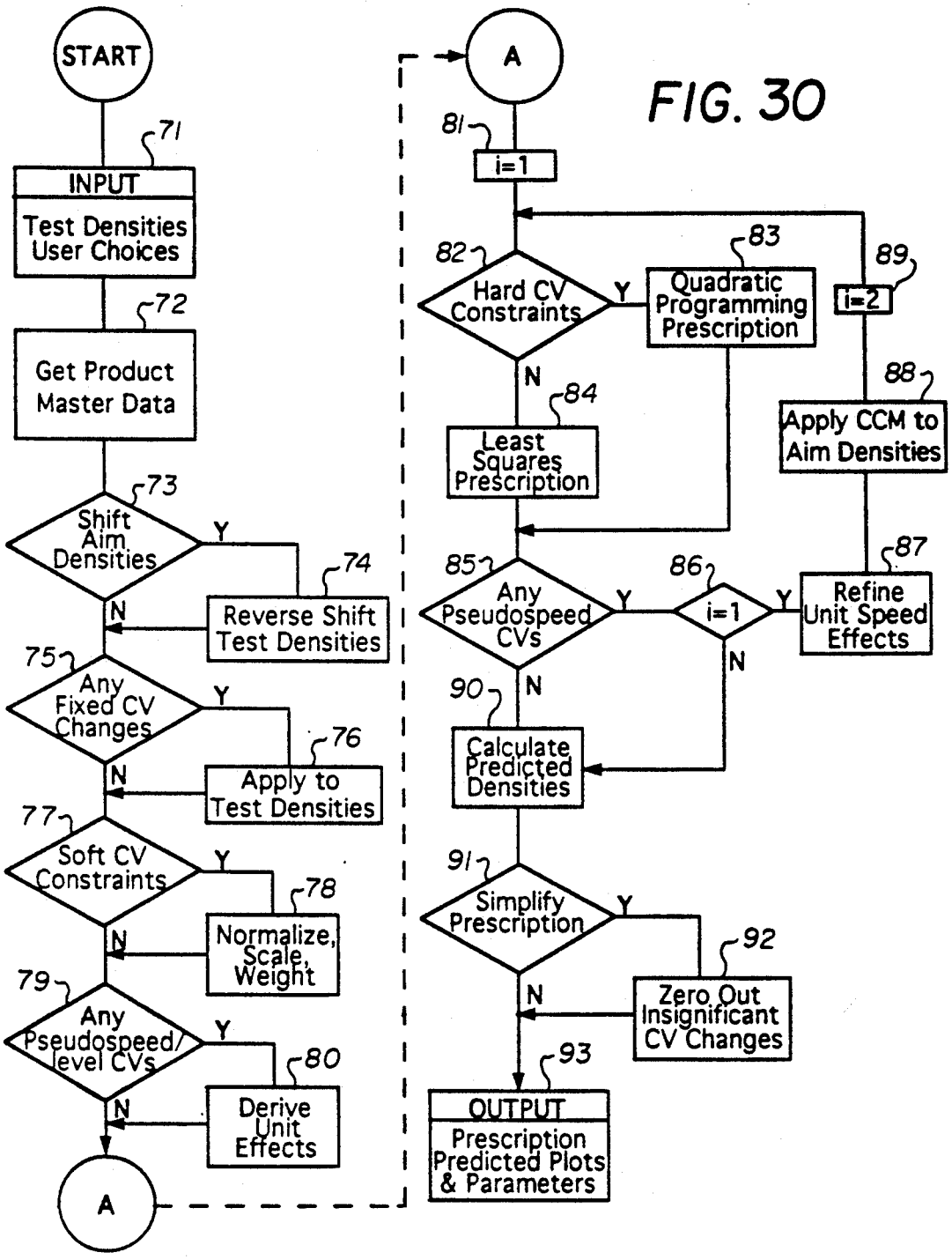
FIG. 30 outlines the logic flow for finding the changes in control variable settings (CV prescription) that will improve sensitometric quality in production, if necessary.

The simplified logic flow chart in FIG. 30 illustrates how many of the techniques discussed in the preceding sections are used to adjust control variable prescriptions. Those skilled in the art will appreciate that the operations illustrated in FIG. 30 are most readily performed using a general-purpose computer to apply the previously described equations and techniques. Box 71 provides the selected product test densities and other user choices related to the immediate prescription run, such as the amounts of any aim density-curve shifts, the control variable subset to be used, any user-prescribed fixed changes for specific control variables, the application and tuning of any soft or hard constraints on control variable changes, the adjustment of threshold significance levels for zeroing out small control variable changes, and the activation of any pseudospeed or pseudolevel control variables. (For any selected product, the user choices should be in the form of default overrides to simplify input.)

Depending on the choices made in box 71, the yes (Y) or no (N) forks of decision boxes 73, 75, 77, 79, 82, 85, and 91 are taken with the yes forks invoking the actions in boxes 74, 76, 78, 80, 83, 86, and 92, respectively. Two decision boxes, 82 and 85, deserve special mention. The use of hard contraints on any control variables results in prescription calculations via Quadratic Programming in box 83, with flow then bypassing the Least Squares prescription method in box 84. If any pseudospeed control variables are used, the indexing variable (i=1) in box 81 directs flow along the yes (Y) fork of decision box 86, resulting in the refinement of unit speed effects in box 87, the application of a Curveshape Correction Model (CCM) in box 88 (if necessary), and a resetting of the index variable (i=2) in box 89.

The no (N) forks of either decision box 85 or 86 lead to box 90 for the calculation of the predicted densities likely to result from the application of the recommended prescriptive changes in the control variables, so that a comprehensive output summary may eventually occur in box 93. The output would normally recapitulate the input choices, list the control variable prescriptions along with a prescription effectiveness rating (PE), and produce two composite displays, one based on the original test densities; the other, on the predicted densities. In the example of FIG. 31, the control variable changes would be used to adjust the flow rates of coating solutions.

AN INTERNEGATIVE EXAMPLE OF A PRESCRIPTIVE TRIAL

Figure 34:
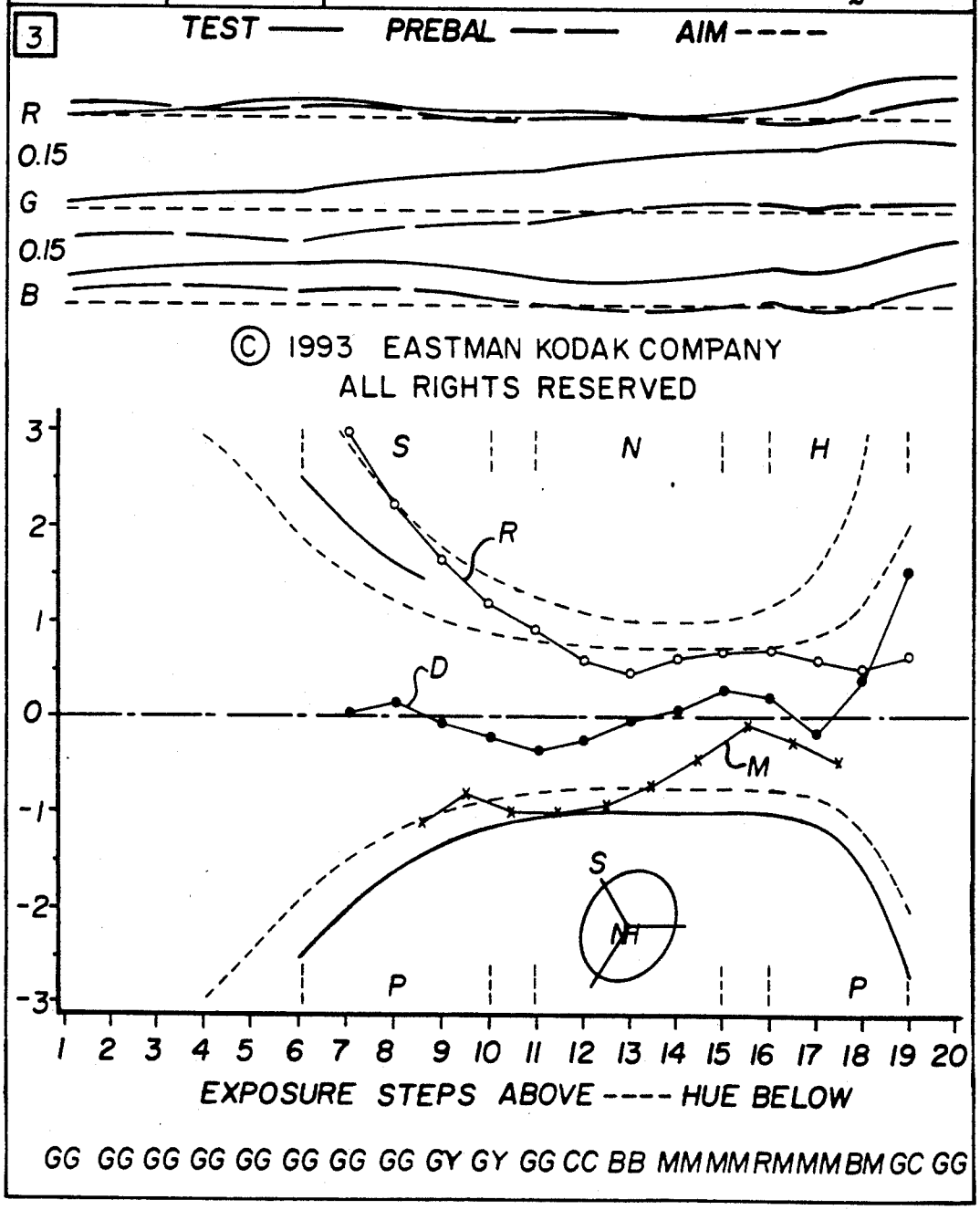
FIG. 34 is a composite display for a test batch of internegative film, unacceptable for sensitometric quality.

In FIG. 34, an initial composite display of a test batch of internegative film rejects it for three sensitometric parameters falling outside their release limits (see the Error Tally Box). Flagged by asterisks (*), the failing parameters are RT, TCM, and NRO. NRO, the number of CRE values outside the release horn, can be identified as those "R" points above the upper solid horn line in the SQIP plot. Flagged by plus signs (+), two root-mean-square parameters exceed inner tolerances only: RCM and green TCE. Flagged by a lower-case script "l", one cylindrically-toleranced parameter, PSPD, also exceeds the ALE dimension of its inner tolerance only.

In a computer run, several control variable changes were prescribed to improve sensitometric quality: −7.5% slow cyan solution flow rate, +4.4% medium-speed cyan solution (silver halide components only), −4.9% slow magenta solution, −10.0% fast magenta solution (dye-forming couplers only), −5.0% fast magenta solution (silver halide components only), +7.7% slow yellow solution, and +9.8% fast yellow solution (silver halide components only). The run used the quadratic programming scheme of optimization because hard constraints were placed on all the control variables; in fact, the −10% prescription on the fast magenta couplers is the result of a +10% constraint. To further dampen prescriptive changes, a moderate level of soft constaints was applied, and all pseudospeed and pseudolevel variables were invoked. The prescriptive red, green, and blue pseudospeed changes were −0.049, +0.021and −0.097 LOG H, respectively. Similarly, the three pseudolevel changes were −0.008, −0.036, and −0.020 density units. (It may be recalled from an earlier discussion that these pseudovariables are applied only in the mathematical optimization procedure to help minimize the required real flow changes; they are not physically available during a coating operation.)

Figure 35:
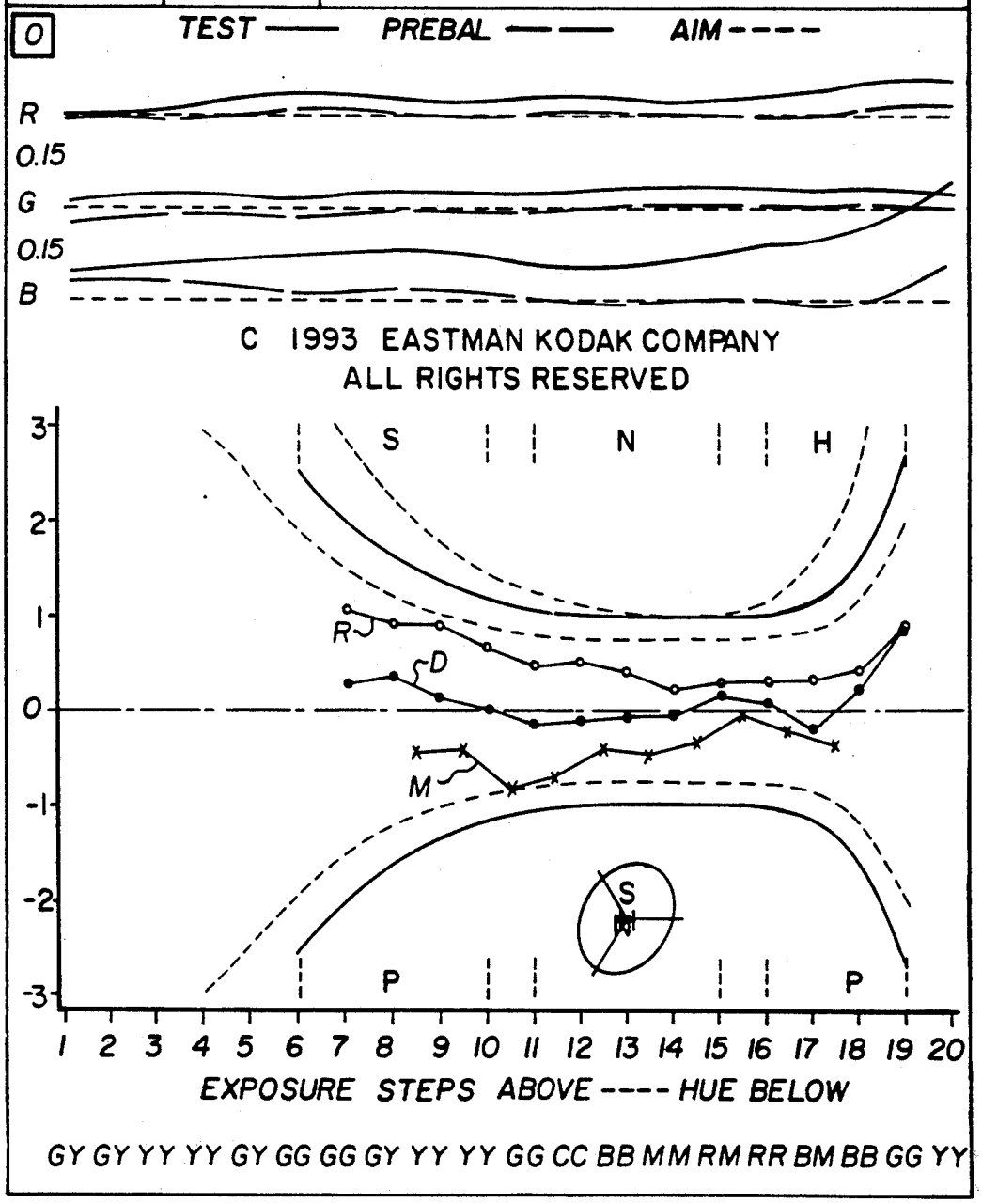
FIG. 35, using the internegative test batch of FIG. 34, shows the composite display predicted through a mathematical quality optimization procedure in which changes in the flow rate of seven process-control solutions are expected to substantially improve sensitometric quality.

The prescription effectiveness (PE) rating for the run was a highly significant 41.4%, as confirmed by the predicted composite display shown in FIG. 35, where all parameters are forcast to be within inner tolerances—an excellent prognosis. In fact, real coatings, using the prescription, were close to expectations.

APPARATUS FOR IMPLEMENTATION

Figure 33:
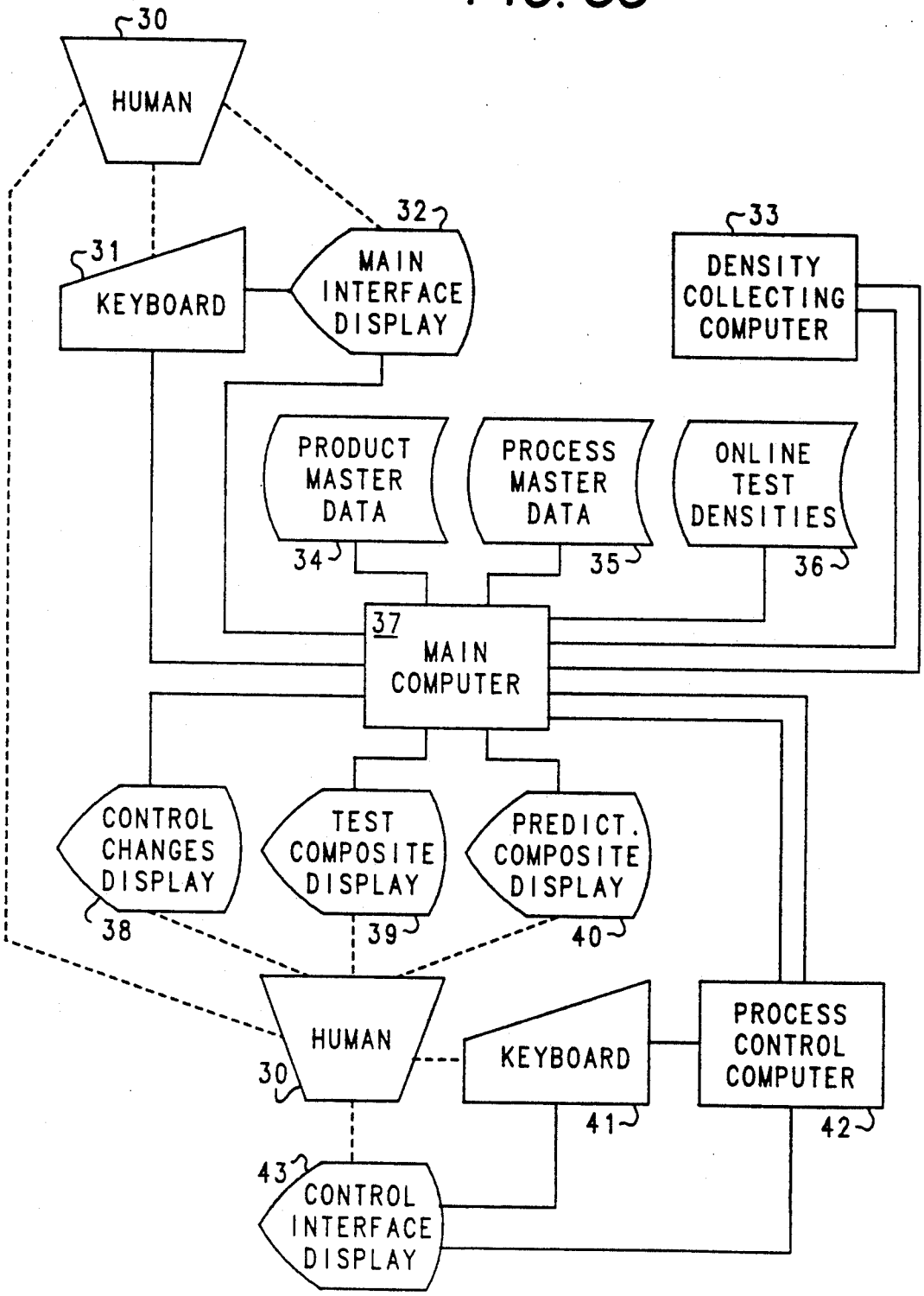
FIG. 33 is a flow diagram showing the apparatus and interconnections required for a practical implementation of the invention.

FIG. 33 is a flow diagram showing the apparatus and connections required for the practical implementation of the invention. An operator (30) initiates a request through keyboard (31) to the main computer (37) to evaluate a product test sample by responding to menus and messages on the main interface display (32). The main computer (37) accesses online product master data files (34), process master data files (35), and measured test density files (36) in order to calculate and present three output displays: prescriptive control variable changes (38), an SQIP/AQP composite display based on the test densities (39), and an SQIP/AQP composite display based on the calculated predicted densities (40) likely to result from the control changes. The online test density files (36) are continuously updated by the density collecting computer (33). The main computer can direct the control variable change recommendations directly to the process control computer (42), which orders the necessary changes in the process control variables. Or, the operator (30) may intervene via keyboard (41) and control interface display (43). Displays 32, 38, 39, 40, and 43 may be presented on a single monitoring device in a compact workstation with a single keyboard (31 and 41).

The method and overall operation of the apparatus of our invention will be readily understood by those skilled in the art from consideration of the preceding description, particularly the logic diagrams of FIGS. 25 and 30, the manufacturing apparatus of FIG. 31, and the control system of FIG. 33. Product and process master data are provided to memory units 34 and 35. The density responses of the production sample are provided to the memory unit 36. For each density response, the deviation of the sample from aim is determined by main computer unit 37 using data from units 34 and 36. Sensitometric quality indicator parameters R, D, and M then are calculated from the deviations or responses or both, as shown by logic box 54 of FIG. 25 and by units 34, 36, and 36 of FIG. 33, using Eqs. 3, 4, and 7 and their antecedents. For each product, the aim responses for at least one primary color, preferably green, are transformed by means such as unit 37 into tolerance limit values and provided to unit 34, as shown by logic boxes 68 and 72 in FIGS. 25 and 30. Depending on the particular product, the tolerance limit values are scaled using Eqs. 8 or 39. Then, as shown by logic boxes 55 and 93 of FIGS. 25 and 30 and displays 39 and 40 of FIG. 33, the quality indicator parameters are visually presented to the operator for consideration.

The number of times that each quality indicator parameter exceeds the tolerance limit values or the reduced tolerance limit values, and the cluster hue point CHUE are determined by units 34, 36, and 37 and presented on displays 39 and 40. Units 34, 36, and 37 also determine the normalized root mean square DT using Eq. 9; the normalized root mean square RT using Eq. 10; the total contrast mismatch TCM using Eq. 12; the total contrast errors TCE using Eq. 13; the residual contrast errors RCE using Eqs. 14, 15, 20, and 13; the residual contrast mismatch RCM using Eqs. 12, 14, and 6; the overall slope error OSE using Eqs. 16, 20, and 21; the root mean square error HT using Eq. 23; the square root CT of the sum of the squares of the total contrast errors using Eq. 24; and the weighted contrast mismatch MT using Eq. 26. Prebalancing by shifting to faster or slower speeds, as shown by logic boxes 52 and 56–65 of FIG. 25, is achieved by units 34, 36, and 37. Changes in shape of the shifted density response curves, as shown by logic box 59 of FIG. 25, are achieved by units 34, 36, and 37. Similarly, shifting to higher or lower densities, as shown by logic boxes 53, 66, and 67 of FIG. 25 is achieved by units 34, 36, and 37.

To control an apparatus and process of the type shown in FIG. 31, the quality objective function of Eq. 22 is formed by unit 37 and organized according to the matrix notation of Eq. 29. The unit effects of the process control variables CV are provided to unit 35 of FIG. 33 in the matrix organization of Eq. 44. Unit 37 then uses the quality objective function and the unit effects information in accordance with Eqs. 45 or 48 to determine and display (unit 38) the changes in control variables for minimization of the value of the quality objective function. As discussed in the text following Eq. 46, various constraints may be placed on the permissible changes in the control variables, such constraints being part of the information provided to units 34 and 35. Unit 37 uses the information in unit 34 in conjunction with Eq. 46 to prepare a predicted composite display as depicted by unit 40.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. A method for controlling a process for making a photographic film or paper product, comprising the steps of:

determining for the process and the product a set of control variables, $CV_i$ to $CV_n$, for each of which a change of a known magnitude will produce a corresponding change in the density response of the product in one or more of three primary colors to exposure over a range of exposure steps;

removing a sample from a production batch of the product;

measuring the density response in three primary colors to exposure of the sample over the range of exposure steps;

determining for each density response the deviation of the sample from an aim response for that color for the product;

transforming the deviations or responses or both into sensitometric quality indicator parameters representing color radial error R, average density error D and contrast mismatch error M, wherein R is determined from data points entered within a closed elliptical curve in a color density balance plane with trilinear coordinates;

transforming the aim response for at least one primary color into tolerance limit values for the quality indicator parameters, thereby defining boundaries of acceptable sensitometric quality of the product;

determining a root mean square error HT of the density responses in accordance with the following expression:

$$HT^2=\{[\Sigma_i(r/L)_i^2]/AXG^2+[\Sigma_i(g/L)_i^2]/AXG^2+[\Sigma_i(b/L)_i^2]/AXB^2\}/3\Sigma_i(1/L_i)^2,$$

where $\Sigma_i$ is the summation over the relevant step range; $r_i$, $g_i$ and $b_i$ are density errors on exposure step i; $L_i$ is the tolerance limit value of the ith step; AXG is the length in density units of the green axis of the closed elliptical curve; and AXB is the length in density units of the semi-major blue axis of the closed elliptical curve;

determining a root mean square DT of exposure stepwise values of D within a predetermined exposure step range, in accordance with the following expression:

$$DT=[\Sigma_i(D_i/L_i)^2/\Sigma_i(1/L_i)^2]^{\frac{1}{2}}$$

where $D_i$ is the value of D at the ith step;

determining a root mean square RT of exposure stepwise values of R within a predetermined exposure step range, in accordance with the following expression:

$$RT=[\Sigma_i(R_i/L_i)^2/\Sigma_i(1/L_i)^2]^{\frac{1}{2}}$$

where $R_i$ is the value of R at the ith step;

determining a weighted contrast mismatch MT, in accordance with the following expression:

$$MT^2=\{\Sigma_i[CM_i/L_i^*]^2\}/\Sigma_i[1/L_i^*]^2,$$

where $CM_i$ is the contrast mismatch for the ith contrast step interval; and $L_i^*$ is the tolerance limit value in the center of the contrast step interval beginning with the ith exposure step;

determining a square root CT of the sum of the squares of total contrast errors over all colors, in accordance with the following expression:

$$CT^2=WTCE_R^2+WTCE_G^2+(AXG/AXB)^2(WTCE_B^2),$$

where each WTCE is determined in accordance with the following expression:

$$WTCE^2=\{\Sigma_i[CE_i/L_i^*]^2\}/\Sigma_i[1/L_i^*]^2,$$

where CE is the average contrast error for each color in percent over an n-step interval beginning with the ith step;

defining a quality objective function F, in accordance with the following expression:

$$F=f_1[HT/w_1]^2+f_2[DT/w_2]^2+f_3[RT/w_3]^2+f_4[MT/w_4]^2+f_5[CT/w_5]^2,$$

where $f_1$ to $f_5$ are weighting factors and $w_1$ to $w_5$ are normalizing factors;

using the changes to the set of control variables and the corresponding changes to the density responses to determine the magnitudes of the control variables for minimization of the value of the quality objective function; and adjusting the magnitudes of the control variables to achieve the minimization and control the said process for making a photographic film or paper product.

2. A method according to claim 1, wherein a maximum permissible normalized tolerance limit value is established for R at a reference exposure level, by selecting the trilinear coordinates of the closed elliptical curve in the color density balance plane; the product is for direct viewing, including a camera reversal film, a reversal duplicating film, a photographic paper or a photographic print film; and the permissible normalized tolerance limit values for the product are established at exposure levels other than the reference exposure level using at least one primary color density response curve, in accordance with the following lightness weighting expression:

$$L_i=\pm(10)^{w(di-do)},$$

where $L_i$ is the limit value for the ith exposure level; 10 is the base of the decadic logarithm; $d_o$ is the density at the reference exposure level; $d_i$ is the density at the ith exposure level; and w is the exponential power of the lightness weighting action.

3. A method according to claim 1, wherein a maximum permissible normalized tolerance limit value is established for R at a reference exposure level, by selecting the trilinear coordinates of the closed elliptical curve in the color density balance plane; the product is not for direct viewing, including a camera negative film, a laboratory internegative film or an intermediate film, each of which must be printed onto a print material for direct viewing; and the permissible normalized tolerance limit values for the product are established at exposure levels other than the reference exposure level using at least one primary color density response curve, in accordance with the following lightness weighting expression:

$$L_i=\pm C_o/C_i(10)^{w(di-do)},$$

where $L_i$ is the limit value for the ith exposure level for the product; $C_o$ is the print material's contrast at its reference density point; $C_i$ is the print material's contrast at a print-through density for the ith step of the product; 10 is the base of the decadic logarithm; $d_o$ is the print material's density at its reference exposure level; $d_i$ is the print material's density resulting from exposure through the ith exposure step of the product; and w is the exponential power of the lightness weighting action.

4. A method according to claim 1, wherein R is determined in accordance with the following expression:

$$R^2=(r-g)^2/(AXG)^2+(b-r)(b-g)/(AXB)^2$$

where r is the red density deviation of the sample from the red aim density for the product; g is the green density deviation of the sample from the green aim density for the product; b is the blue density deviation of the sample from the blue aim density for the product.

5. A method according to claim 1, wherein a maximum permissible normalized tolerance limit value is established for R at a reference exposure level, by selecting the trilinear coordinates of the closed elliptical curve in the color density balance plane and D is determined in accordance with the following expression:

$$D=(r+g+b)/[3(ADRL)]$$

where r is the red density deviation of the sample from the red aim density for the product; g is the green density deviation of the sample from the green aim density for the product; b is the blue density deviation of the sample from the blue aim density for the product; $\frac{1}{3}$ is a factor providing the average value for the sum (r+g+b); and ADRL is a maximum acceptable value of D at the reference exposure level.

6. A method according to claim 1, wherein a maximum permissible normalized tolerance limit value is established for R at a reference exposure level, by selecting the trilinear coordinates of the closed elliptical curve in the color density balance plane and M is determined in accordance with the following expression:

$$M^2=0.5[(CE_R-CE_G)_i^2+(CE_G-CE_B)_i^2+(CE_B-CE_R)_i^2]/(CMRL)^2$$

where 0.5 is a scaling factor; $CE_{Ri}$ is the average red contrast error in percent over a light exposure interval of n adjoining exposure steps; $CE_{Gi}$ is the average green contrast error in percent over a light exposure interval of n adjoining exposure steps; $CE_{Bi}$ is the average blue contrast error in percent over a light exposure interval of n adjoining steps; i is an integer in a range representing exposure steps spanning the light sensitive range of a product; and CMRL is a contrast mismatch reference limit chosen to reject any batch having an absolute value of M greater than unity at the reference exposure level.

7. A method according to claim 1, wherein the at least one primary color is green.

8. A method according to claim 1, wherein the product is a color print material, further comprising, prior to the determining step, a prebalancing step of shifting the density response in the three primary colors to faster or slower speeds toward the aim responses for each color; and the determining step applies to the shifted density responses.

9. A method according to claim 8, further comprising a step of changing the shape of the shifted density response curves when the speed shifts are unequal for the three primary colors.

10. A method according to claim 1 wherein the product is a camera negative material, further comprising, prior to the determining step, a prebalancing step of shifting the density response in the three primary colors to higher or lower densities toward the aim responses for each color.

11. A method according to claim 1 wherein the product is a laboratory internegative or laboratory intermediate material, further comprising, prior to the determining step, prebalancing steps of first shifting the density response in the three primary colors to faster or slower speeds toward the aim responses for each color and then shifting the density response in the three primary colors to higher or lower densities toward the aim responses for each color.

* * * * *